US011337875B2

(12) United States Patent
Wilson

(10) Patent No.: US 11,337,875 B2
(45) Date of Patent: May 24, 2022

(54) WHEELCHAIR LIFT-TRANSFER DEVICE

(71) Applicant: Harold R Wilson, Holland, MI (US)

(72) Inventor: Harold R Wilson, Holland, MI (US)

(73) Assignee: Adaptive Mobility, LLC, Grand Rapids, MI (US)

( * ) Notice: Subject to any disclaimer, the term of this patent is extended or adjusted under 35 U.S.C. 154(b) by 885 days.

(21) Appl. No.: 15/868,664

(22) Filed: Jan. 11, 2018

(65) Prior Publication Data

US 2019/0008710 A1 Jan. 10, 2019

Related U.S. Application Data

(63) Continuation-in-part of application No. PCT/US2017/040723, filed on Jul. 5, 2017.

(51) Int. Cl.
*A61G 7/10* (2006.01)

(52) U.S. Cl.
CPC ..... *A61G 7/1046* (2013.01); *A61G 7/1019* (2013.01); *A61G 7/1025* (2013.01); *A61G 7/1048* (2013.01); *A61G 7/1051* (2013.01); *A61G 7/1055* (2013.01); *A61G 7/1057* (2013.01); *A61G 7/1059* (2013.01); *A61G 7/1074* (2013.01); *A61G 2200/34* (2013.01); *A61G 2200/36* (2013.01)

(58) Field of Classification Search
CPC .. A61G 7/1078; A61G 7/1069; A61G 7/1067; A61G 7/1019; A61G 7/1017
See application file for complete search history.

(56) References Cited

U.S. PATENT DOCUMENTS

| | | | | | |
|---|---|---|---|---|---|
| 710,304 | A | * | 9/1902 | Rose | A61G 7/1007 5/219 |
| 2,962,730 | A | * | 12/1960 | Carnes | A61G 7/053 5/86.1 |
| 3,205,512 | A | * | 9/1965 | Camper | B66C 19/00 5/86.1 |
| 4,435,863 | A | | 3/1984 | Lerich | |
| 4,719,655 | A | | 1/1988 | Dean | |
| 5,112,076 | A | * | 5/1992 | Wilson | A61G 5/045 180/907 |
| 5,255,934 | A | * | 10/1993 | Wilson | A61G 5/045 180/907 |
| 5,319,817 | A | | 6/1994 | Hay et al. | |
| 5,380,034 | A | | 1/1995 | Wilson | |
| 5,466,111 | A | | 11/1995 | Meyer | |
| 5,538,268 | A | | 7/1996 | Miller | |

(Continued)

OTHER PUBLICATIONS

The International Search Report and Written Opinion of the International Searching Authority for PCT/US2017/40723, date completed Sep. 12, 2017, dated Dec. 11, 2017.

*Primary Examiner* — Peter M. Cuomo
*Assistant Examiner* — Ifeolu A Adeboyejo
(74) *Attorney, Agent, or Firm* — Mark L. Maki; Miller Canfield

(57) ABSTRACT

An improved wheelchair lift-transfer device provides capabilities for a patient or caregiver to independently control the wheelchair and lift functions to elevate and move about safely. The compact lift-transfer device is readily usable to assist in transporting and lifting patients from various locations including wheelchairs, beds and chairs. Further, the lift-transfer device is also collapsible for storage and transport.

15 Claims, 54 Drawing Sheets

(56) References Cited

U.S. PATENT DOCUMENTS

| | | | | |
|---|---|---|---|---|
| 5,704,439 | A * | 1/1998 | Kitahama | A61G 7/1046 180/65.1 |
| 5,758,371 | A * | 6/1998 | VanDyke | A61G 7/1015 5/86.1 |
| 6,092,247 | A | 7/2000 | Wilson | |
| 6,161,232 | A | 12/2000 | Von Schroeter et al. | |
| 6,430,761 | B1 * | 8/2002 | Brandorff | A61G 7/053 5/81.1 R |
| 8,910,326 | B2 * | 12/2014 | Wilson | A61G 7/1011 5/86.1 |
| 2006/0213007 | A1 * | 9/2006 | Palay | A61G 7/1019 5/81.1 R |
| 2010/0154115 | A1 * | 6/2010 | Wernqvist | A61G 7/1096 5/86.1 |
| 2013/0111660 | A1 * | 5/2013 | Wilson | A61G 7/1019 5/86.1 |
| 2017/0020293 | A1 * | 1/2017 | Duff | B60N 2/3056 |

* cited by examiner

FIG. 5
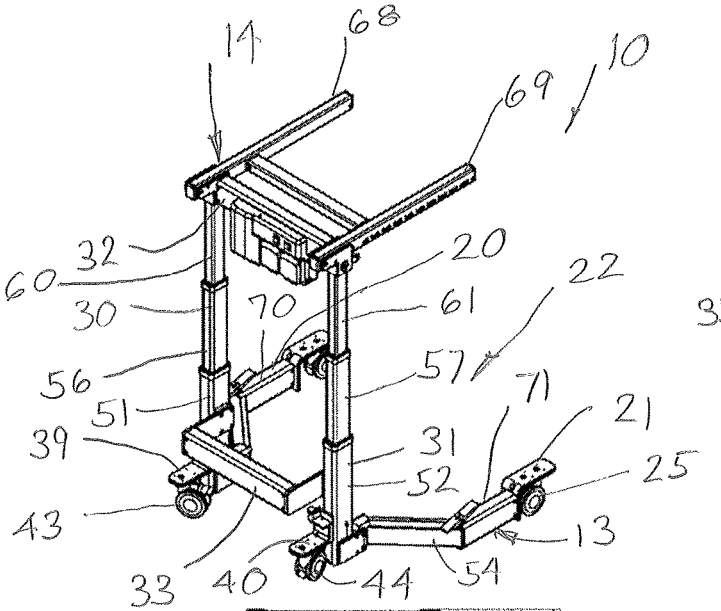
FIG. 6
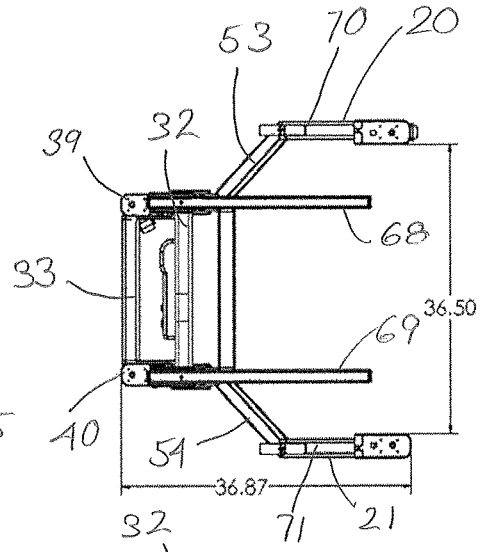
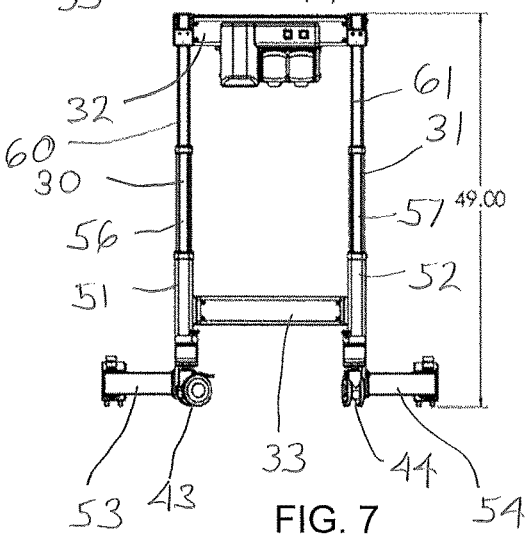
FIG. 7
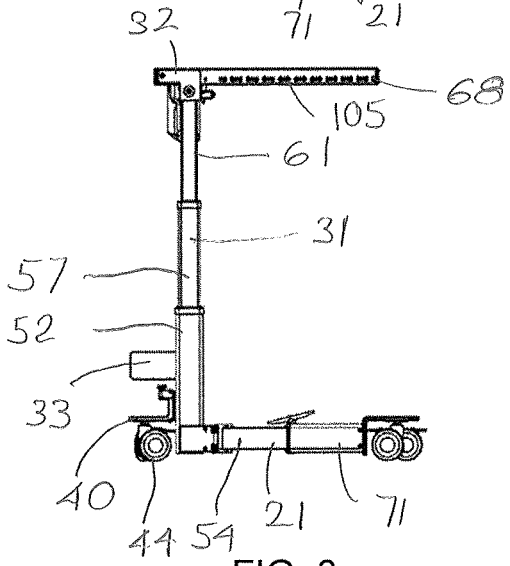
FIG. 8

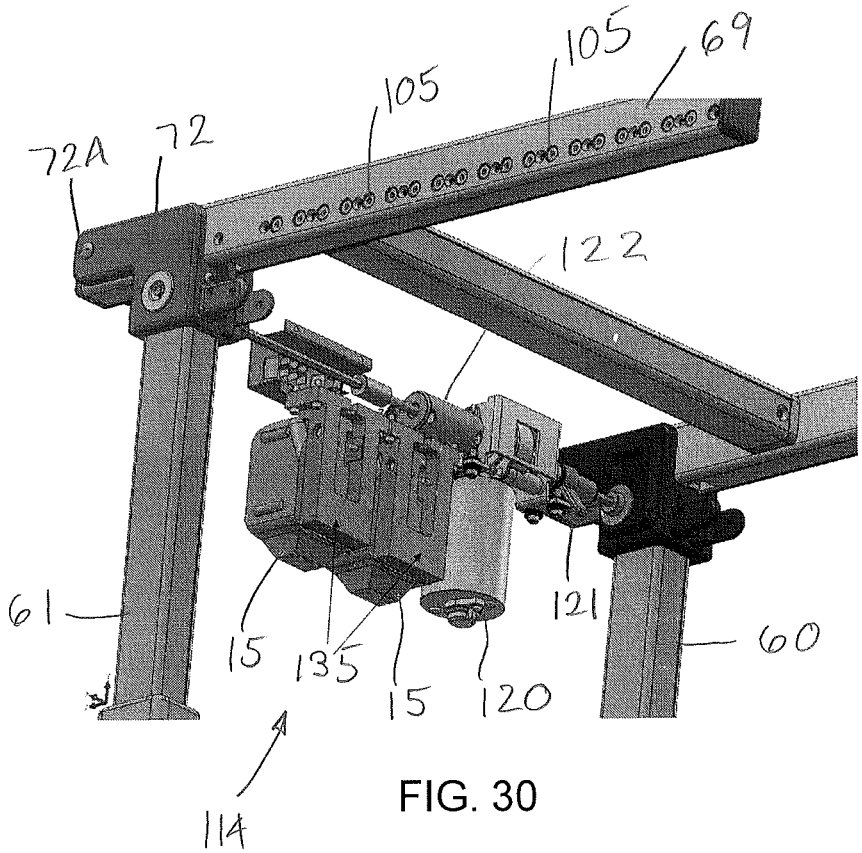
FIG. 30
FIG. 31
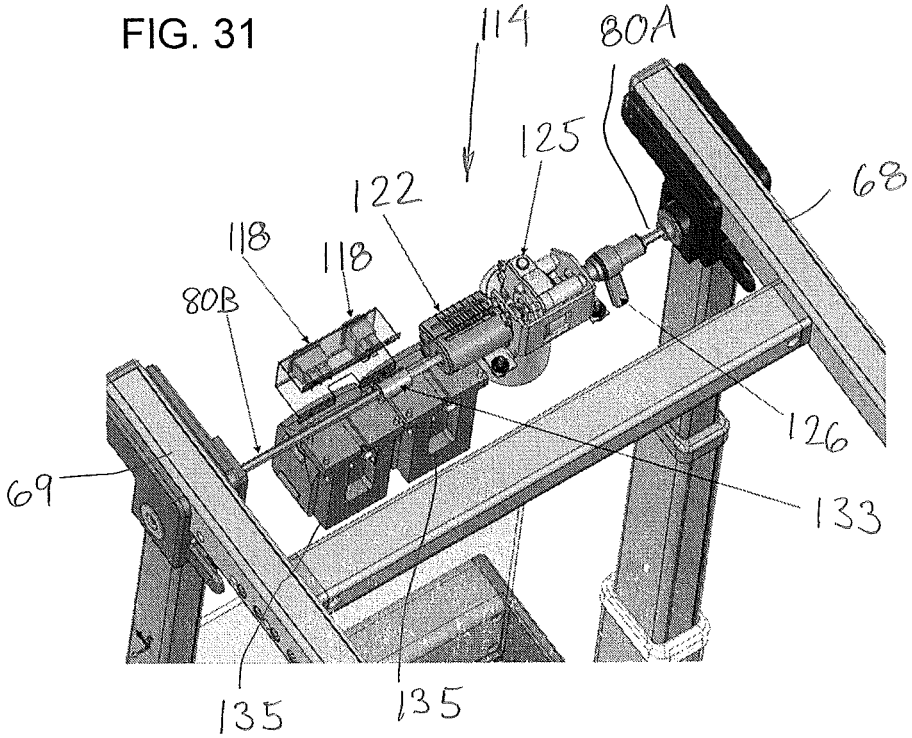

FIG. 40A
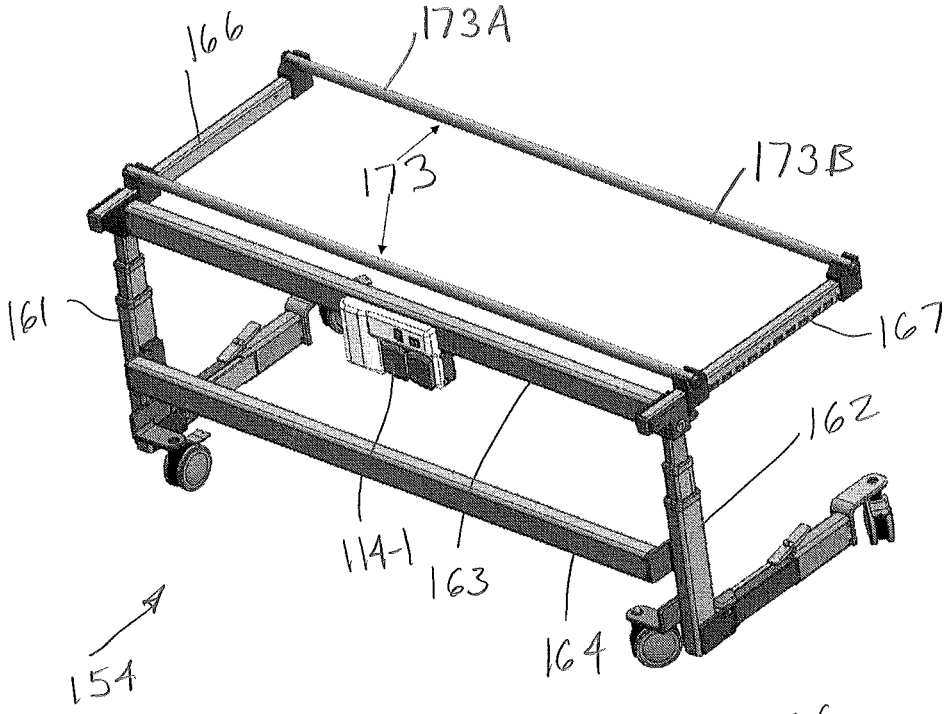
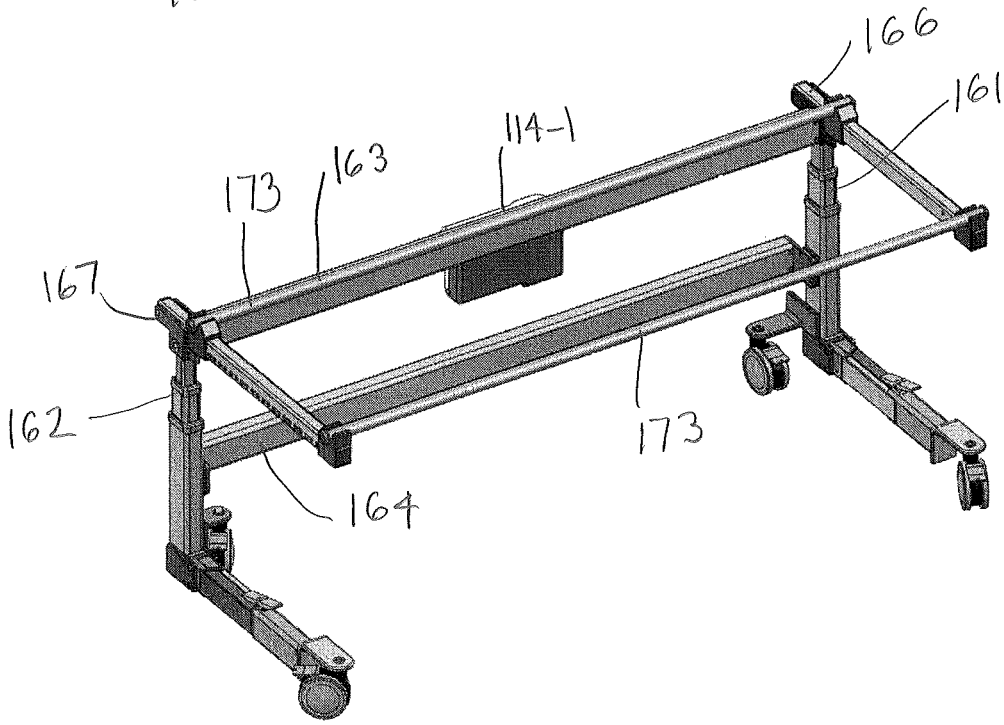
FIG. 40B

FIG. 45
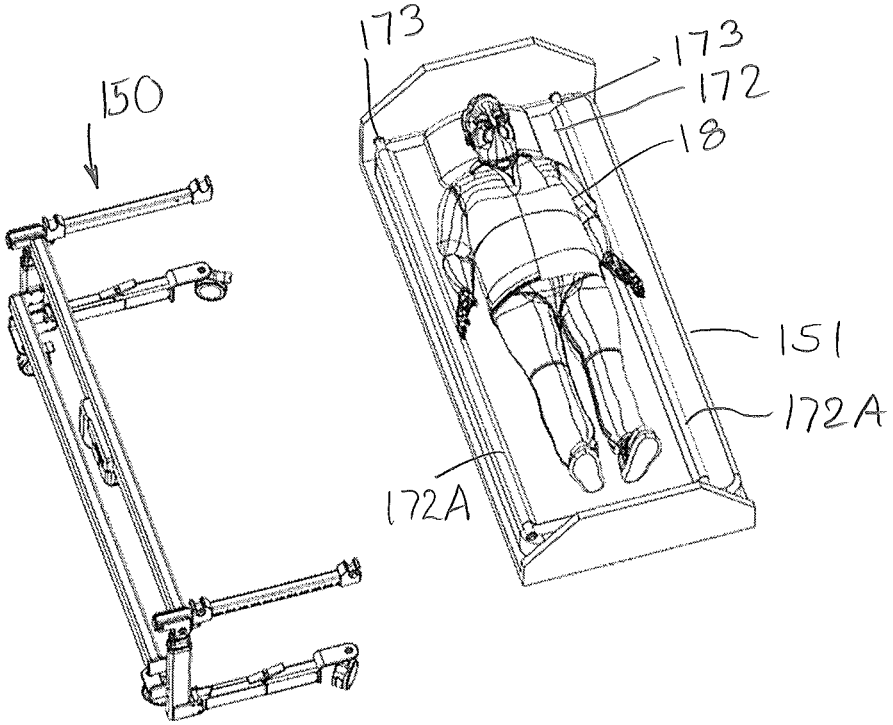
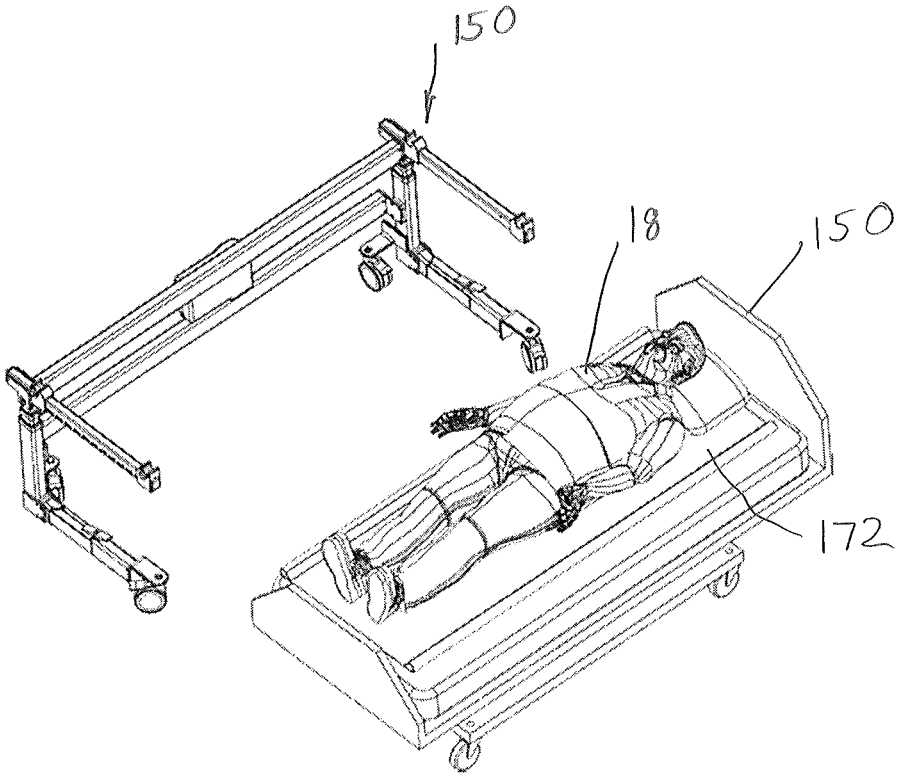
FIG. 46

FIG. 85
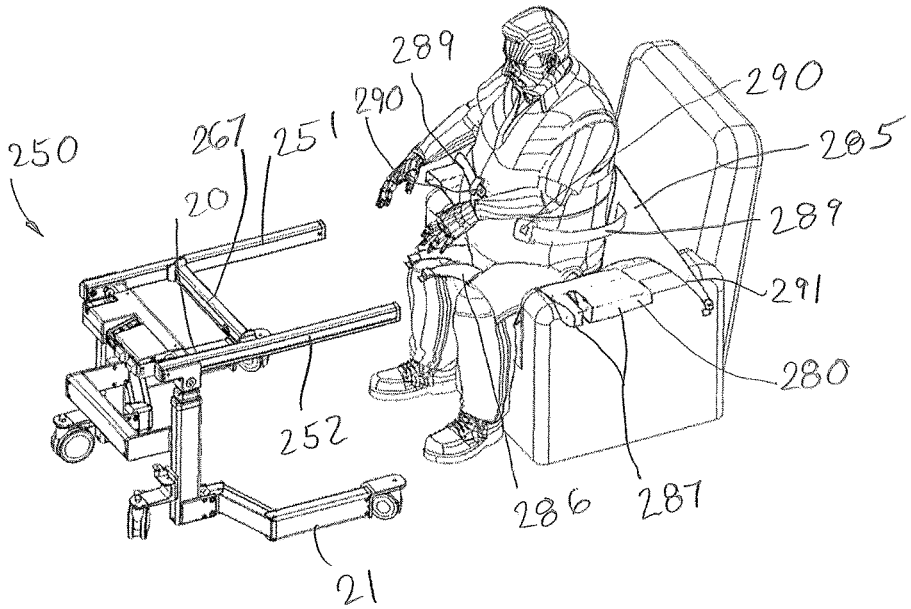
FIG. 86
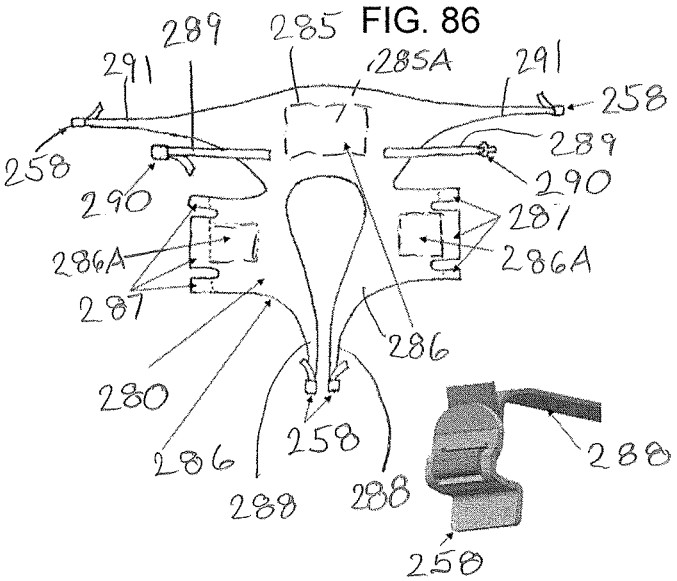
FIG. 87
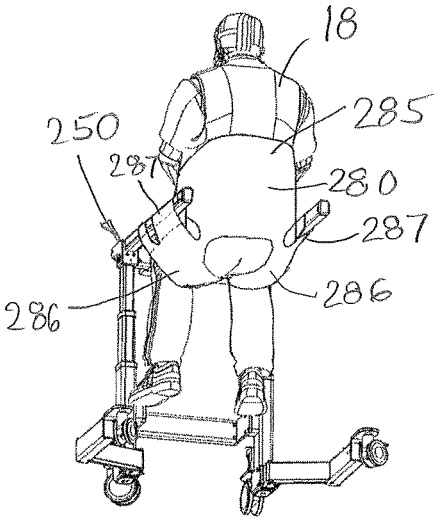
FIG. 88

WHEELCHAIR LIFT-TRANSFER DEVICE

CROSS REFERENCE TO RELATED APPLICATIONS

This application is a continuation-in-part of co-pending PCT Application PCT/US2017/040723, filed Jul. 5, 2017, which PCT application in turn claims priority of U.S. Provisional Patent Application Ser. No. 62/358,249, filed Jul. 5, 2016, and U.S. Provisional Patent Application Ser. No. 62/428,798, filed Dec. 1, 2016, the disclosures of each application being incorporated herein by reference in their entirety.

FIELD OF THE INVENTION

This invention relates to an improved patient transfer-lift that is effective to transfer and lift patients.

BACKGROUND OF THE INVENTION

Generally as to the invention, many patients desire mobility and independence. Conventional patient controlled powered wheelchairs are front entry in that the supporting structure is under and behind the seated user, and even though they provide great mobility, the conventional wheelchair is hampered by front entry when lifting and transfer capabilities are added. Conversely, wheeled patient transfer-lifts are usually rear entry in that the patient faces and is suspended from the lifting structure. Also, transfer-lifts are nearly exclusively operated by a caregiver even though the patient being lifted and transported may have significant capabilities. Rear entry transfer-lifts offer an advantage in transfer operations by the natural orientation of the patient that compliments transfer to other equipment or furnishings. It is easier to place a patient into a front entry conventional wheelchair or place a patient on a bed or toilet from a rear entry transfer-lift device. Wheeled transfer-lifts have rear wheel support arms that can be widened to improve stability when the lift is elevated.

There are numerous patient lift devices that have adequate lifting capability for certain situations; however those with lifting range sufficient to lift a patient from lying on the floor to standing height are not both compact and mobile. There are ceiling mounted lifts with great lifting range but these are confined to a ceiling track or large frame structure. There are boom arm lifts with fairly high lifting range but to increase lifting range these lifts have long boom arms and long support structures to achieve the greater lift range. There are jackscrew driven and hydraulic driven vertically guided lifts that have high lift ranges but these lifts have very tall guide support structures that increase their height and reduce their mobility.

Wheeled lifts are often used to aide in transferring to a conventional wheelchair and therefore have support structures that straddle the wheelchair during this transfer operation. Moving to and from the wheelchair, such wheeled lifts must often pass through common width doorways so the width of the support structure must have a means to be reduced. Therefore, most wheeled lifts have provisions to move some portion of the support structure from wide to narrow width as needed. Many wheeled lifts have outwardly pivoting wheel support arms that can be swung outward to widen the structure for transfers to and from a wheelchair. The required wide angle of the wheel support arms results in a width between the ends of the pair of extended arms that is much wider than the wheelchair. A few lift types have sidewardly sliding sections that provides a wider opening for straddling a wheelchair.

Commonly, wheeled lifts have a single central column at one end from which the boom arm extends or the lifting section telescopes. This structure simplifies the lift mechanism but the structure resulting from this central location interferes with the patient's knees and also makes it difficult to locate the lifting point of the lift close enough to a patient that is lying on the floor.

U.S. Pat. No. 6,430,761 describes a Compact Portable Patient Lift that is intended to be portable but it has inadequate lifting range to lift a patient from lying on the floor to standing, it has an interfering central lifting support column and does not provide the capability for self-lifting or patient driving. U.S. Pat. No. 4,719,655 describes a patient lift with two telescoping vertical guide columns but also has an interfering central lift mechanism and no means to adjust the width of the wheel support arms. U.S. Pat. No. 6,161,232 describes an Invalid Lifting Device having two vertical lifting columns, each having front and rear wheels wherein the columns can be adjusted to the desired width from the other. However, this device has very tall columns to achieve the high lift range and has no provision for patient operation of the lift. U.S. Pat. No. 5,466,111 describes a method wherein the seat lift of a wheelchair is used to raise a wheelchair and patient occupant into a vehicle by attaching the upper portion of the wheelchair to the vehicle door and then swinging the door shut to move the wheelchair and occupant into the vehicle. However, this method requires a vertically hinged door to carry the raised wheelchair and most vehicle floors are too high for the illustrated seat lift to achieve an adequate height to clear the vehicle floor to allow entry and this method will not work when the vehicle door has a horizontal hinge axis like a van rear door.

U.S. Pat. No. 6,092,247 for a Powered Patient Lift Vehicle, describes an earlier attempt by the present inventor to provide a patient operated lift that could also be driven as a wheelchair. However, this device achieves some of the capabilities of the present invention, but it has the long boom arm affect, the outwardly swinging wheel arm supports, and is too large for easy portability in a vehicle. It also does not assist in raising the device itself to higher levels. U.S. Pat. No. 5,255,934 is another earlier attempt by the present inventor to provide a power driven wheelchair with a lifting capability. However, this is a front entry wheelchair with the lift motor, battery and cross shaft below the patient which eliminates the ability to move over a patient lying on the floor. There is no provision to move the rear wheel support arms outward to improve stability when elevated. Also, this device has only a single jack screw in each lift column and the lift column height increases directly proportional to the lift stroke which makes the higher lift version too tall when retracted. There is no provision or lift range for using the lift mechanism for self lifting the entire unit from one level to a higher level.

There has been a need for a patient-operated rear entry lifting, transfer and transporting device that can also serve as a wheelchair that is compact enough to fit inside a vehicle and easily transported for use at another location.

The ideal wheelchair lift-transfer device of the invention provides capabilities for a patient to independently control the wheelchair and lift functions to elevate and move about safely so that he or she can communicate eye to eye with others and retrieve items that are normally too high to reach. Such independence would be demonstrated by the patient when they grasp a handheld wireless remote control and summon their wheelchair lift-transfer device from across the room, to their bedside, then independently transfer into the device and then drive it about in their home, raising and lowering their body as needed. Later they can drive to their bed, lower their self onto the bed, release from the lift and then with the handheld wireless remote control, drive the wheelchair lift-transfer device clear of their sleeping area. For certain performance requirements, the patient may need to transfer to their conventional power drive wheelchair. The independent patient can drive the wheelchair lift-transfer device over to their conventional wheelchair, adjust the rear wheel support arm width as needed, reverse the direction of the wheelchair lift-transfer device and lower themselves onto their conventional wheelchair and then complete the transfer by driving the wheelchair lift-transfer device away from the user, now in the conventional wheelchair, into a parking position by use of the handheld wireless remote control.

When a caregiver is present and can assist in the operation, this ideal wheelchair lift-transfer device of the invention will provide even more capabilities such as by raising the patient off of the floor and placing them in a seated position on a chair or bed or, standing them up on the floor. In this case, the wheelchair lift-transfer device of the invention will also be configured to utilize the integral lifting capability to not only lift the patient but also to lift a conventional wheelchair or other equipment into a vehicle and subsequently lift the wheelchair lift-transfer device its self into a vehicle or lift it from a lower level floor, upward, for use on a higher level floor or platform.

One preferred type of lift-transfer device is disclosed in U.S. Pat. No. 8,910,326 B2, the disclosure of which is incorporated herein by reference in its entirety. With the significant advancements achieved by the lift-transfer device of the '326 patent, there is a need for continuing improvements to such a wheeled patient lift-transfer device that will lift a patient from a conventional wheelchair, transport him or her through narrow passage ways, and lower him or her on to a stationary seat or bed. The lift-transfer device can be propelled by the attendants or could be provided with electric motor drives for both transport and lifting energy, and the present inventive disclosures herein are intended to improve the structure and function of a lift-transfer device.

Therefore, the objects of the present invention are to provide:

1. A compact patient lift-transfer device with increased lifting range, including lifting a patient from lying on the floor to standing position yet have a retracted column height that will pass under a normal height table top.

2. A compact wheelchair lift-transfer device that improves transfer to and from conventional wheelchairs by providing a pair of independently adjustable rear wheel support arms that remain substantially parallel when they are adjusted, including a range of adjustment that allows a narrow position for passage of the pair of support arms under and between the wheels of a conventional wheelchair and a wide position that allows space for a chair to sit between the wheel support arms and/or provide improved stability for driving the wheelchair lift-transfer device with the lift elevated.

3. A compact rear entry wheelchair lift-transfer device that improves transfer to and from a bed including a semi-rigid seat plate that can be easily placed under a patient who is on a bed and be quickly attached to the lift.

4. A compact patient controlled power drive or unpowered lift-transfer device that can serve as a rear entry lift transfer that can carry the patient around the house, place them on a toilet, sit them close up to a table or lift them up to reach high objects such as in a kitchen cupboard.

5. A compact patient wheelchair lift-transfer device that provides patient independence by providing a battery powered wheelchair lift-transfer device that can be used to with the patient who is in a bed or in a conventional wheelchair and then allow the patient to control the lift to cause it to lift the patient from the bed or wheelchair to permit the patient to be transferred to another location.

6. A compact lift-transfer device that is full-size so as to seat occupants and patients, but is readily collapsible to a folded condition to facilitate storage or ease of transport.

7. A lift-transfer device with lift columns having improved roller assemblies that equalize forces acting on a set of rollers for improved displacement of telescoping column sections.

8. Occupant support arms on a lift-transfer device which can readily support a variety of seat and sling options for supporting the patient.

9. A lift-transfer device having wheel support arms that can articulate between narrow and wide conditions, wherein the wheel support arms have improved lock mechanisms that may permit manual or powered articulation of the wheel support arms. The wheel support arms may also include wheel locks for locking out swiveling of the wheels.

10. A lift-transfer device that can be configured to carry a patient in seated, standing and lying orientations, wherein the lift-transfer device can be reconfigured to serve as a gurney.

Other objects and purposes of the invention, and variations thereof, will be apparent upon reading the following specification and inspecting the accompanying drawings.

BRIEF DESCRIPTION OF THE DRAWINGS

FIG. 5 is a perspective view of the lift-transfer device configured as a rear entry wheelchair frame structure with rear wheel support arm assemblies moved to an expanded position.

FIG. 6 is a plan view of the lift-transfer device of FIG. 5.

FIG. 7 is a front elevational view thereof.

FIG. 8 is a side view thereof.

FIG. 30 is a rear perspective view of the power drive system as viewed from below.

FIG. 31 is a rear perspective view of the power drive system as viewed from above.

FIG. 40A is a front perspective view of the gurney transport lift.

FIG. 40B is a rear perspective view of the gurney transport lift.

FIG. 45 is a front perspective view of the lift transfer gurney positioned adjacent to a bed with the stretcher body and with stretcher poles disposed on the bed with the body of a patient supported thereon.

FIG. 46 is a rear perspective view of the lift transfer gurney positioned adjacent to a bed with the stretcher body and without stretcher poles disposed on the bed with the body of a patient supported thereon.

FIG. 85 is a perspective view of the lift-transfer device with the seat sling being attached to a patient on a chair.

FIG. 86 is a plan view of the seat sling.

FIG. 87 is a rear perspective view of an attachment clip used with the seat sling.

FIG. 88 is a rear perspective view of the patient supported by the seat sling on the lift-transfer device.

FIG. 116 is a perspective view of a lift-transfer device with a tray mounted thereon.

FIG. 117 is a perspective view of the tray.

FIG. 118 is a perspective view of a lift-transfer device with a knee guard mounted thereon.

FIG. 119 is a perspective view of the knee guard.

FIG. 120 is a partial cut-away perspective view of a modified lift column.

FIG. 121 is a partial perspective view of the lift column.

FIG. 122 is a top view of the lift column.

FIG. 123 is a partial perspective view of a top end of a column section.

FIG. 124 is a partial perspective view of a bottom end of a column section.

Certain terminology will be used in the following description for the convenience in reference only, and will not be limited. For example, the word "front" will refer to the side of the wheelchair lift-transfer device that faces the pair of double telescoping lifting columns that is opposite the rear side from which the cantilevered horizontal seat support arms extend.

With respect to the wheelchair lift-transfer device, the abbreviation "RH" which means "right hand" and "LH" which means "left hand" as related to the patients right hand or left hand as he or she is supported in the wheelchair lift-transfer device while seated and facing in the same direction as the wheelchair lift-transfer device "front" faces. The words "inwardly" and "outwardly" will refer to directions toward and away from, respectively the geometric center of the wheelchair lift-transfer device and designated parts thereof. Said terminology will include the words specifically mentioned, derivatives thereof, and words of similar import.

DETAILED DESCRIPTION

Figure 1:
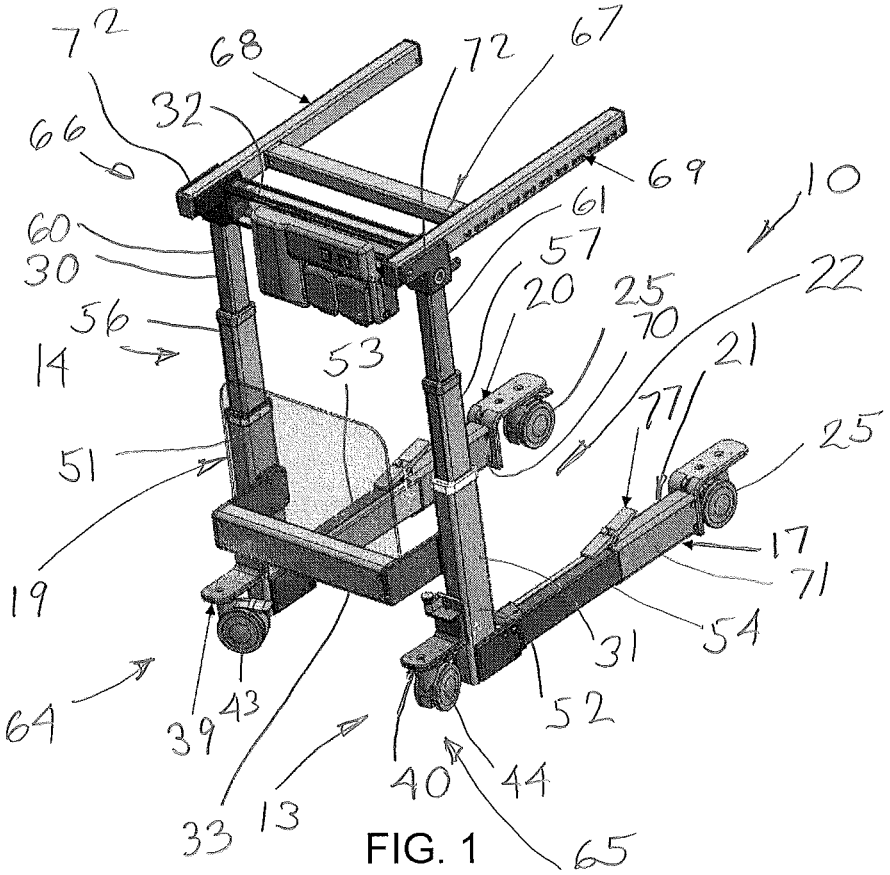
FIG. 1 is a perspective view of one embodiment of an improved patient wheelchair lift-transfer device configured as a rear entry power lift.
Figure 2:
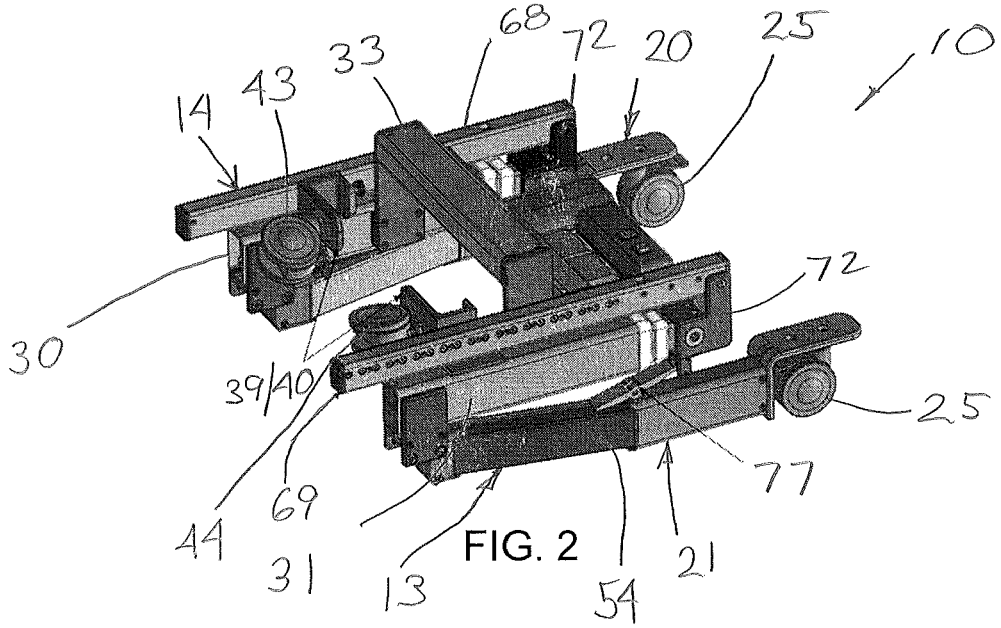
FIG. 2 is a perspective view of the improved lift-transfer device in a folded condition for transport or storage.

Referring to FIG. 1, there is illustrated one embodiment of the wheelchair lift-transfer device 10 (herein-after referred to as the "transporter" for convenience) configured as a rear entry power lift wheelchair. As seen in FIG. 2, the transporter 10 is readily foldable for storage or transport as will described herein.

Figure 3:
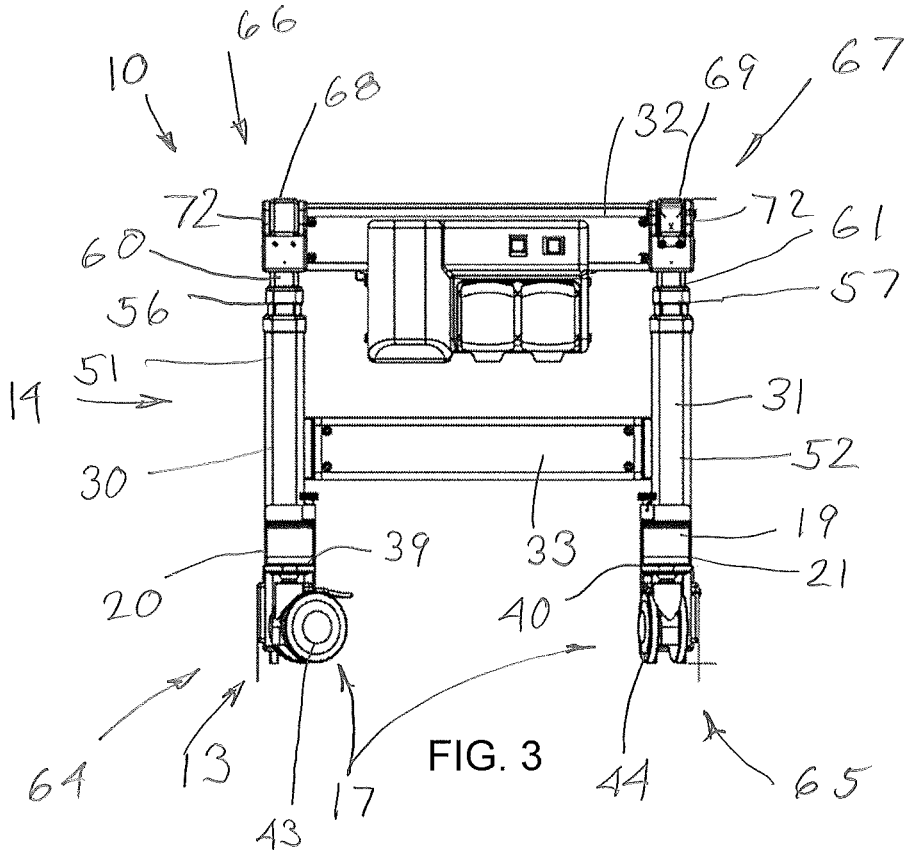
FIG. 3 is a front elevational view of the lift-transfer device in an unfolded, open condition.
Figure 4:
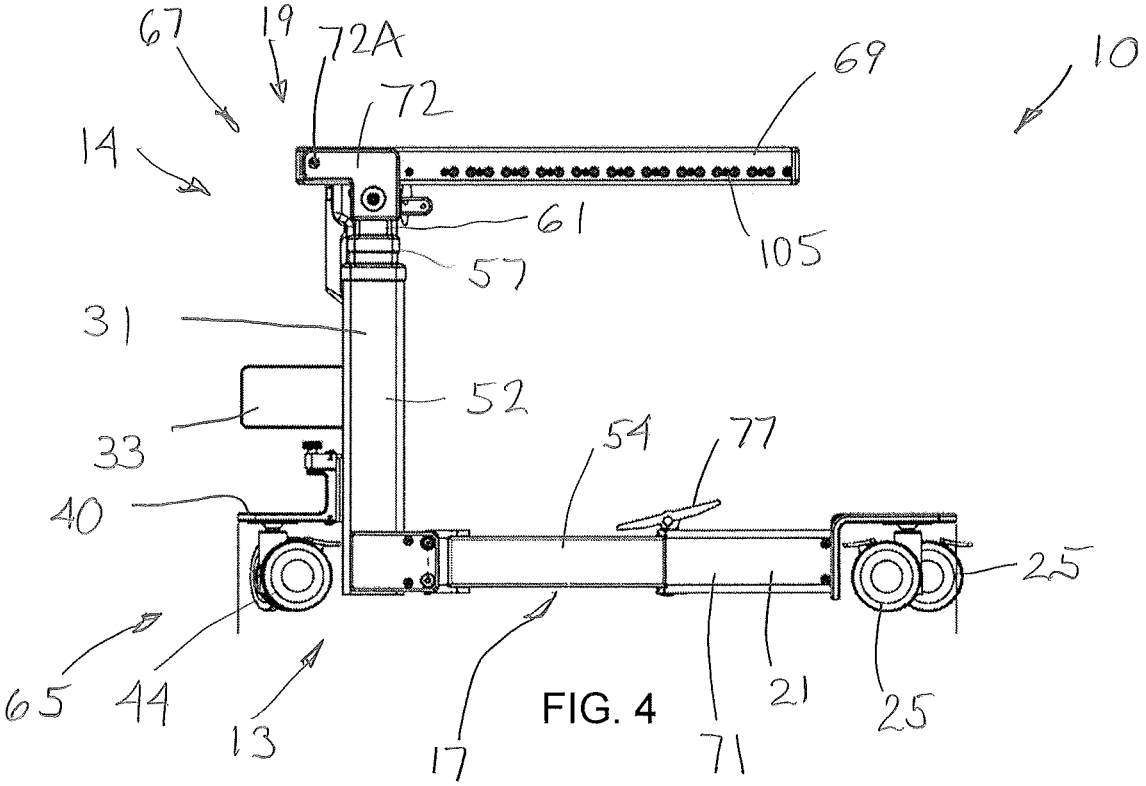
FIG. 4 is a side view thereof.
Figure 23:
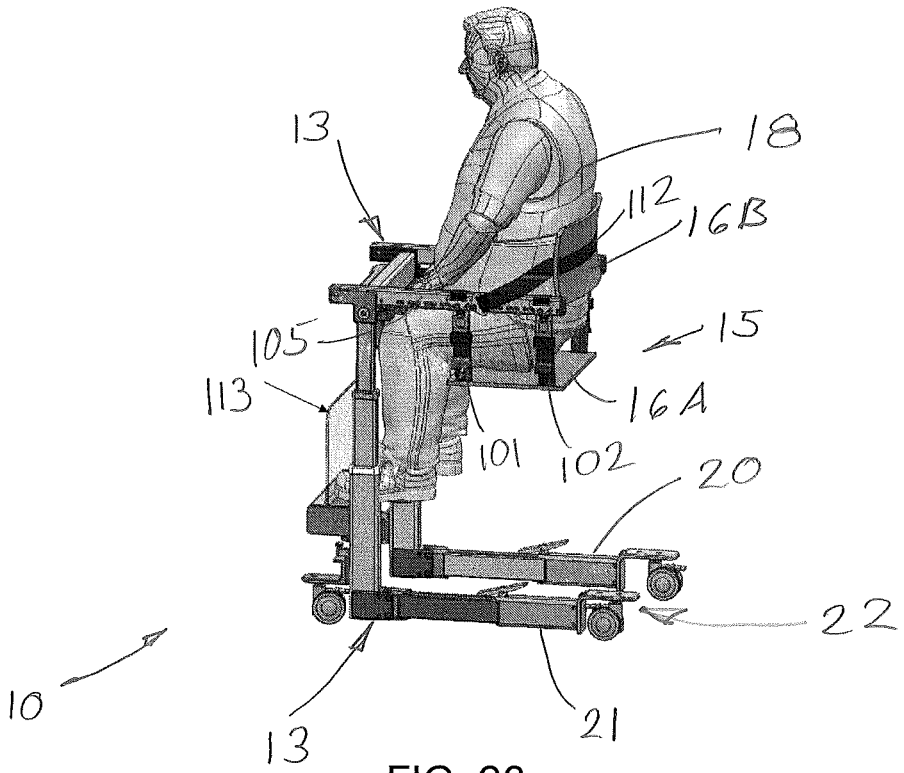
FIG. 23 is a perspective view of an optional seat assembly and attachment system.
Figure 24:
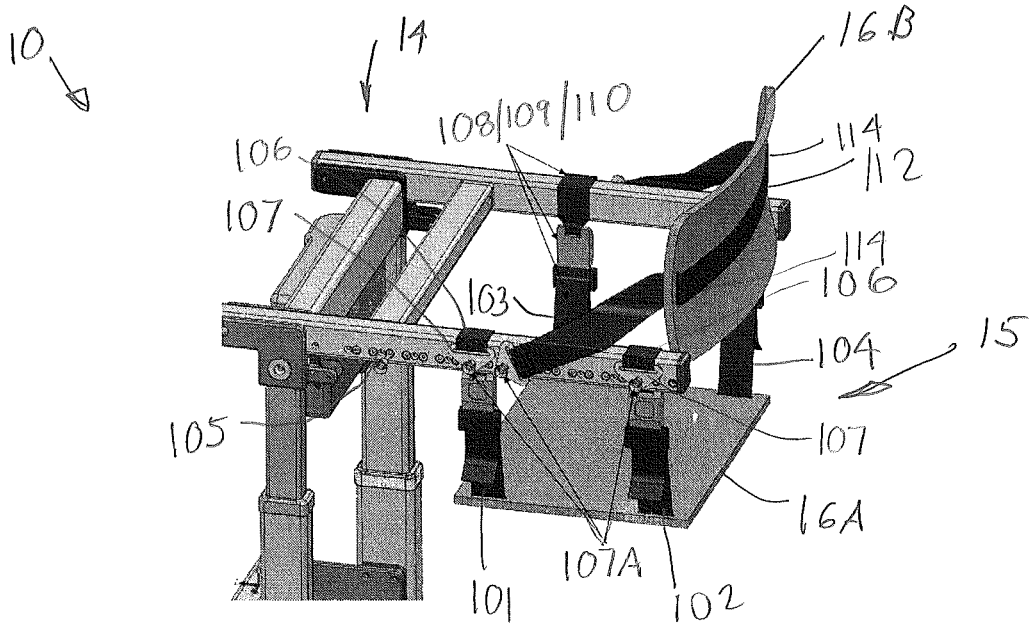
FIG. 24 is a fragmentary perspective view of the seat assembly of FIG. 23.

Referring to FIGS. 1 and 3-4, the transporter 10 includes a wheeled base assembly 13 having an upright assembly 14 projecting therefrom. The upright assembly 14 in turn mounts thereon a removable seat assembly 15 preferably comprising a seat support 16A and back support 16B (FIGS. 23 and 24), the latter being used for receiving an occupant/patient 18 for transporting by the transporter 10 and transfer to and from the transporter 10. The wheeled base assembly 13 includes a generally rigid and rearwardly-opening U-shaped horizontally extending wheeled base 17 that is defined by the upright assembly 14 at the front 19 and a pair of generally parallel and rearwardly extending rear wheel support arms 20 and 21. These rear wheel support arms 20 and 21 are sidewardly spaced apart and define a rearwardly opening space 22 that is optionally adjustable in width therebetween to permit the base 13 to provide an opening that is wide enough to straddle a chair or a patient who might be lying on the floor, and optionally defines an overall width that is narrow enough to pass through a doorway, passageway or fit between opposite side-wheels of some conventional wheelchairs. Each rear wheel support arm 20 and 21 has a wheel 25 or roller mounted adjacent the rear free end 26 thereof. In the embodiment of FIG. 1, these rear wheels 25 are preferably pivotable caster wheels that are releasably lockable as described herein.

The upright assembly 14 includes a pair of lift columns 30 and 31 connected to and spaced apart by cross beam structures 32 and 33 which extend horizontally transversely across the transporter 10 adjacent the front side 19 thereof. The lower cross beam structure 33 is elevated enough to allow space underneath for passage of the legs of a patient 18 that is lying on the floor. The upright assembly 14 also has a pair of front side support arms 39 and 40 or brackets which project forwardly a small extent in cantilevered relation to the pair of lift columns 30 and 31. These arms 39 and 40, adjacent the free ends thereof 41 mount thereon front support rollers 43 and 44. In the embodiment of FIG. 1 the front support rollers are pivotable caster wheels.

The upright assembly 14 includes the pair of vertically elongate and telescopic lift columns or support post assemblies 30 and 31, each including a vertically elongate lower post 51 and 52 to which a respective one of the rear wheel support arms 20 and 21 is attached via a respective four-bar horizontally pivoting linkage 53 and 54 (FIGS. 1 and 4), the combination forming the U-shaped wheeled base 13 from which the upright assemblies 30 and 31 project upwardly in cantilevered relationship therewith. In this regard, the lower posts 51 and 52 are joined together in sidewardly or laterally spaced relation by the lower cross beam structure 33. Vertically elongate middle posts 56 and 57 are slidably telescopingly positioned within and project upwardly out of the lower posts 51 and 52. Vertically elongate upper posts 60 and 61 are slidably telescopingly positioned within and project upwardly out of the middle posts 56 and 57. A double-jackscrew drive 63 or lifting unit is disposed interiorly of each post assembly 30 and 31 (described later in reference to FIG. 18) to selectively extend and retract the lower posts 51/52, middle posts 56/57 and upper posts 60/61.

The support post assemblies 30 and 31 are disposed adjacent opposite sides of the transporter 10 adjacent the front corners 64 and 65 thereof (FIG. 1), and at the upper ends 66 and 67 thereof are respectively joined to horizontally elongate occupant support arms 68 and 69. The pair of occupant support arms 68 and 69 then project rearwardly in cantilevered relationship away from the support post assemblies 30 and 31 in generally parallel relationship adjacent opposite sides of the transporter. The seat support arms 68 and 69 more particularly are supported on the upper posts 60/61 so as to move vertically therewith, and joined together in sidewardly spaced relation by the upper cross beam structure 32 and a secondary beam structure.

With respect to FIGS. 1 and 3-4, it can be seen that the lift-transfer device can be configured in a narrow width condition with the wheel support arms 20 and 21 disposed in a narrow position wherein the space 22 has the narrowest width. This narrow width can be suitable for a number of reasons, such as fitting between the wheels of wheelchair with the support arms 68 and 69 being disposed on opposite sides of an occupant or patient 18. In this condition, the lift columns 30 and 31 can be retracted so that the support arms 68 and 69 are at the lowest elevation relative to the floor.

As can be seen in FIGS. 5-7, the wheel support arms 20 and 21 can be positioned outwardly or spread apart due to articulation of the linkages 53 and 54 wherein the outer arm sections 70 and 71 are moved apart from each to define a wider width for the space 22. Preferably, the outer arm sections 70 and 71 are parallel to each other as seen in FIG. 6, although other orientations are possible.

Also, the telescoping lift columns 30 and 31 may be extended to raise or lift the support arms 68 and 69 to the vertically elevated position seen in FIGS. 5-8. To change the elevation of the support arms 68 and 69, the elevation of the support arms 68 and 69 are selectively extended and retracted by vertically displacing moving the lower posts 51/52, middle posts 56/57 and upper posts 60/61 upwardly and downwardly. If desired, the support arms 68 and 69 might be elevated as seen in FIGS. 5-7 while the wheel support arms 20 and 21 remain in the narrow configuration of FIGS. 1 and 3.

Referring to FIGS. 2 and 9-11, the lift-transfer device 10 preferably is configured so that is foldable as seen in FIGS. 2 and 9-11. Generally as to FIG. 2, the wheel support arms 20 and 21 may be folded up against the lift columns 30 and 31, while the occupant support arms 68 and 69 may be folded up so as to lie flat against the lift columns 30 and 31. As described further herein, the rear wheels 25 can remain oriented so as to remain in contact with a support surface to help in moving the folded lift-transfer device 10 to a storage location.

Figure 10:
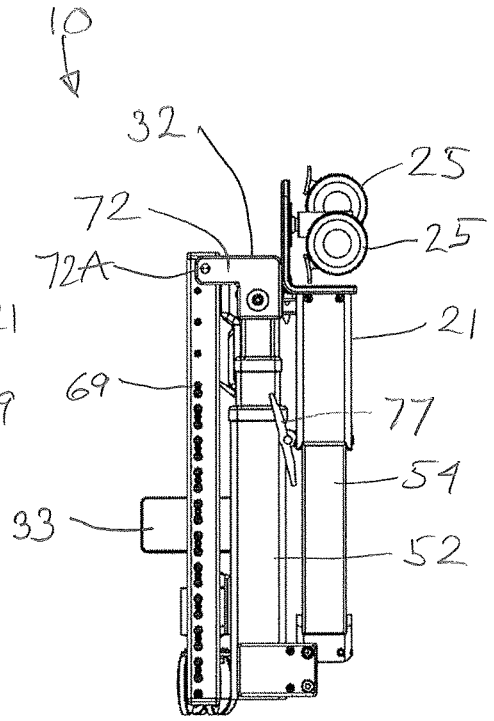
FIG. 10 is a side view thereof.

Referring to FIGS. 4 and 10, the upper posts 60/61 each include a respective L-shaped connector bracket 72 which has a first leg fixed to the upper post 60/61 and a second leg projecting forwardly from the upper post 60/61. The second leg of the bracket 72 includes a pivot connector 72A, which pivotally connects to the respective occupant support arm 68/69. When the support arm 68/69 is in the horizontal position shown in FIG. 4, the support arm 68/69 is supported on the upper end of the upper post 60/61 so as to be cantilevered horizontally in the horizontal position shown in FIG. 4. However, the support arm 68/69 also may be pivoted vertically about the pivot connector 72A so as to swing upwardly and forwardly until the support arm 68/69 lies parallel to and flat against the respective lift column 30/31 as seen in FIGS. 2 and 10.

Figure 12:
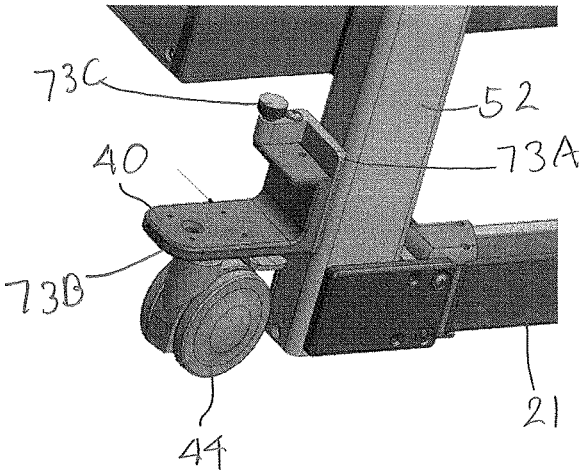
FIG. 12 is a fragmentary perspective view of a front wheel support in a normal use position.
Figure 13:
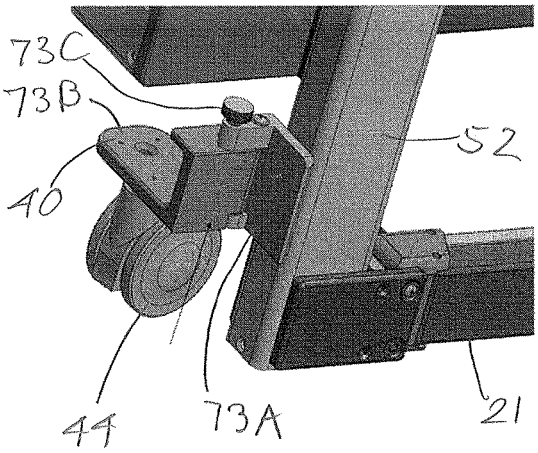
FIG. 13 is a fragmentary perspective view of the front wheel support pivoted inward to facilitate folding.

With the support arm 68/69 in the folded position of FIGS. 2 and 10, the lift-transfer device 10 preferably is configured to allow the front wheels 43/44 and their support bracket 39/40 to pivot out of the way of the support arm 68/69. FIGS. 12 and 13 illustrate the one support bracket 40 but it will be understood that the support bracket 39 has the same construction, such that a specific description of such support bracket 39 is not required. Each support bracket 40 or 39 preferably is pivotally connected to the respective lift column 31 or 30. Preferably each support bracket 40 or 39 is formed as a bracket assembly comprising a connector plate 73A, and a wheel bracket 73B which are pivotally connected by a pivot pin that allows the wheel bracket 73B to pivot inwardly and a lock pin 73C that is releasable to restrain the wheel bracket 73B in the use position of FIG. 12, but release the wheel bracket 73B to allow the wheel bracket 73B and respective wheel 43 or 44 to be swung inwardly to the storage position of FIG. 13 so as to avoid interfering with the support arm 68/69 when it is swung to the folded position described above as seen in FIGS. 9 and 11. Essentially, the wheel brackets 73B and wheels 43 or 44 are displaced sidewardly in non-interfering relation with the support arms 68/69.

Figure 14:
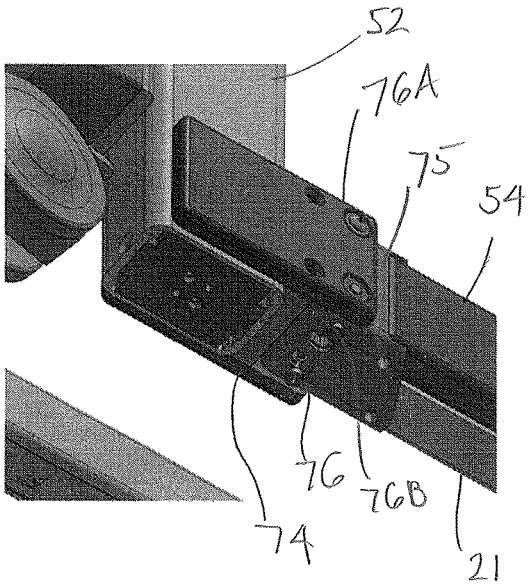
FIG. 14 is a fragmentary perspective view of a rear wheel support arm assembly locked in a normal use position.
Figure 15:
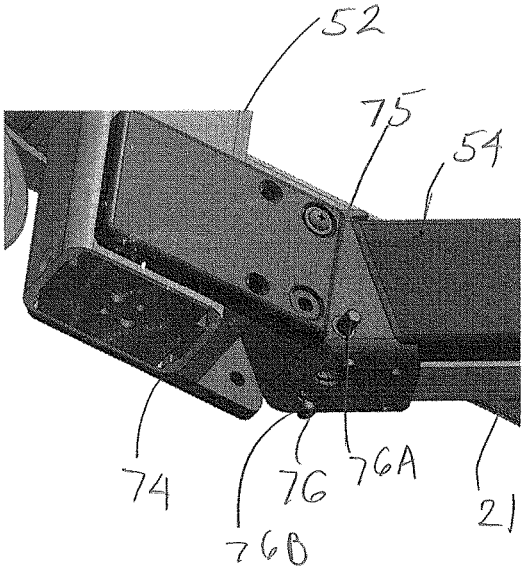
FIG. 15 is a fragmentary perspective view of the rear wheel support arm assembly unlocked and partially pivoted to a folded storage position.

Referring to FIGS. 14 and 15, the wheel support arms 20 and 21 are also joined to the lift columns 30 and 31 by pivot connections to allow pivoting of the support arms 20 and 21 upwardly so to lie flat or parallel with the lift columns 30 and 31 as seen in FIGS. 2 and 10. The pivot connections generally comprise a column connector 74 rigidly affixed to the respective support column 30 and 31 and an arm connector 75 rigidly affixed to the respective wheel support arm 20/21. The column connector 74 and arm connector 75 are pivotally connected together by a pivot pin 74A, which permits the support arms 20 and 21 to pivot upwardly with the arm connectors 75 so as to fold flat or generally parallel to the lift columns 30/31 as seen in FIGS. 2 and 10.

The pivot connection also comprises a lock device 76 to selectively lock the wheel support arms 20/21 in the horizontal position of FIGS. 1 and 3-8. The lock device 76 may be unlocked or released to permit the wheel support arms 20 and 21 to pivot upwardly to fold against the support columns 30/31. Generally, as to FIGS. 14 and 15, the lock device 76 comprises spring biased locking pins 76A that engages corresponding bores or other formations in the column connector 74 when extended. The pins 76A may be retracted by manual actuators 76B to retract the pins 76A from the formations in the column connector 74 to permit swinging or pivoting of the support arms 20 and 21 to the folded position.

Figure 9:
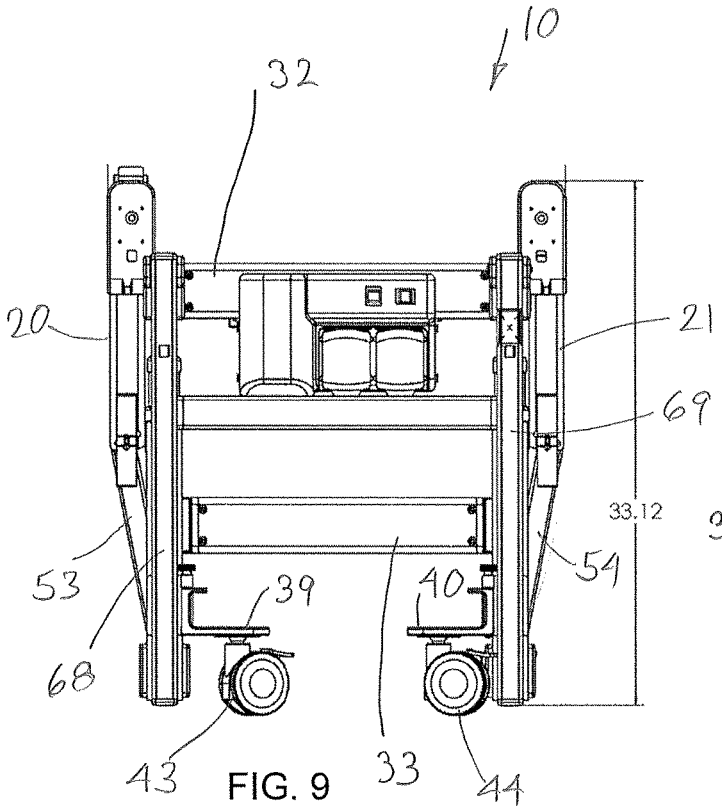
FIG. 9 is a top view of the lift-transfer device in the folded condition of FIG. 2.
Figure 11:
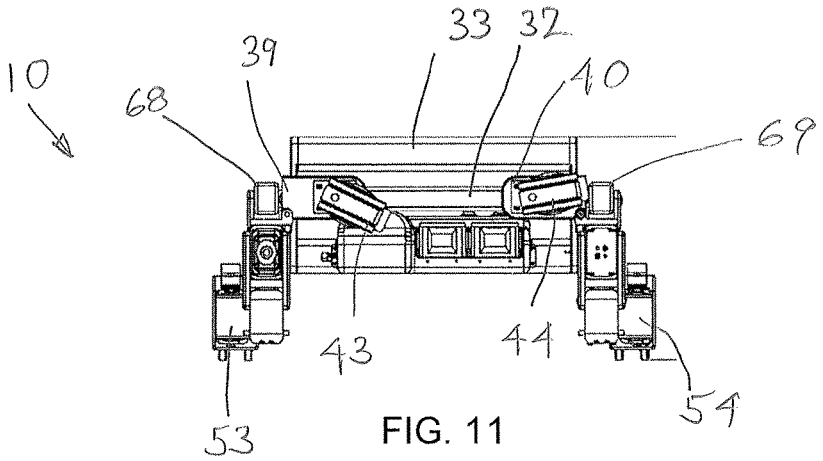
FIG. 11 is a front elevational view thereof.

As can be seen in FIGS. 9-11, the wheel support arms 20 and 21 also may be articulated outwardly due to the provision of the four-bar linkages 53 and 54. This allows all upwardly projecting structure of the wheel support arms 20 and 21 including a position lock mechanism 77 and the wheel mounts 140 to be relocated sidewardly of the lift columns 30 and 31 when in the folded condition to minimize the vertical height of the folded transporter 10 as seen in FIG. 11. Essentially, the wheel support arms 20 and 21 are displaced sidewardly in non-interfering relation with the lift columns 30 and 31.

In view of the foregoing, the inventive lift-transfer device 10 can be readily folded for storage or transport. As seen in FIGS. 2 and 9-11, the lift-transfer device 10 is collapsed or folded so that it uses a minimal amount of storage space.

Figure 16:
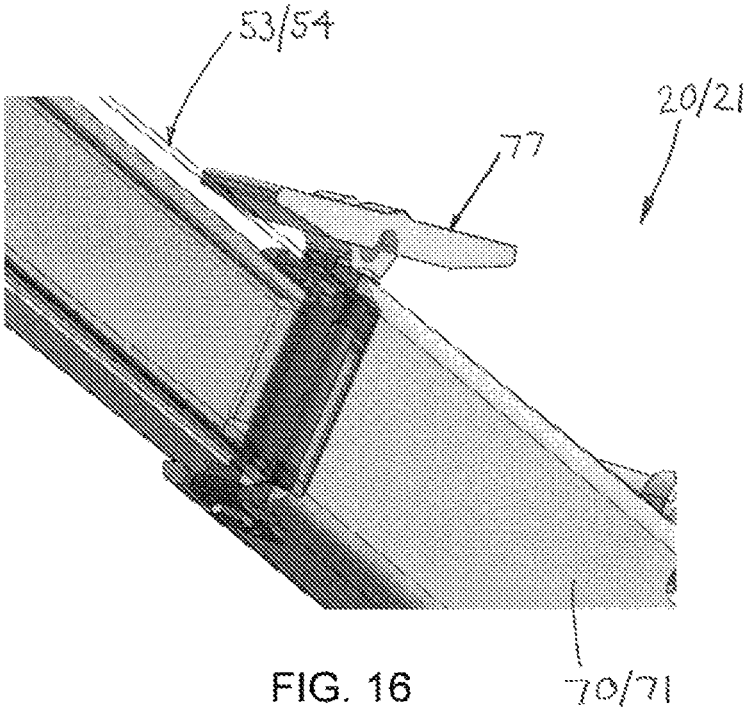
FIG. 16 is a fragmentary perspective view of the lock assembly for the rear wheel support arm assembly.
Figure 17:
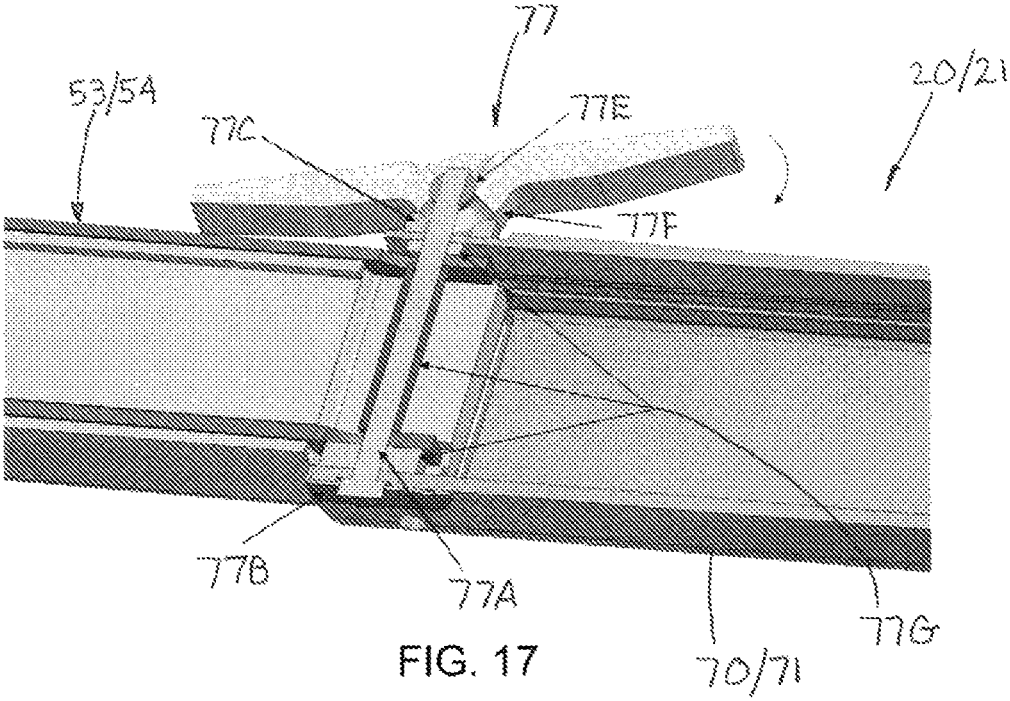
FIG. 17 is a fragmentary perspective view of the lock assembly of FIG. 16 shown in cross-section.

Referring to FIGS. 16 and 17, the wheel support arms 20 and 21 may be configured so as to be power driven to the widest position of FIGS. 5-8. However, the wheel support arms 20/21 also may be manually displaced between the narrow and wide positions, with the support arms 20/21 being provided with a manual position locking mechanism or arm position lock 77. More particularly, the four bar linkage 53/54 of each wheel support arm 20/21 is pivotally connected to the outer arm section 70/71. The outer arm sections 70/71 may be locked relative to their linkages 53/54 by actuation of the arm position lock 77.

In the illustrated embodiment, the arm position lock 77 comprises a tension bolt 77A having a lower end abutting against a bolt-head lock plate 77B. The tension bolt 77A extends through the outer arm sections 70 or 71 and a sliding cam plate 77C, and pivotally connects to an actuator lever 77D by a nut-lever axle 77E. The lever 77D includes a camming surface 77F which acts against the cam plate 77C to compress and selectively lock the arm sections 70/71 relative to the linkages 53/54 which fixes the orientation of these components relative to each other. To facilitate arm rotation when the lock 77 is unlocked, spacers 77G may also be provided. This mechanism provides an improved method for manually locking the linkages 53/54 and outer arm sections 70/71 relative to each other.

Figure 18:
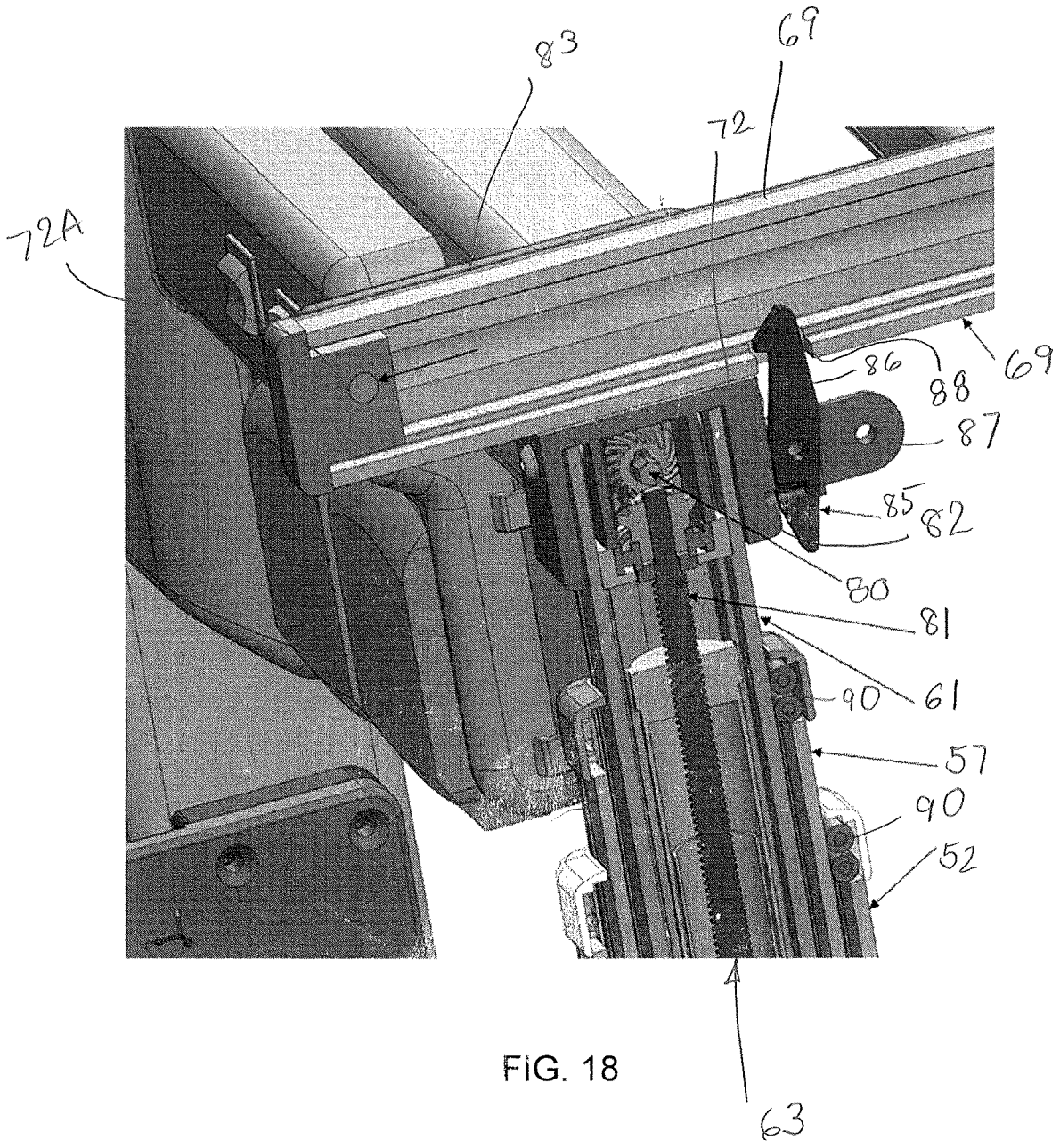
FIG. 18 is a cut-away perspective view of a lift column and powered lift mechanism.

Referring to FIG. 18, the double-jackscrew drive 63 or lifting unit is disposed interiorly of each post assembly 30 and 31 to selectively extend and retract the lower posts 51/52, middle posts 56/57 and upper posts 60/61. The double-jackscrew drive 63 connects to a horizontal hexagon shaped cross shaft 80 that is part of a motor drive assembly disclosed herein after. The double-jackscrew drive 63 includes a hexagonal vertical shaft 81 which connects to the cross shaft 80 by a matching pair of bevel gears at each end of the horizontal cross shaft 80.

The double telescoping lift columns 30 and 31 include lower posts 51 and 52, which slidably support the middle posts 56 and 57 wherein the upper posts 60 and 61 slide within the middle posts 56 and 57. As noted above, the upper ends of the upper posts 60 and 61 each include a respective L-shaped connector bracket 72 which has a first leg or bracket body 82 fixed to the upper post 60/61 and a second leg 83 projecting forwardly from the upper post 60/61. The second leg 83 of the connector bracket 72 includes the pivot connector 72A, which pivotally connects to the respective occupant support arm 68/69. When the support arm 68/69 is in the horizontal position shown in FIGS. 4 and 18, the support arm 68/69 is supported on the upper end of the upper post 60/61 so as to be cantilevered horizontally in the horizontal position shown in FIGS. 4 and 18. As described above, the support arm 68/69 may pivot vertically about the pivot connector 72A so as to swing upwardly and forwardly until the support arm 68/69 lies parallel to and flat against the front side of the respective lift column 30/31 as seen in FIGS. 2 and 10.

To prevent inadvertent pivoting of the support arm 68/69, each of the occupant support arms 68/69 includes a releasable latch 85 that is engages the support arms 68 or 69 with the respective connector bracket 72. In the illustrated embodiment, a latch arm 86 is pivotally connected to a latch flange 87 projecting from the second leg 83 of the connector bracket 72. The latch arm 86 extends vertically and hooks into a respective slot 88 formed in a bottom wall of the support arm 69 or 68. Normally, the latch arm 86 is spring-biased into latching engagement with the slot 88, but the latch arm 86 can manually pivoted against the spring bias to release from the slot 88 and permit the support arm 68/69 to be pivoted to the folded position described above. It will be recognized that other latch constructions may be provided.

Figure 19:
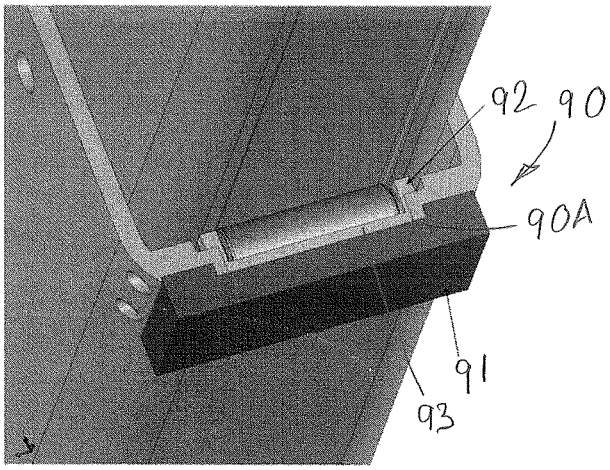
FIG. 19 is a fragmentary cut-away perspective view of an external support roller assembly for the lift columns.
Figure 20:
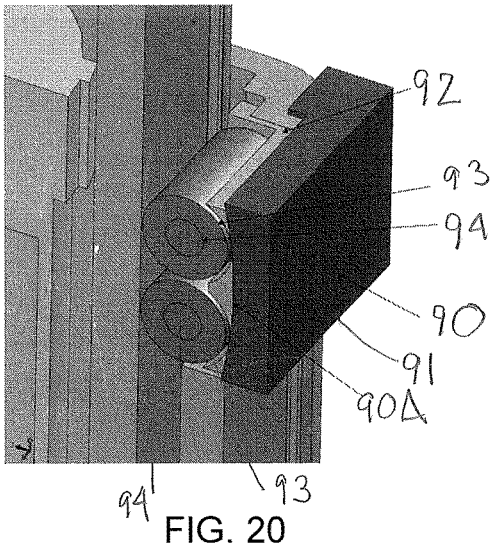
FIG. 20 is a fragmentary cut-away perspective view of an external roller assembly from a first side.

To maintain alignment of the double telescoping lift columns 30 and 31 wherein the lower posts 51 and 52 slidably support the middle posts 56 and 57, and the upper posts 60 and 61 slide within the middle posts 56 and 57, each of the lift columns 30 and 31 has outer support roller assemblies 90 at the upper ends of the lower posts 51 and 52, and additional support roller assemblies 90 at the upper ends of the middle posts 56 and 67 as seen in FIGS. 18-20.

The roller assemblies 90 each comprise a pivot block cradle 91 that is supported on one of the respective lower posts 51/52 or middle posts 56/57, a pivot block 92 which is movably supported within the pivot block cradle 91 to permit limited movement or rocking of the pivot block 92. In particular, the pivot block 92 and pivot block cradle 91 include curved mating surfaces 90A that permit limited movement of the pivot block cradle 91. The pivot block 92 in turn supports at least one but preferably at least two rollers 93 that are each supported by a respective axis pin 94 (FIG. 20). The rollers 93 roll against the opposing side surfaces of the lower posts 51 and 52 and middle posts 56 and 57. Since the pivot block 92 can pivot within the pivot block cradle 91, this limited movement equalizes the support provided by each of the rollers 93 against the opposing side surfaces.

Figure 21:
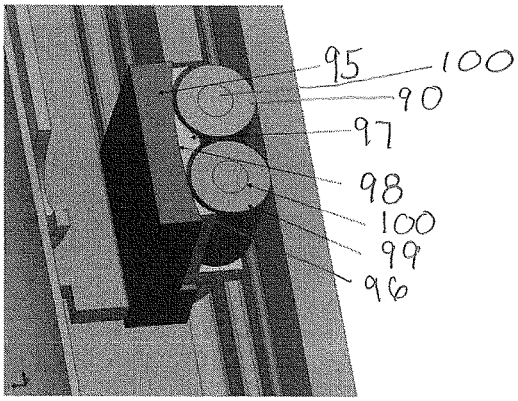
FIG. 21 is a fragmentary cut-away perspective view of an internal roller assembly from a first side.
Figure 22:
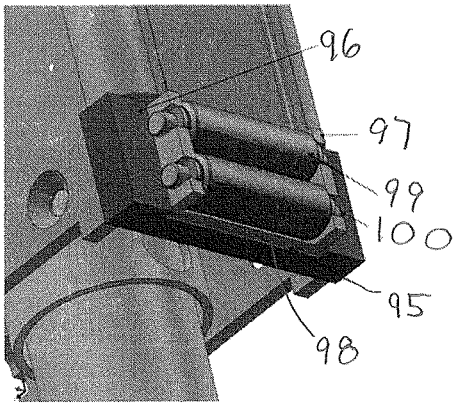
FIG. 22 is a fragmentary cut-away perspective view of the internal support roller assembly for the column.

Each of the lift columns 30 and 31 also has inner support roller assemblies 95 at the lower ends of the upper posts 60 and 61, and additional inner support roller assemblies 95 at the lower ends of the middle posts 56 and 67 as seen in FIGS. 21-22. Like the outer roller assemblies 90, each of the inner support roller assemblies 95 comprises a pivot block cradle 96 that is supported on one of the respective upper posts 60/61 or middle posts 56/57, and a pivot block 97 which is movably supported within the pivot block cradle 96 to permit limited movement or rocking of the pivot block 97. In particular, the pivot block 97 and pivot block cradle 96 include curved mating surfaces 98 that permit limited movement or displacement of the pivot block 97 relative to the pivot block cradle 96. The pivot block 97 in turn supports at least one but preferably at least two rollers 99 that are each supported by a respective axis pin 100 (FIGS. 21-22). The rollers 99 roll against the opposing side surfaces of the upper posts 60 and 61 and middle posts 56 and 57. Since the pivot block 97 can pivot within the pivot block cradle 96, this limited movement equalizes the support provided by each of the rollers 99 against the opposing side surfaces.

Considering now the seat support assembly 15 (FIGS. 23 and 24), the same includes a seat portion 16A and a backrest portion 16B, both of which are preferably connected to the seat support arms 68 and 69 by elongate flexible straps 101-104 that are provided as a set of four straps 101-104 and releasably attach to a row of connector mounts 105 provided on each of the support arms 68 and 69. The connector mounts 105 may comprise fastener bores or holes or other formations that are spaced in a row along the length of the support arms 68/69.

Two of the set of four straps 101-104 supporting the seat 16A are pivotally attached to each respective support arm 68/69 at the strap upper end 106 thereof by a connector bracket 107 that includes a push-button, quick-release pin or fastener 107A that engages with one of the connector mounts 105. The connector bracket 107 is generally triangular shaped with the quick-release pin 107A located at one apex wherein the connector bracket 107 can swivel about the pin 107A when engaged to a respective connector mount 105.

The straps 101-104 have a length-adjuster portion comprising a conventional vehicle-type seat belt buckle or clasp 108 attached between strap upper and lower ends 109/110 thereof. The seat 16A has the four straps 101-104 attached thereto adjacent the four corners thereof. Each support arm 68 and 69 also engage with a backrest support strap 112 attached at the rearward ends thereof. The backrest support strap 112 includes connector brackets 107 at the opposite ends thereof which are releasably engagable with the connector mounts 105 by quick-release pins 107A. The strap 112 may be formed as two parts joined by a buckle, and passes through openings 114 in the backrest 16B, adjustably securing the backrest 16B to the support arms 68 and 69.

Also, a shield 113 may be mounted to the front of the transporter 10.

Figure 25:
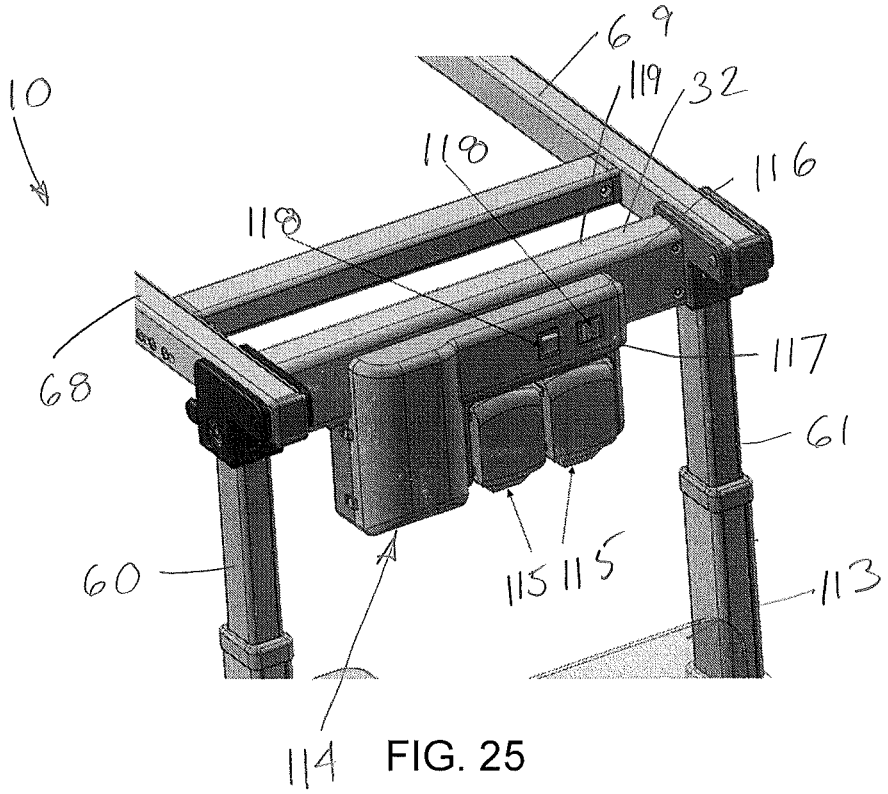
FIG. 25 is a fragmentary perspective view of a power drive system for the lift-transfer device.

To power the transporter 10, the upper crossbeam structure 33 of the embodiment of FIG. 1 includes a compartment in which a drive assembly 114 is provided and in which power supply batteries 115 are stored. A driving control module 116 (FIG. 25) includes an operator control panel 117 that may include switches 118 for the lift up-down control, battery selection, and if provided in some embodiments, for rear wheel support arm in-out control or a powered drive.

Figure 26:
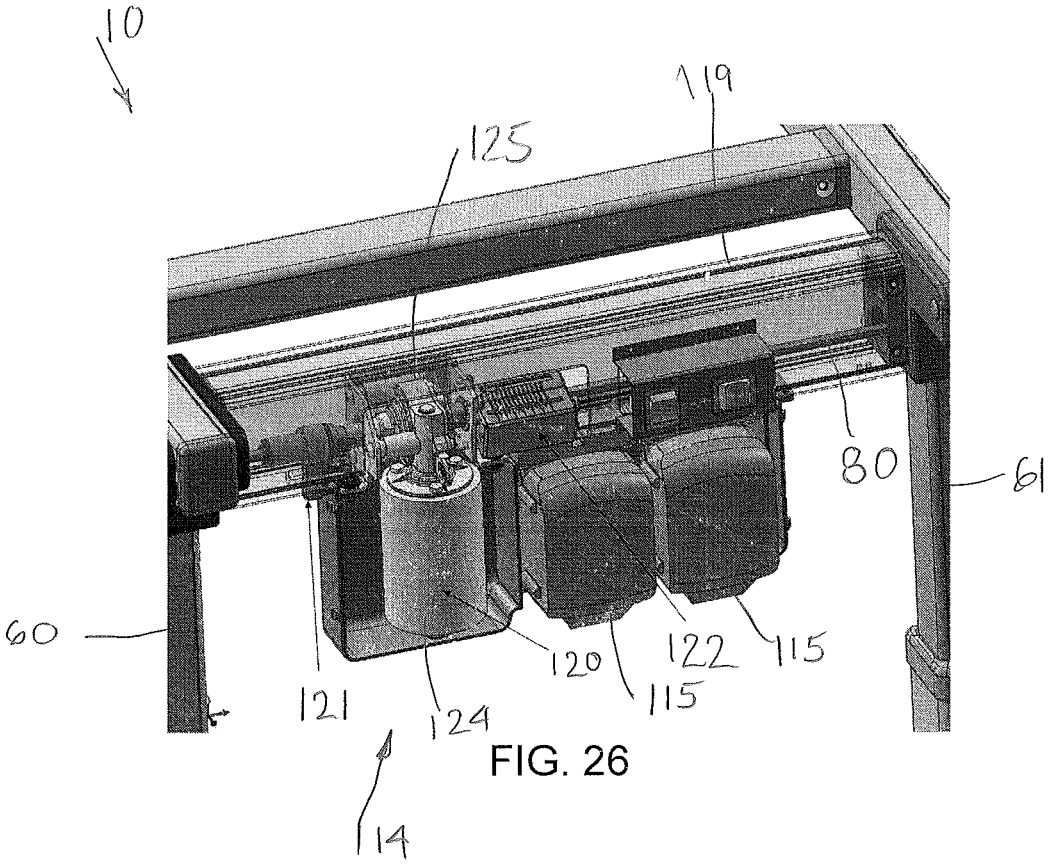
FIG. 26 is a perspective view of the power drive system with components of the drive system being visible.

Referring to FIG. 26, the upper crossbeam structure 32 is supported at each end by the pair of upper posts 60 and 61 and comprises a channel shaped housing 119 for supporting a lift motor or gearmotor 120, a lever-actuated lift motor release mechanism 121, the hexagonal cross shaft 80 and a height sensing switch assembly 122. As described herein, the lift motor 120 includes a motor 124 and gearbox 125 and is releasably coupled to the cross shaft 80. The switch assembly 122 serves as a lift range stop switch assembly that is independently coupled to the cross shaft 80.

Referring to FIGS. 27-31, the lift motor 120 is a combined motor 124 and gearbox preferably formed as a gear reducer 125. To the side of the lift motor 120 the exposed (handle) portion powered lift release lever 126 projects forwardly through an opening 127 in the upper cross beam structure 32.

Figure 27:
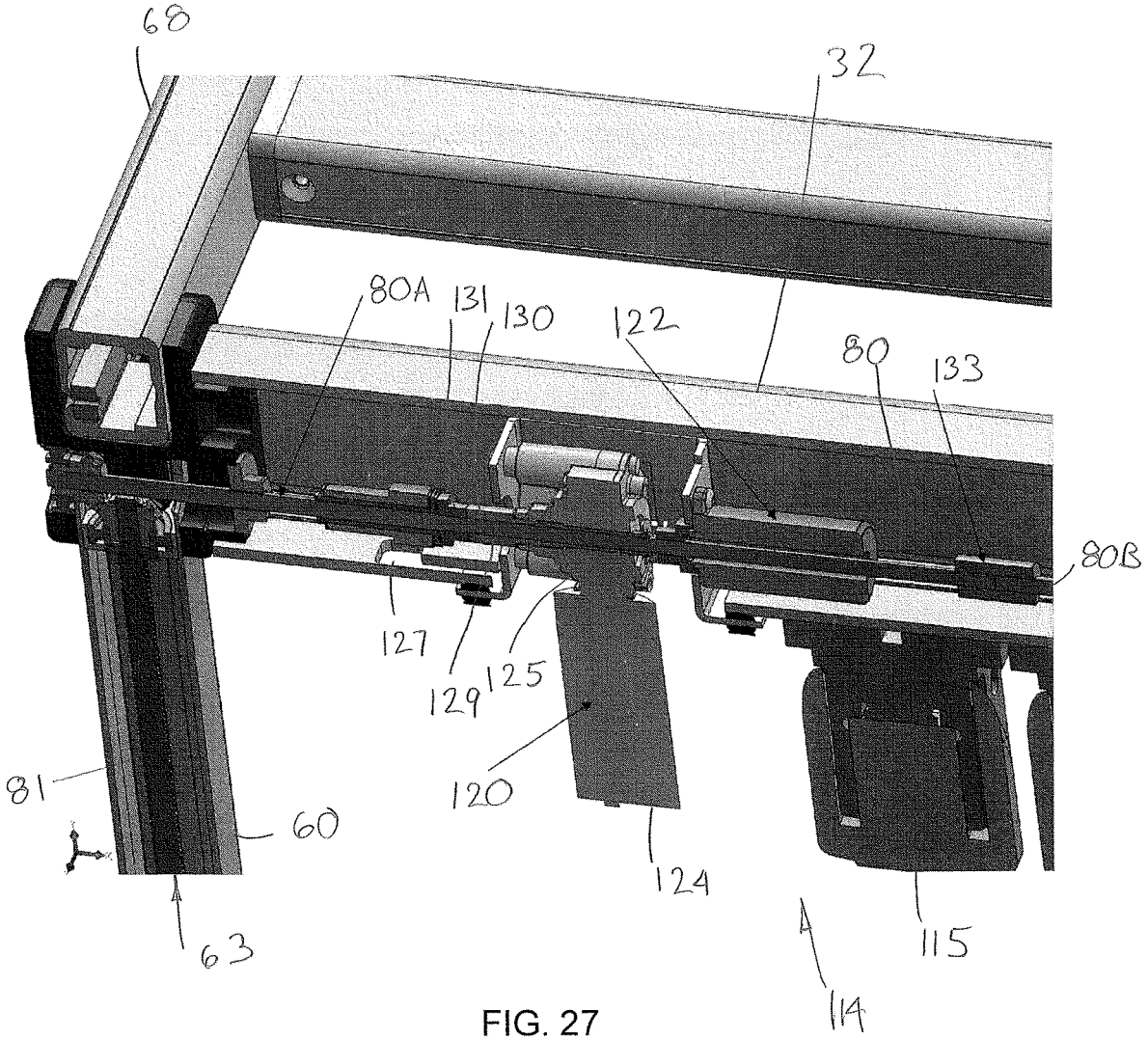
FIG. 27 is a cut-away perspective view of the power drive system including a hexagon cross shaft, worm gear, moving gear-rack and mounted switches provided for lift-height position sensing.
Figure 28:
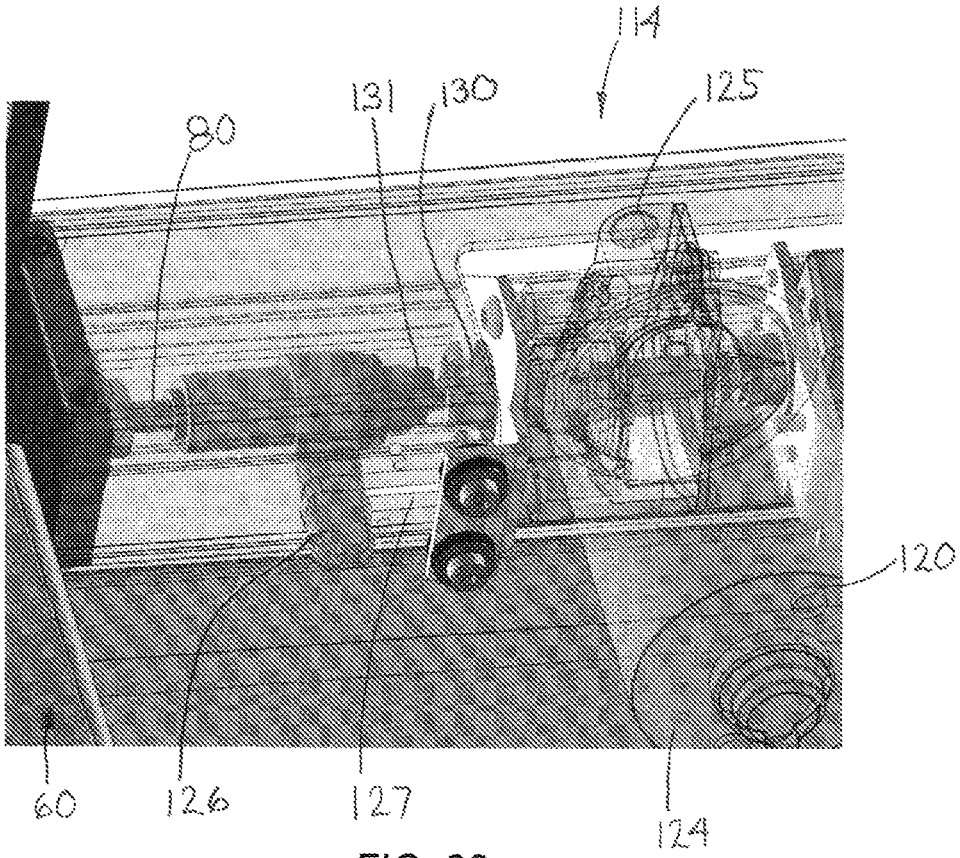
FIG. 28 is a fragmentary perspective view showing a shaft coupler in a disengaged position.
Figure 29:
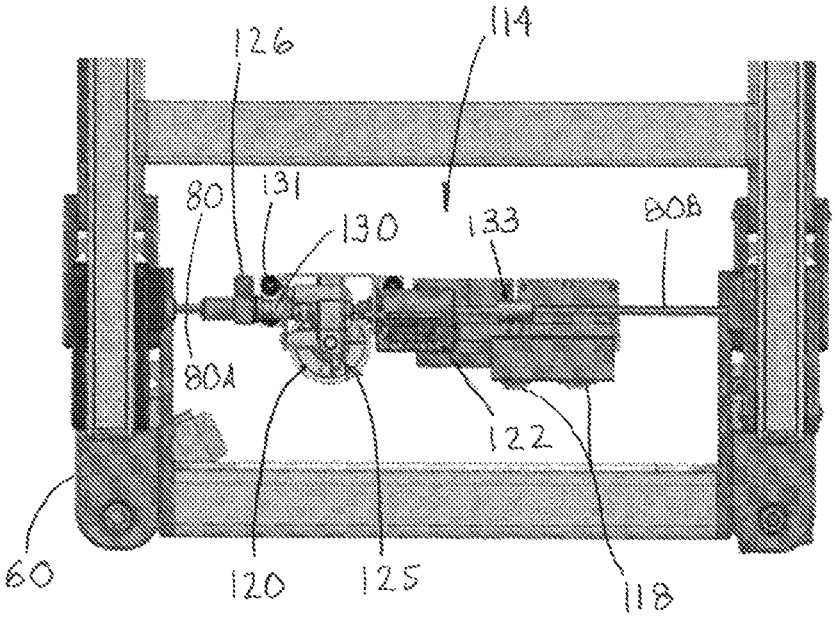
FIG. 29 is a plan view of the power drive system.

Referring to FIGS. 27-29, rotation of the hexagon shaped cross-shaft 80 extends lifting power from the lift motor 120 to turn each of the double jack screw assemblies 63 that are disposed within each of the pair of support columns 30 and 31. The center output shaft 129 of the lift motor gear reducer 125 is hollow which allows the hexagon shaped cross shaft 80 to pass through without interference. The RH side of the hollow output shaft 129 has an extended portion 130 wherein a portion of the extension 130 is notched away to form a driving cross-slot. A power link 131 has a hexagon shaped bore that slidingly mounts on the hexagon cross shaft 80 and is fitted so that the power link 131 can move rightwardly and leftwardly on the hexagon cross shaft 80 while continually transmitting rotational torque between the power link 131 and the hexagon cross shaft 80 so that they rotate equally. The power link 131 includes projections on one end that fittingly match the shape of the driving cross slot of the extension 130 on the lift motor output shaft 129.

The opposite end of the power link 131 has the lift power release lever 126. A compression spring is mounted between the power link 131 and the adjacent upper post 60, and forces the power link 131 to slide towards the lift gearmotor 120 so that the projections of the power link 131 will engage the driving cross slot in the extension 130 of the lift gearmotor output shaft 129 thereby turning the power link 131 and cross shaft 80 when the lift motor 120 turns while the power link 131 and gear motor output shaft 129 are engaged for normal power lift operation.

If the lift motor 120 should fail or the battery 115 be discharged the lift can be operated manually by disengaging the power link 131 from the extension 130 of the lift motor shaft 129. To disengage, the lift power release lever 126 is shifted along the cross shaft 80 thereby compressing the spring. The operator can then insert a hexagon shaft of a manual lift crank handle into the hexagon shaft coupler for manual driving of the lift columns 30 and 31.

In operation, the gearmotor 120 drives the cross shaft 80 causing the occupant support arms 68 and 69 to raise or descend with the lift columns 30 and 31. The lifting pair of upper posts 60 and 61 and the seat support arms 68 and 69 attached at the upper ends thereof causes the patient/operator seat 16 to move upwardly. Reversing the direction of rotation of the rotating lift parts will cause the patient/operator seat 16 to move downwardly.

Now referring to FIG. 27, the lift drive cross shaft 80 preferably is formed with a RH shaft section 80A and a LH shaft section 80B, which are joined by a shaft coupler 133. To define limits for raising and lowering of the lift columns 30 and 31, the height sensing switch assembly 122 is mounted over the shaft 80 so as to detect operation of the cross shaft 80 and the relative movement and positions of the lift columns 30 and 31. The switch assembly 122 cooperates with limit switches to determine the position of the lift columns 30 and 31 and stop operation of the motor 120 at the upper and lower limits of column travel. Actuation of these switches provides signals to the motor power and logic control module 117 through which information is used by the control logic for safe and complete operations.

Referring to FIGS. 30 and 31, the batteries 115 preferably are removably supported in respective battery mounts 135. In the preferred embodiment, the two different batteries 115 may be provided such as a 24V battery and a 32V battery wherein this dual voltage may optionally provide two different lift speeds depending upon which battery is selected by an associated one of the switches 118. Another of the switches 118 may be used as an up-down switch to control the motor 120 for raising and lowering of the lift columns 30 and 31.

The illustrated version of the transporter 10 is provided without power driving capability. The transporter 10 is operated primarily by a caregiver who will push or pull the transporter 10 to move it horizontally on the support surface or floor. Optionally, a power drive may be provided on at least some wheels associated with the transporter to permit powered moving of the transporter.

Figure 32:
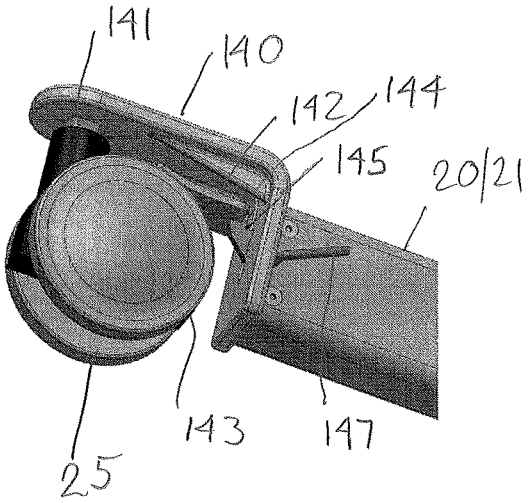
FIG. 32 is fragmentary perspective view of a rear wheel swivel lock assembly in a locked condition.
Figure 33:
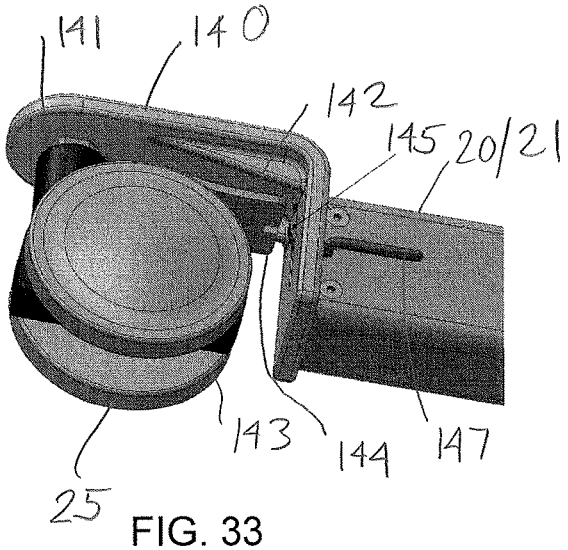
FIG. 33 is fragmentary perspective view of the rear wheel swivel lock assembly in an unlocked condition.
Figure 34:
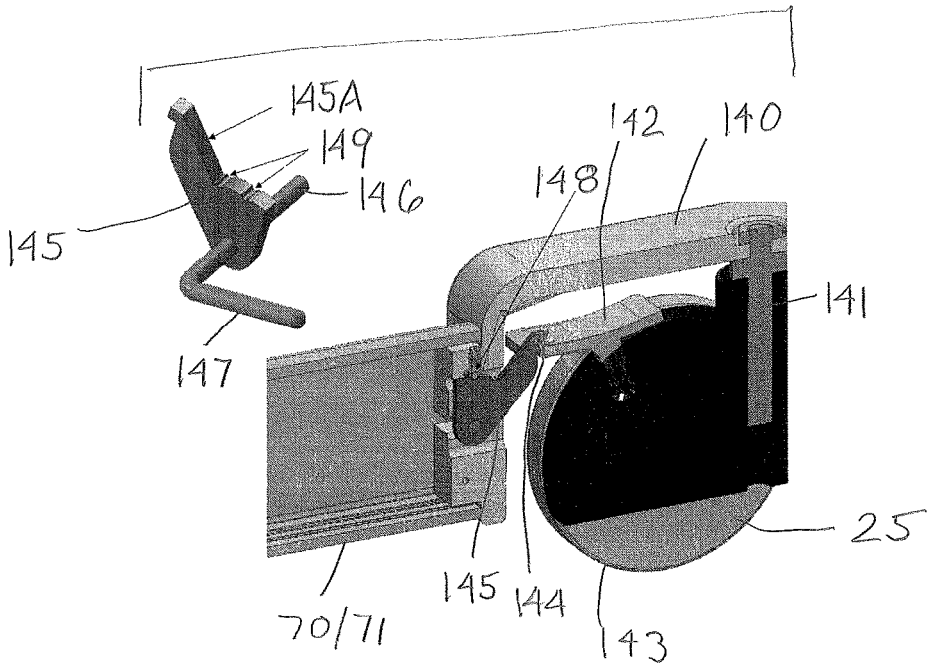
FIG. 34 is fragmentary perspective view in cross-section of the rear wheel swivel lock assembly in the locked condition.
Figure 35:
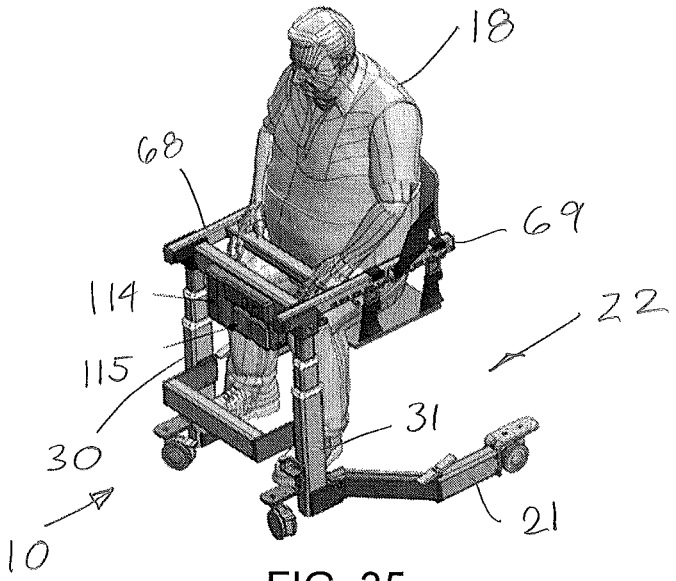
FIG. 35 is a front perspective view of another embodiment of the patient wheelchair lift-transfer device configured with an alternate seat assembly.

For manual movement of the transporter 10, it may be desirable to lockout rotation or swiveling of the rear wheels 25 on the wheel support arms 20/21. Referring to FIGS. 32-34, each wheel 25 is pivotally mounted on an L-shaped wheel mount 140 that projects rearwardly from the outer arm section 70/71. A pivot shaft 141 joins the wheel 25 to the wheel mount 140 so that the wheel 25 can swivel about a vertical axis.

Each wheel also includes a lockout plate 142 that projects to the side of the wheel 25 above the rolling surface 143. The lockout plate 142 includes a formation preferably formed as a notch 144 that is configured to receive an edge of a lock member or lever 145 that is pivotally connected to the wheel mount 140. The lock lever 145 includes a pivot axle 146 that is formed integral with a manual latch handle or actuator 147 as best seen in the exploded view of FIG. 34. The pivot axle 146 is rotatably joined to the wheel mount 140 so that the lock lever 145 projects rearwardly toward the wheel 25 and is movable toward and away from the notch 144. The latch handle 147 is accessible from the exterior to permit manual pivoting of the lock lever 145 and movement of the nose 145A of the lock lever 145 rearwardly into the notch 144 (FIGS. 32 and 34) to lockout rotation of the wheel 25 and forwardly out of the notch 144 to permit swiveling of the wheel 25. A spring-biased ball detent 148 is provided in the wheel mount 140 to engage detent sockets 149 in the lock lever 145 to restrain the lock lever 145 in either the locked position of FIG. 32 or the unlocked position of FIG. 33. When the wheels 25 are unlocked, this helps an operator when moving the occupant in different directions. However, it may be desirable to restrict wheel movement to facilitate movement of the transporter 10 in a single direction.

In operation, the transporter 10 has significant flexibility in supporting an occupant 18 and transferring locations. The support arms 68 and 69 have connector mounts 105 thereon to help support a variety of seat and sling configurations as will be disclosed further herein. For example, the adjustable seat assembly 16 can readily support the occupant 18. The transporter 10 includes the drive assembly 114 for DC powered lifting of the lift columns 30 and 31, wherein the batteries 115 are readily changeable.

Figure 36:
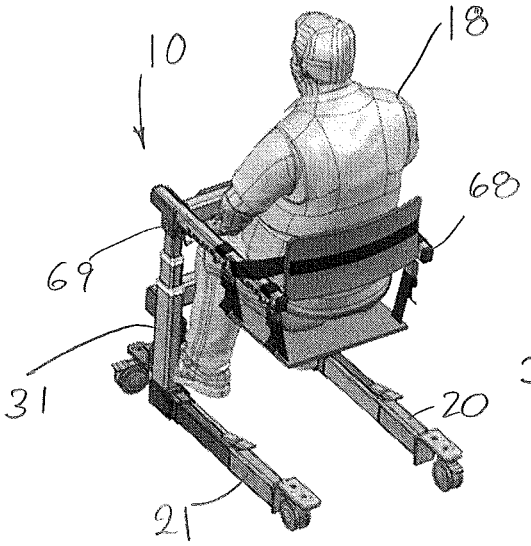
FIG. 36 is a rear perspective view of the lift-transfer device of FIG. 35 with the wheel support arm assemblies in a straight condition.
Figure 37:
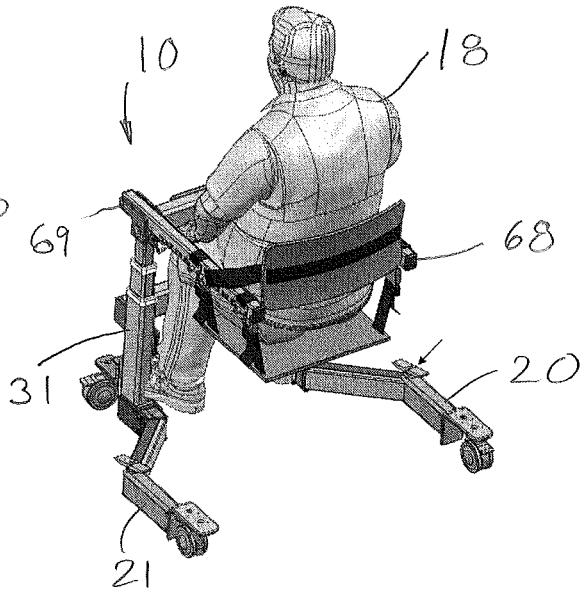
FIG. 37 is a rear perspective view of the lift-transfer device of FIG. 36 with the wheel support arm assemblies in an expanded condition defining an expanded, full width position between the wheel arm assemblies.

As seen in FIG. 37, the wheel support arms 20 and 21 can be easily opened wide to increase the space 22 simply by releasing the arm position locks or position locking mechanisms 77. Since the arm position locks 77 have an exposed lever actuator, the locks 77 can simply be locked and unlocked by the foot of an operator. When the transporter 10 is adjusted to the narrowed position of FIG. 36, the transporter 10 can readily pass through narrow doorways.

Referring to FIGS. 38, 39, 40A and 40B, the above-described transporter 10 can be modified to form a lift-transfer device that is configured as a gurney to define a gurney transport lift 150 for lifting and transferring a person to and from a bed 151 in a supine position. To use common terms, the gurney transport lift 150 is a transporter that uses many of the same components described above relative to the transporter 10 wherein the total lateral width of the gurney transporter 150 is extended to support a body support unit preferably formed as a stretcher unit 152.

Figure 38:
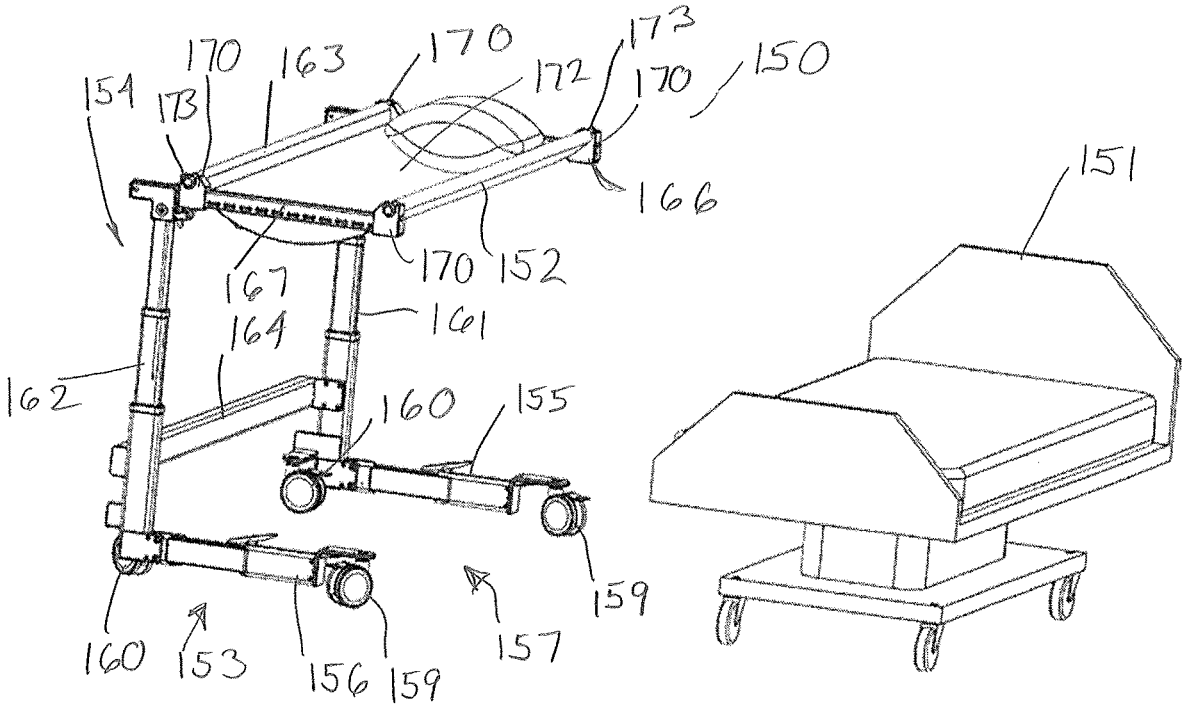
FIG. 38 is a perspective view of an alternate lift-transfer device configured as a gurney to define a gurney transport lift for lifting and transferring a person to and from a bed.
Figure 39:
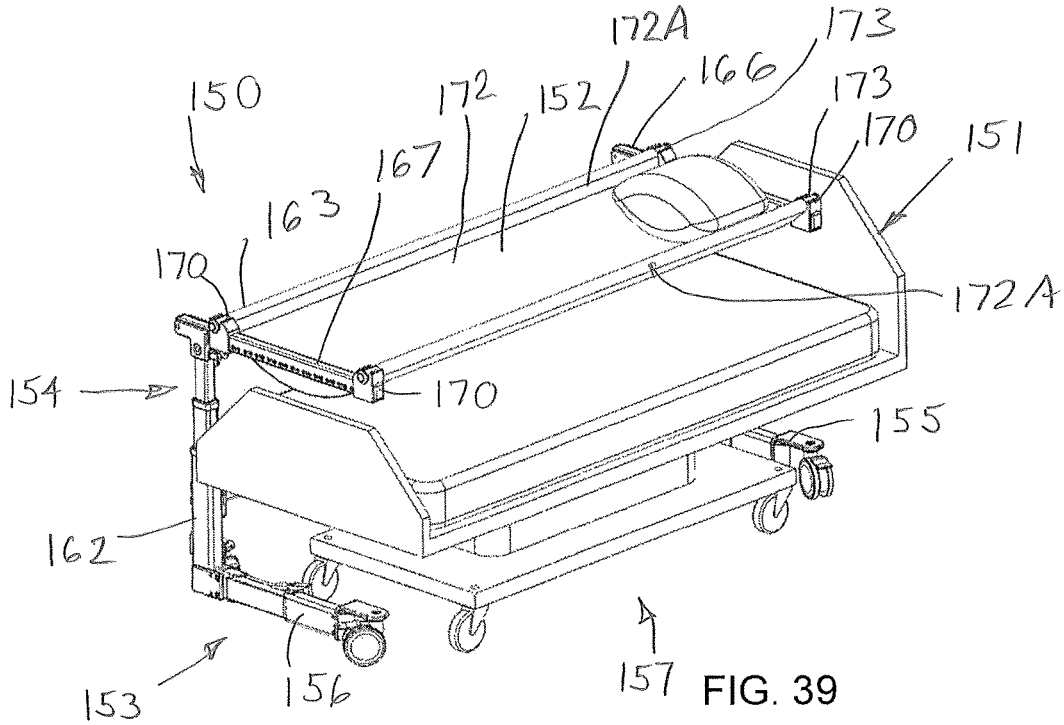
FIG. 39 is a perspective view of the gurney transport lift shown with the lift columns in a raised position and the gurney disposed above a bed.

Generally, the transporter 150 includes a wheeled base assembly 153 having an upright assembly 154 projecting therefrom. The upright assembly 154 in turn mounts the stretcher unit 152 or other similar body support unit thereon as seen in FIGS. 38 and 39 for carrying an occupant/patient 18. The wheeled base assembly 13 includes a pair of generally parallel and rearwardly extending rear wheel support arms 155 and 156 which are basically formed the same as wheel support assemblies 20 and 21 and which may include any of the inventive features disclosed herein. These rear wheel support arms 155 and 156 are sidewardly spaced apart and define a rearwardly opening space 157 that is optionally adjustable in width therebetween to permit the base 153 to provide an opening that is wide enough to straddle a bed 151. The narrow width shown in FIG. 39 may be suitable to straddle the bed 151 without adjustment, but the adjustability of the space 157 may be needed to accommodate beds or medical gurneys that might be wider than the bed 151 as shown.

Also, while the lateral width of the transporter 150 is wider than the transporter 10, the transporter 150 still has a dimension measured front to back across the stretcher unit 152 that is narrow enough to pass through a doorway or passageway. Each rear wheel support arm 155 and 156 has a wheel 159 or roller mounted adjacent the rear free end thereof while the base assembly 153 also includes front wheels 160.

The upright assembly 154 includes a pair of telescoping lift columns 161 and 162 that are formed the same as lift columns 30 and 31 described above such that a detailed discussion of common components is not required. The lift columns 161 and 162 are connected to and spaced apart by cross beam structures 163 and 164 which are structurally and functionally similar to but longer than the above-described cross beam structures 32 and 33. Like beam structures 32 and 33, the cross beam structures 163 and 164 extend horizontally transversely across the transporter 150.

More particularly as to the lower beam structure 164, this structure is made longer than the comparable beam structure 33. As to the upper beam structure 163, this beam structure 163 also accommodates a motor lift drive 114-1 that is formed basically the same as the lift drive 114 described above. However, the lift drive 114 is modified to accommodate the longer length of the beam structure 163 in comparison to the shorter beam structure 32. This modification is accomplished by lengthening the cross shaft 80 so that it can span the longer distance between the lift columns 161 and 162.

Figure 42:
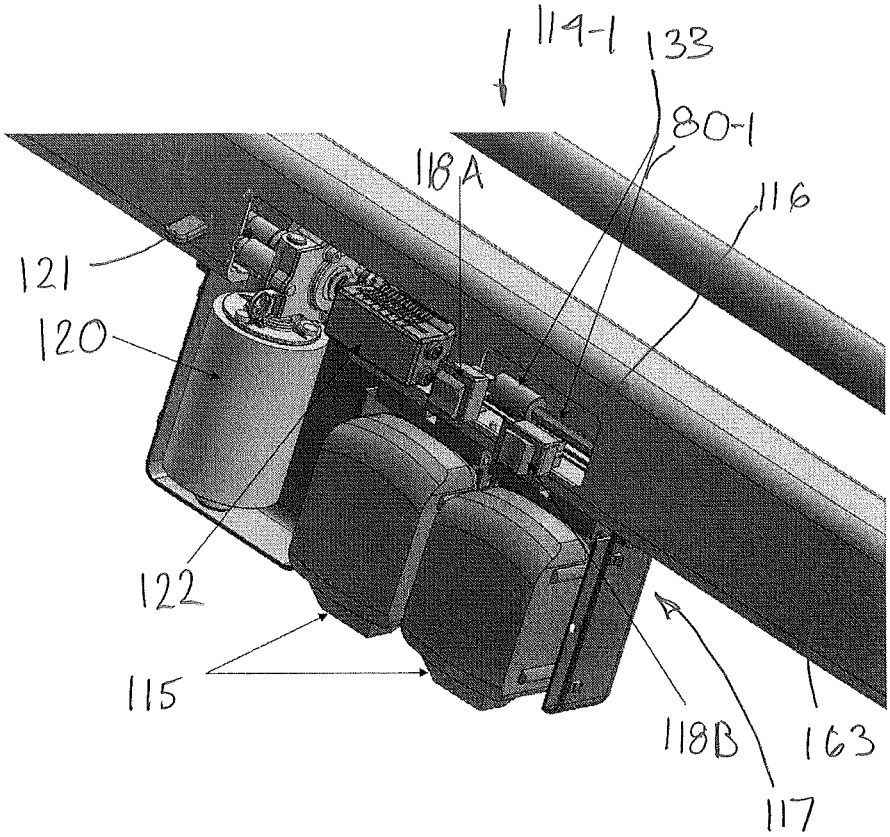
FIG. 42 is perspective view of the power drive system therefor.

As seen in FIG. 42, the upper crossbeam structure 163 is supported at each end by the pair of upper posts 161 and 162 and comprises a channel shaped housing for supporting a lift motor or gearmotor 120, a lever-actuated lift motor release mechanism 121, the hexagonal cross shaft 80-1 with a coupler 133, and a height sensing switch assembly 122. The cross shaft 80-1 is basically the same as shaft 80 except that it is made longer. As described herein, the lift motor 120 is releasably coupled to the cross shaft 80-1, and the switch assembly 122 serves as a lift range stop switch assembly that is independently coupled to the cross shaft 80-1.

To power the transporter 150, the upper crossbeam structure 163 includes batteries 115 and a driving control module 116 that includes an operator control panel 117 that may include an up-down switch 118A for the lift up-down control, and a battery select switch 118B. In this configuration, the lift columns 161 and 162 can be raised to a lifted position of FIG. 38 and lowered to a lowered position of FIG. 39.

To support the patient or lift occupant, the lift columns 161 and 162 are disposed adjacent opposite sides of the transporter 150 and at the upper ends thereof are respectively joined to horizontally elongate occupant support arms 166 and 167 which are formed the same as support arms 68 and 69. The pair of occupant support arms 166 and 167 then project rearwardly in cantilevered relationship away from the support post assemblies 161 and 162 in generally parallel relationship to support the stretcher unit 152. The support arms 166 and 167 are supported on the lift columns 161 and 162 so as to move vertically therewith for loading and transport of the stretcher unit 152.

Additionally each support arm 166 and 167 includes a pair of supports 170 which include an upward opening pocket that is removably engagable with the stretcher unit 152. The supports 170 preferably slide, clamp or otherwise fasten onto the support arms 166 and 167. As to the illustrated stretcher unit 152, the stretcher unit 152 comprises a stretcher or stretcher body 172 that is basically formed of a flexible or semi-flexible fabric material that includes tubular hems or edge portions 172A (FIG. 39) along opposite side edges to slidably receive a pair of stretcher poles 173 therein. The opposite ends of the stretcher poles 173 project outwardly of the stretcher 172 and slide into the pocket of the respective support 170.

Figure 41:
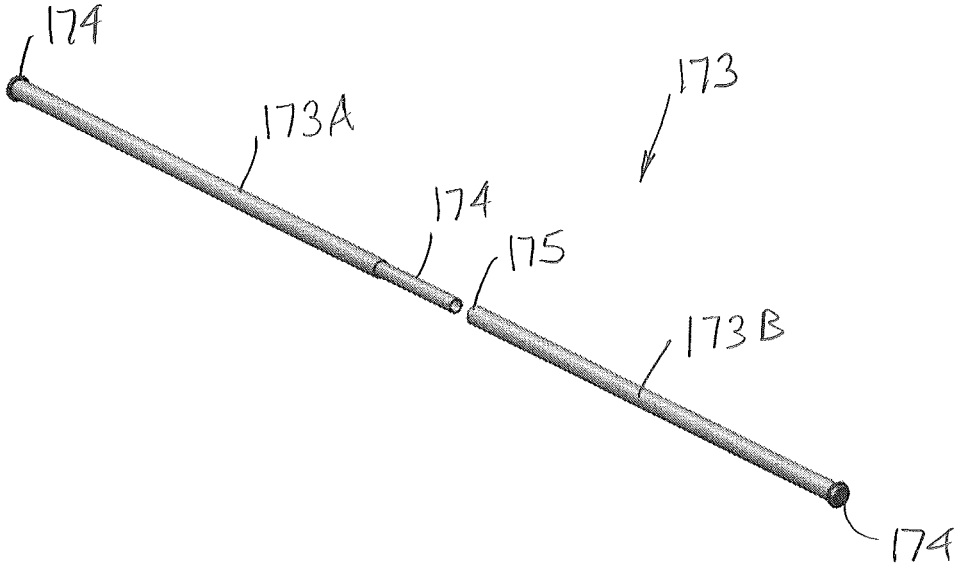
FIG. 41 is a perspective view of a segmented stretcher pole.

FIG. 41 illustrates one construction for a stretcher pole 173 which is segmented into pole sections 173A and 173B. The pole sections 173A and 173B have male and female end connectors 174 and 175 that mate to join the pole sections 173A and 173B into a single stretcher pole 173 as generally seen in FIG. 40A. If desired, the pole sections 173A and 173B might be slid into the tubular edge portions 172A from opposite ends of the stretcher body 172 and then joined together to simplify assembly. The opposite end of each stretcher pole 172 includes a radially enlarged rim 174 that is radially larger than the pocket of the support 170. Therefore, when the opposite ends of the stretcher pole 173 are seated in the support 170, the rim 174 abuts against the side face of the support 170 to axially restrain the pole ends and resist flexing of the poles 173 under the load of a patient or occupant. With this construction, the transporter 150 is readily usable as a gurney while incorporating most of the same components as the transporter 10.

Figure 43:
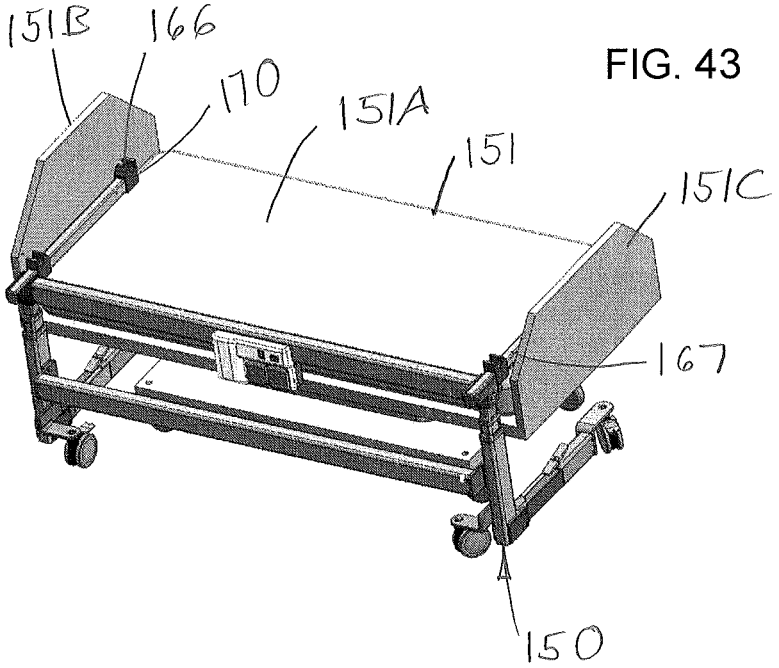
FIG. 43 is a perspective view of the lift transfer gurney positioned over a bed.
Figure 44:
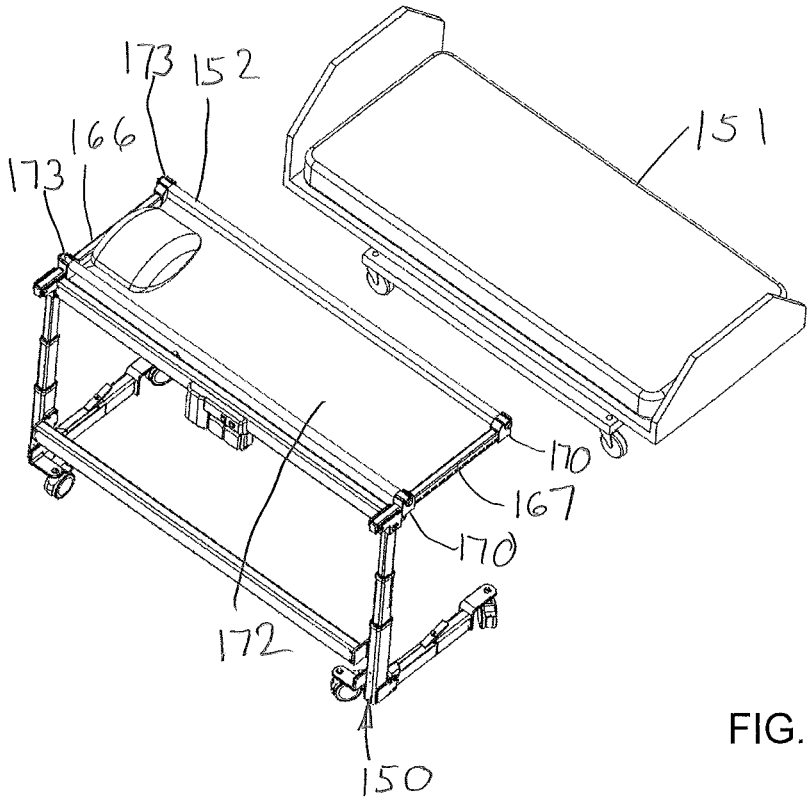
FIG. 44 is a perspective view of the lift transfer gurney positioned adjacent to a bed and supporting a stretcher body and stretcher poles thereon.

In use, FIG. 43 illustrates the lift transfer gurney 150 positioned over the bed 151. The support arms 166 and 167 are in a low or lowered position so as to rest on the bed support surface 151A near the headboard 151B and footboard 151C. When located close to the bed support surface 151A, the support arms 166 and 167 are positioned to facilitate sliding of the stretcher body 172 beneath an occupant as described below. FIG. 44 also shows the lift transfer gurney 150 positioned adjacent to the bed 151 and supporting the stretcher 152 with the stretcher poles 173 cradled in the supports 170 which facilitates lifting and transport of a person.

FIGS. 45 and 46 illustrate the lift transfer gurney 150 positioned adjacent to the bed 151 in an unloaded condition, wherein the stretcher body 172 and stretcher poles 173 are disposed on the bed 151 with the body of a patient 18 supported thereon. To position the stretcher body 172, the stretcher body 172 can be laid underneath the patient 18 by rolling the patient to one side. Then, the patient 18 is rolled to their other side so that the stretcher body 172 can be pulled flat, after which the patient is rolled back so as to lie on their back with the stretcher body 172 lying flat underneath their back. While patient 18 typically lies on their back in a supine position, the patient 18 may also lie face down in a prone position or on their side in a prostrate position. In FIG. 45, the stretcher poles 173 are fitted in the stretcher body 172 either after placement of the patient 18 on the bed 151 wherein the gurney 150 has been moved away, or in preparation for transfer of the patient 18 from the bed 151 wherein a caregiver may slide the stretcher body 172 underneath the patient and then install the stretcher poles 173. In FIG. 46, the stretcher poles 173 are not installed such as after placement of the patient 18 on the bed 151.

Figure 47:
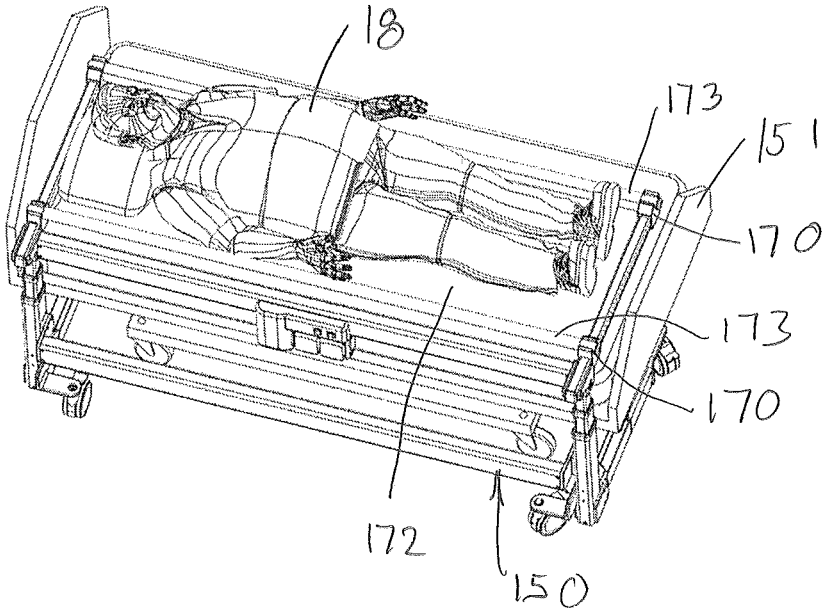
FIG. 47 is a perspective view of the lift transfer gurney positioned over a bed with the stretcher body and stretcher poles disposed on the bed along with the patient supported thereon before or after transfer of the patient.
Figure 48:
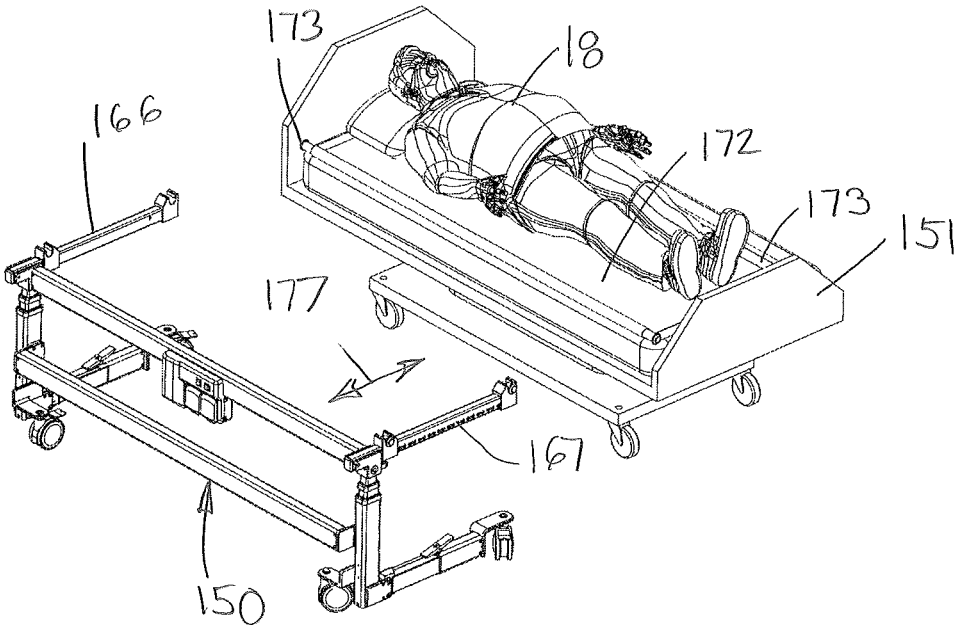
FIG. 48 is a perspective view of the lift transfer gurney being displaced relative to the bed with the stretcher body and stretcher poles disposed on the bed along with the patient.

FIG. 47 shows the lift transfer gurney 150 positioned over the bed 151 with the stretcher body 172 and stretcher poles 173 disposed on the bed 151 along with the patient 18 supported thereon before or after transfer. FIG. 47 further shows the lift transfer gurney 150 moved to the bed 151 with the stretcher poles 173 cradled in the supports 170. Since the stretcher body 172 may be flexible, the stretcher poles 173 can be lifted upwardly to allow the support arms 166 and 167 to be disengaged therefrom or downwardly to allow them to be reengaged with the supports 170. FIG. 48 shows the lift transfer gurney 150 being displaced relative to the bed 151 as indicated by reference arrow 177.

Figure 49:
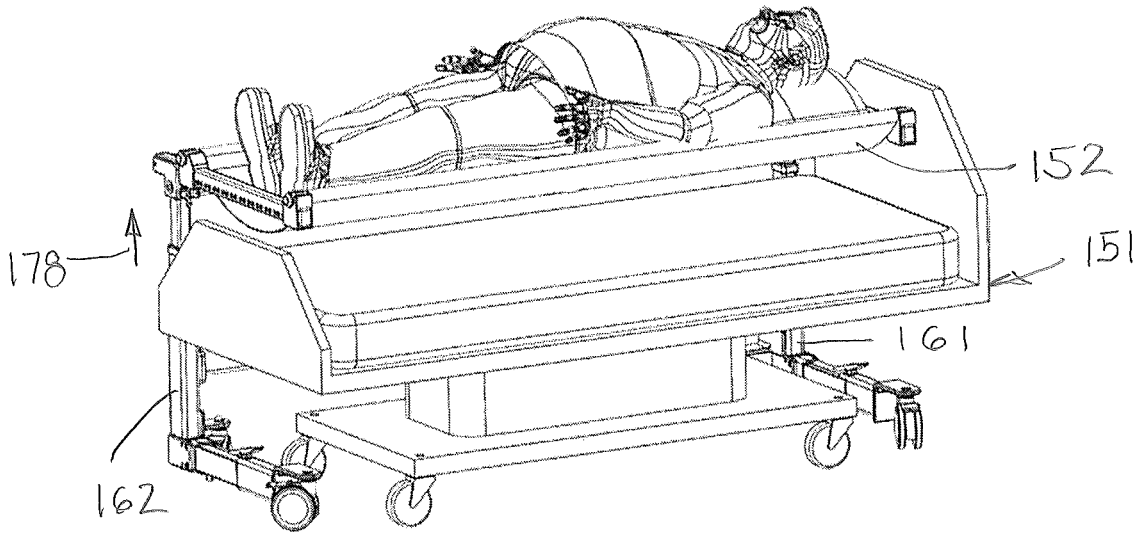
FIG. 49 is a rear perspective view of the lift transfer gurney positioned over a bed with the stretcher body and stretcher poles disposed above the bed along with the patient supported thereon for lowering the patient to the bed or lifting the patient from the bed.
Figure 50:
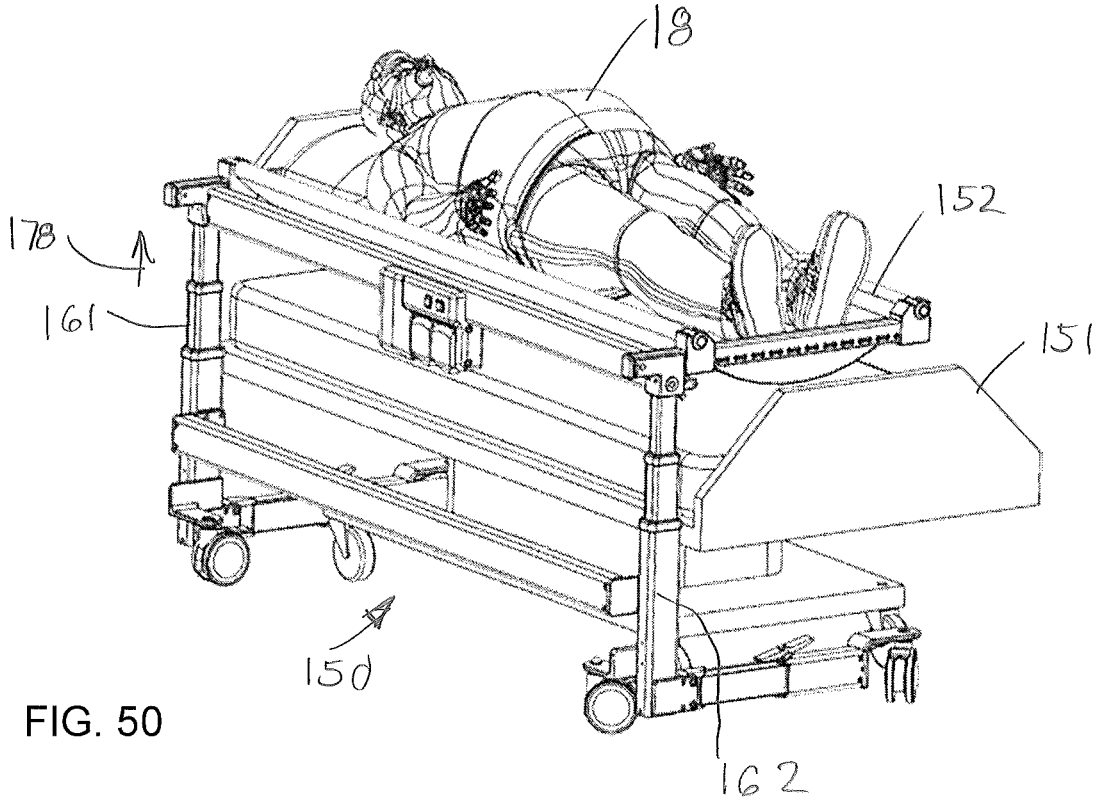
FIG. 50 is a front perspective view of the lift transfer gurney positioned over a bed with the stretcher body and stretcher poles disposed above the bed along with the patient supported thereon for lowering the patient to the bed or lifting the patient from the bed.

When the lift transfer device 150 is engaged with the stretcher 152, FIGS. 49 and 50 show the lift transfer gurney 150 positioned over the bed 151, wherein the lift columns 161 and 162 are telescoped upwardly as indicated by reference arrow 178 to lift the patient 18 above the bed 151. Or the lift columns 161 can be reversed and lowered for lowering the patient 18 to the bed 151.

Figure 51:
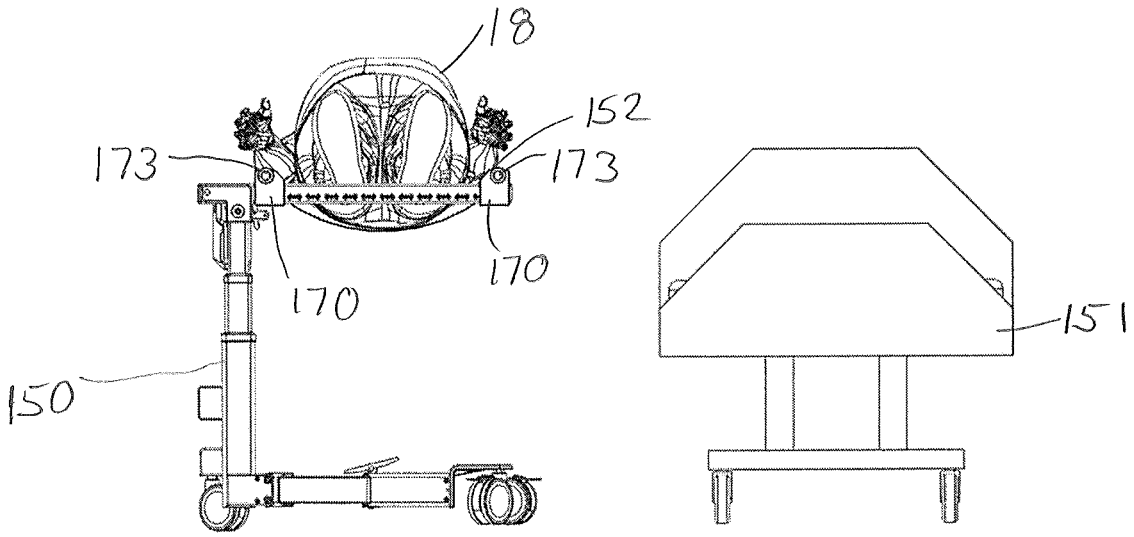
FIG. 51 is an end view of the lift transfer gurney positioned adjacent a bed with the stretcher body and stretcher poles lifted above the bed along with the patient.
Figure 52:
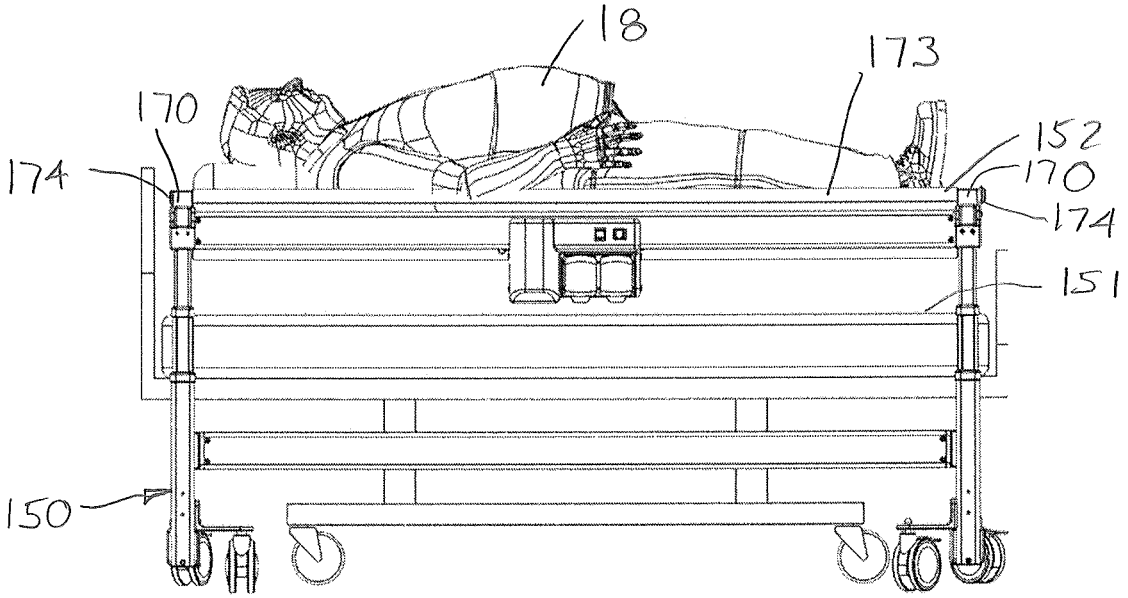
FIG. 52 is a front view the patient lifted above the bed.

As can be seen in FIG. 51, the lift transfer gurney 150 is positioned at an elevation that is higher than the bed surface to ensure clearance and transfer of the patient 18 to a new location. In FIG. 52, it can be seen that each of the rims 174 on each pole 173 is positioned axially next to a side face of each respective support 170 on the lift transfer gurney 150. The rims 154 axial restrain the pole ends relative to the supports 170 to control sagging of the stretcher fabric when loaded by the patient 18.

Figure 53:
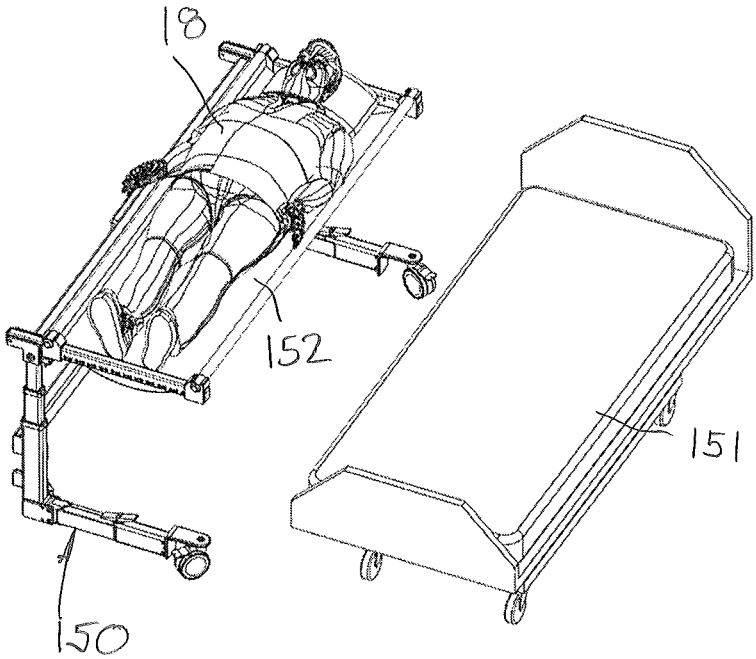
FIG. 53 is a side perspective view of the lifted patient being transferred relative to the bed.
Figure 54:
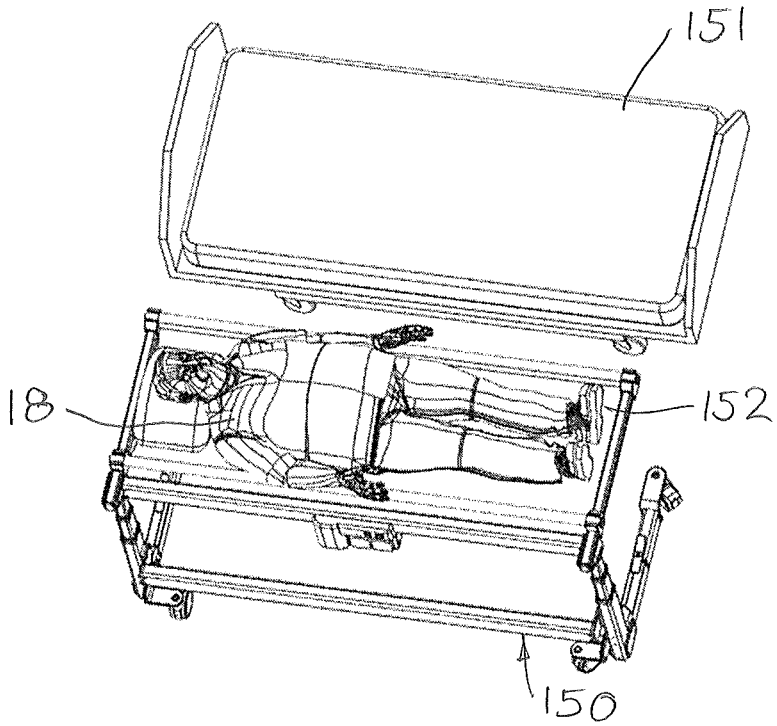
FIG. 54 is a front perspective view of FIG. 53.

FIGS. 53 and 54 thereby illustrate the patient 18 loaded on the lift transfer gurney 150 for transport. The wheeled gurney 150 is readily movable to various locations. Also, the gurney 150 is configured to readily lift and lower a patient 18 from a bed 151 or other similar structure with a minimum of work being required by a caregiver.

Figure 55:
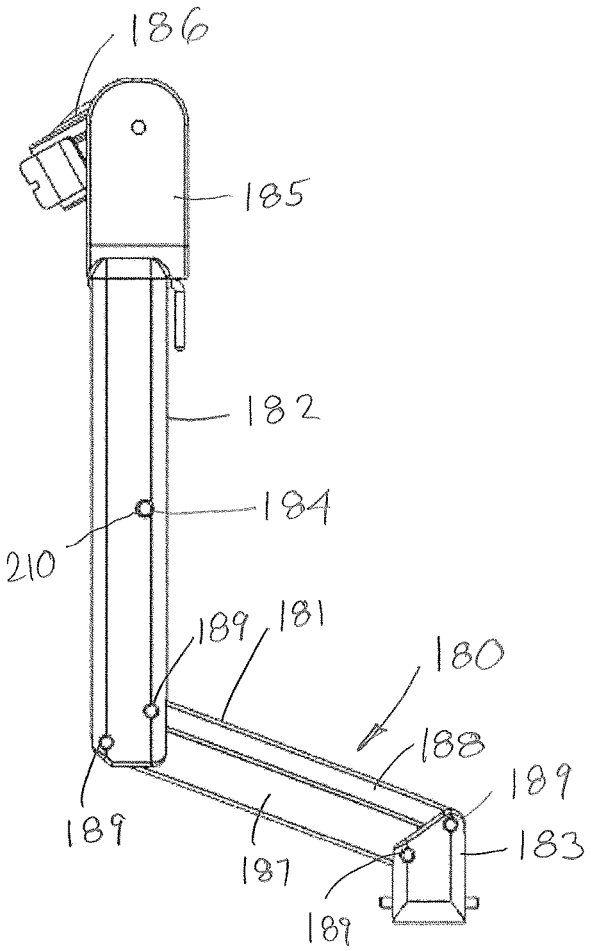
FIG. 55 is a top view of another embodiment of a wheel support arm assembly showing the RH rear wheel support arm linkage with the rear wheel support arm extended to a wide width position and comprising a first position locking mechanism.

Referring to FIG. 55, another embodiment of a wheel support arm 180 is shown with the RH rear wheel support arm linkage 181 connected to an outer arm section 182 and an arm connector 183. The rear wheel support arm 180 is extended to a wide width position and comprises a further embodiment of a position locking mechanism 184 that provides a similar function to the position locking mechanism 77. The outer arm section 182 also includes a wheel mount 185 and a rear wheel 186. Notably, the linkage 181 includes an outer link arm 187 and an inner link arm 188 that are pivotally connected to the outer arm section 182 and the arm connector 183 by pivot connectors 189.

Figure 56:
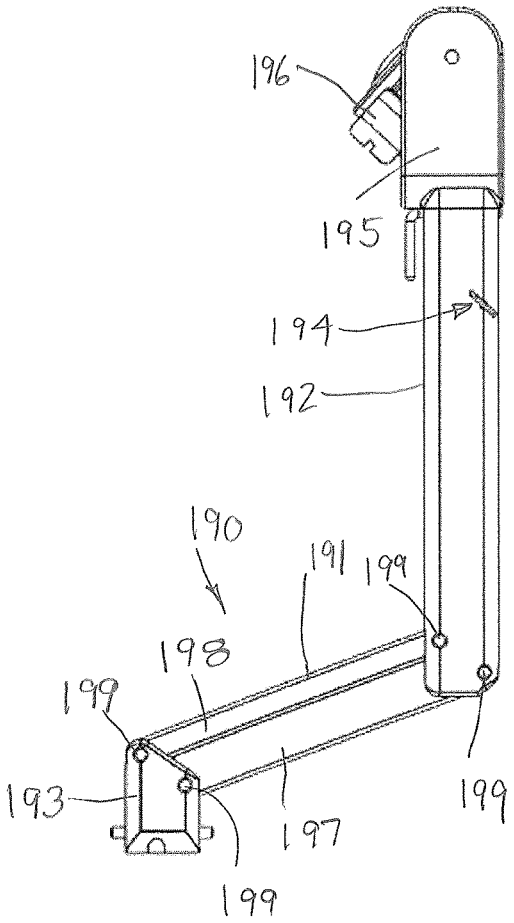
FIG. 56 is a top view of still another embodiment of a wheel support arm assembly showing the LH rear wheel support arm linkage with the rear wheel support arm extended to a wide width position and comprising a second position locking mechanism.

Referring to FIG. 56, another embodiment of a wheel support arm 190 is shown with the LH rear wheel support arm linkage 191 connected to an outer arm section 192 and an arm connector 193. The rear wheel support arm 190 is extended to a wide width position and comprises a further embodiment of a position locking mechanism 194 that provides a similar function to the position locking mechanism 77. The outer arm section 192 also includes a wheel mount 195 and a rear wheel 196. Notably, the linkage 191 includes an outer link arm 197 and an inner link arm 198 that are pivotally connected to the outer arm section 192 and the arm connector 193 by pivot connectors 199.

Figure 57:
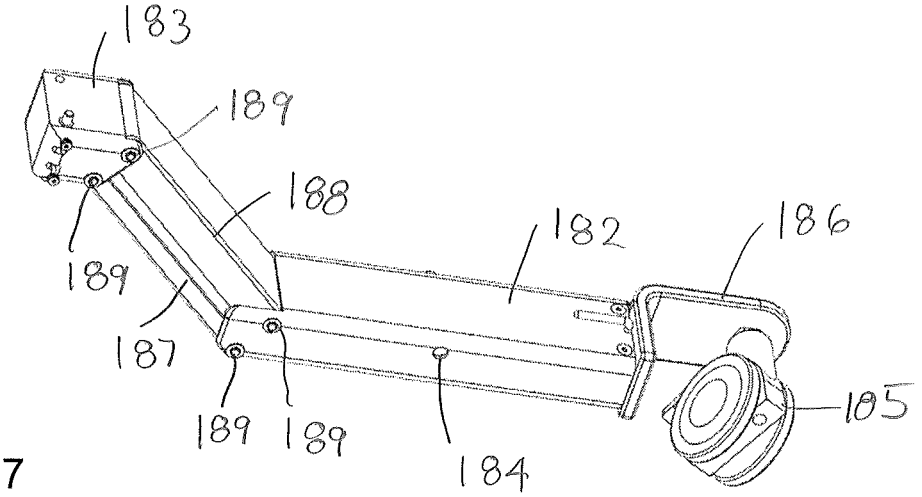
FIG. 57 is a perspective view of the support arm assembly of FIG. 55 with the first position locking mechanism.

FIG. 57 further illustrates the support arm 180 of FIG. 55 with the alternate position locking mechanism 184. While different reference numerals are used for this support arm 180, it will be understood that the support arm 180 or even the support arm 190 are structurally and functionally similar to the support arms 20 and 21 except for the differences noted below as to the position locking mechanisms 184 and 194.

Figure 58:
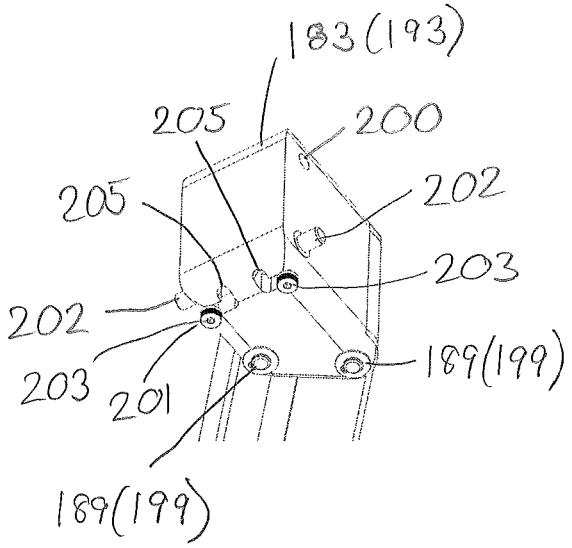
FIG. 58 is a fragmentary perspective view of the rear wheel support arm assembly having a pivot lock mechanism locked in a normal use position.
Figure 59:
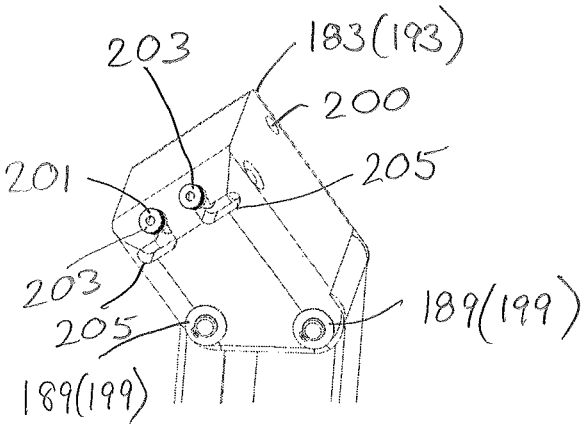
FIG. 59 is a fragmentary perspective view of the rear wheel support arm assembly having a pivot lock mechanism unlocked and partially pivoted to a folded storage position.
Figure 60:
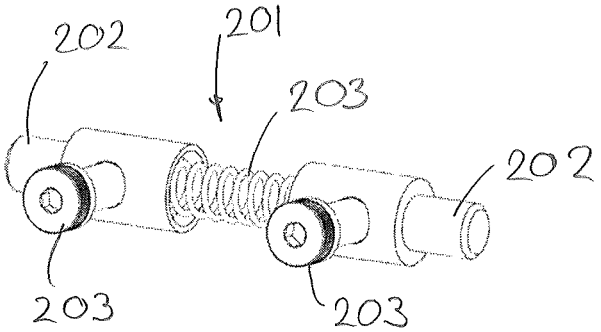
FIG. 60 is a perspective view of spring-biased lock pin assembly for the pivot lock mechanism.

Referring first to FIGS. 58 and 59, the column connectors or connector blocks 183 (193) are formed essentially the same as the arm connectors 75 and are configured for pivotable connection to the column connectors 74. As noted above, the lift-transfer device 10 preferably is configured so that it is foldable as seen in FIGS. 2 and 9-11, while the wheel support arms 20 and 21 may be folded up against the lift columns 30 and 31. Where the alternate support arms 180 or 190 are provided in place of the support arms 20 and 21, the support arms 180 and 190 can pivot to a folded position in the same manner as the support arms 20 and 21. Consistent with the above disclosure, the wheel support arms 180 and 190 are also joined to the lift columns 30 and 31 by pivot connections to allow pivoting of the support arms 180 or 190 upwardly so as to lie flat or parallel with the lift columns 30 and 31. The pivot connections generally comprise an arm connector 183 or 193 formed like the arm connectors 75, which may be pivotally joined with the column connectors 74 that are joined to the respective support column 30 and 31. The pivot pin 74A is configured to be inserted through the pivot bore 200 formed in one corner of the arm connector 183 (193).

As in the arm connector 75, the arm connector 183 (193) also comprises a lock device 201 formed the same as lock device 76 to selectively lock the wheel support arms 180 (190) in the horizontal position of FIGS. 1 and 3-8. The lock device 201 may be unlocked or released to permit the wheel support arms 180 (190) to pivot upwardly to fold against the support columns 30/31. Generally, as to FIGS. 58 and 59, the lock device 201 comprises spring biased locking pins 202 that are biased apart from each other by a biasing member or spring 203 to engage corresponding bores or other formations in the column connector 74 when extended. The pins 202 may be retracted by manual actuators or knobs 203 to retract the pins 202 from the formations in the column connector 74 to permit swinging or pivoting of the support arms 180 (190) to the folded position. The actuators 203 follow L-shaped slots 205 to allow retraction of the pins 202 along sideward legs of the slots 205, and then allow rotation of the pins 202 and actuators 203 along axial legs of the slots 205. Rotation of the pins 202 and actuators 203 along this L-shaped path thereby holds the pins 202 in the retracted position as seen in FIG. 59.

Figure 61:
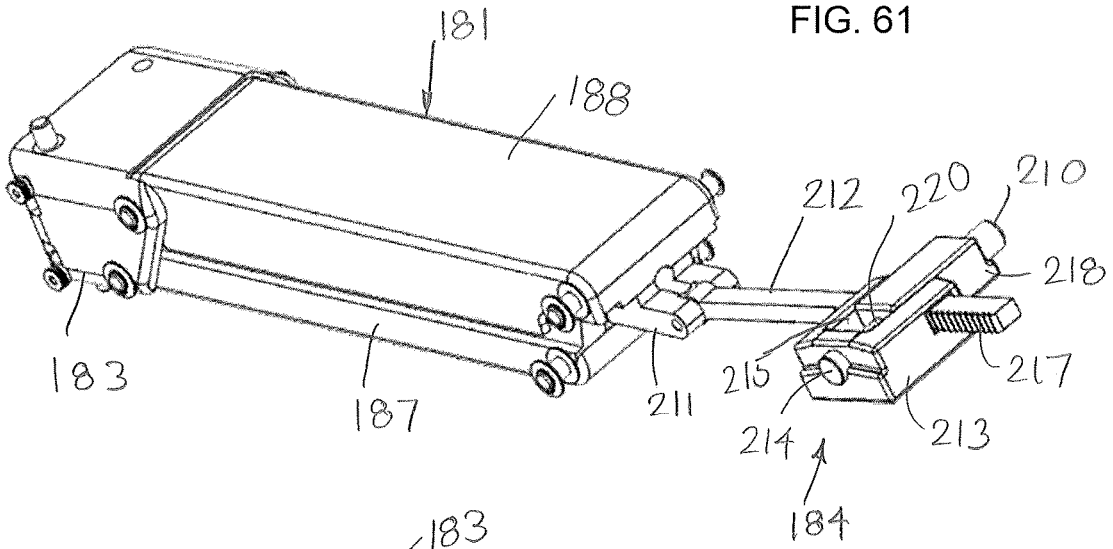
FIG. 61 is a partial perspective view of the wheel support arm assembly showing the RH rear wheel support arm linkage with the rear wheel support arm in a straight, narrow width position and showing the first position locking mechanism.

Next as to the alternate position locking mechanism 184, FIG. 61 shows the rear wheel support arm linkage 181 with the rear wheel support arm 180 in a straight, narrow width position and showing the first position locking mechanism 184 engaged between the linkage 181 and outer support arm section 182 to lock the relative orientation between these components.

Figure 62:
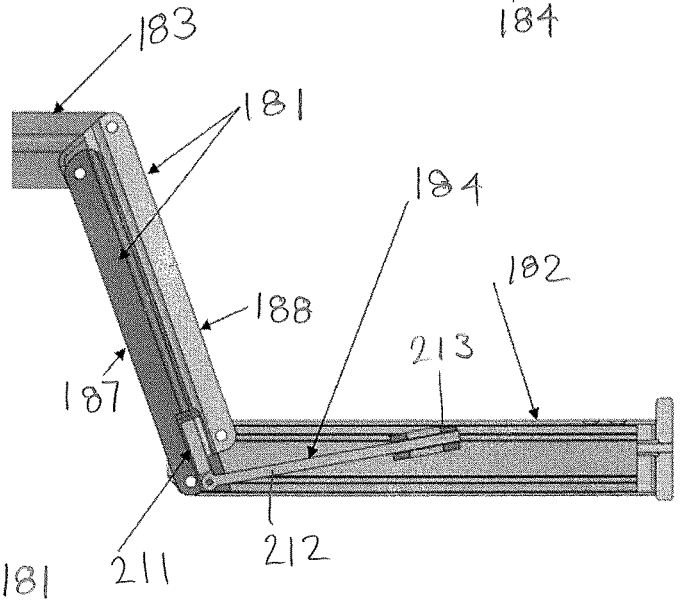
FIG. 62 is a partial bottom view of the wheel support arm assembly showing the RH rear wheel support arm linkage with the rear wheel support arm in the wide width position and showing the first position locking mechanism.
Figure 63:
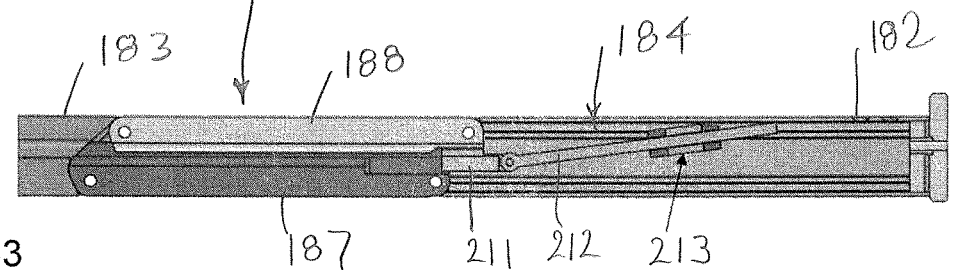
FIG. 63 is a partial bottom view of the wheel support arm assembly showing the RH rear wheel support arm linkage with the rear wheel support arm in the straightened, narrow width position and showing the first position locking mechanism.

In FIGS. 61 and 62, the position locking mechanism 184 basically operates by a lock-release button 210 which projects out of the outer arm section 182. In more detail, a clevis block 211 is attached to inner linkage arm 188 so as to project from one end thereof and move in linear alignment with the linkage arm 188 as seen in FIGS. 62 and 63. The free end of the clevis block 211 is pivotally connected to a link bar 212 that extends axially into the outer arm section 182. The outer arm section 182 includes a pivoting support block 213 that has a bottom shaft 214 that pivotally joins to a bottom wall of the outer arm section 182.

Figure 64:
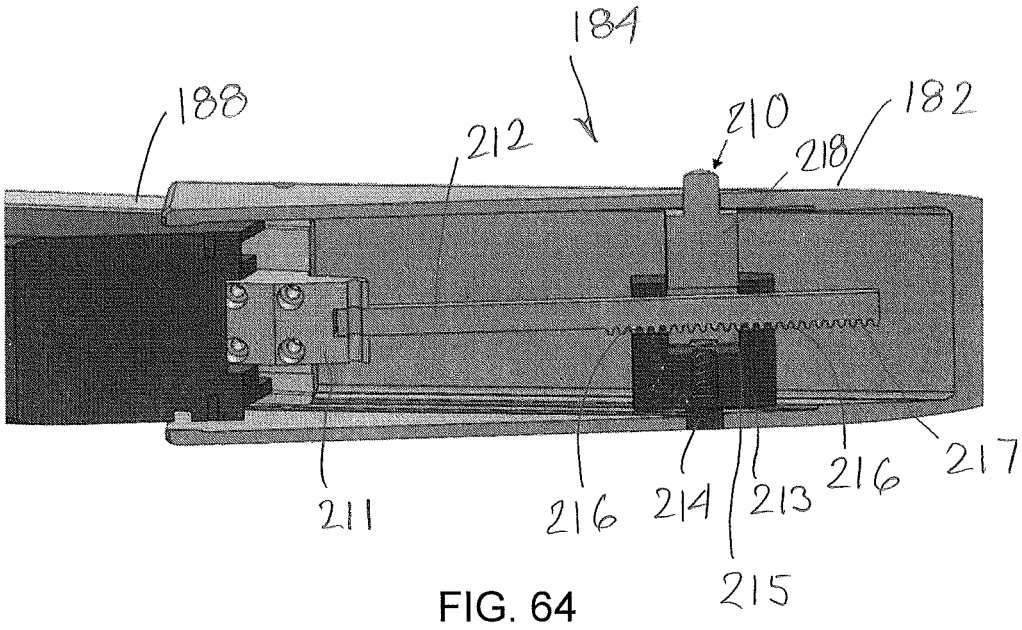
FIG. 64 is a side view of the position locking mechanism in a locked condition.
Figure 65:
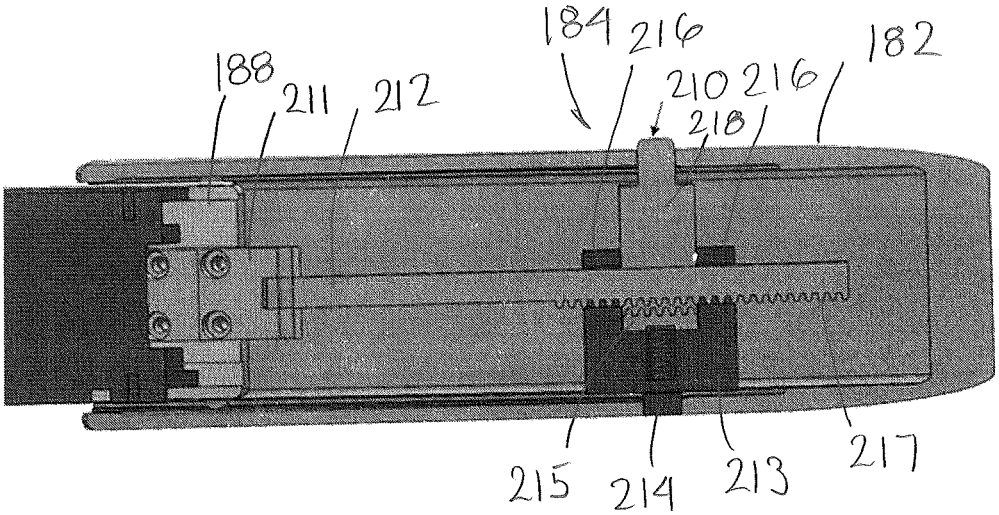
FIG. 65 is a side view of the position locking mechanism in an unlocked condition.
Figure 66:
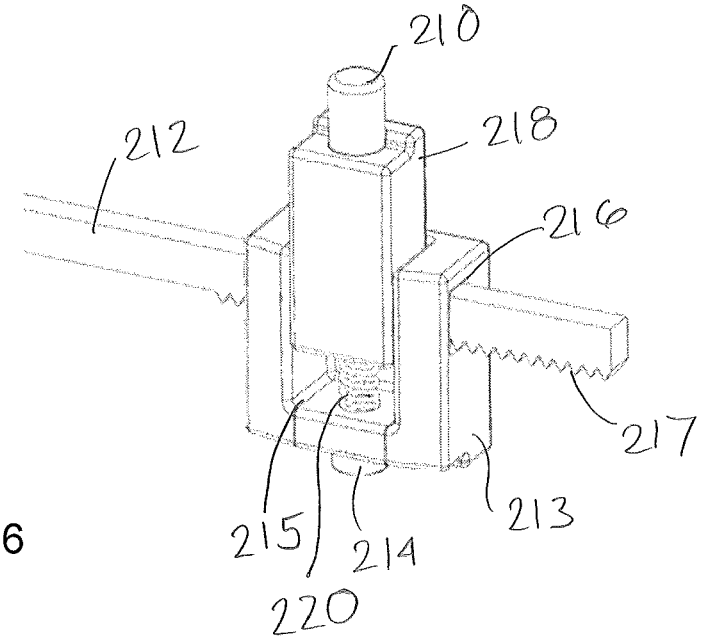
FIG. 66 is a fragmentary perspective view of the position locking mechanism in the locked condition.
Figure 67:
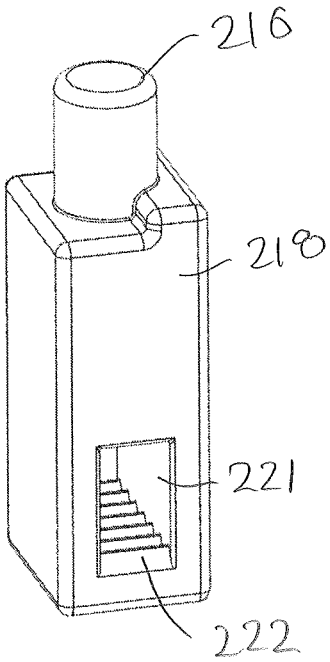
FIG. 67 is a perspective view of a lock plunger.
Figure 68:
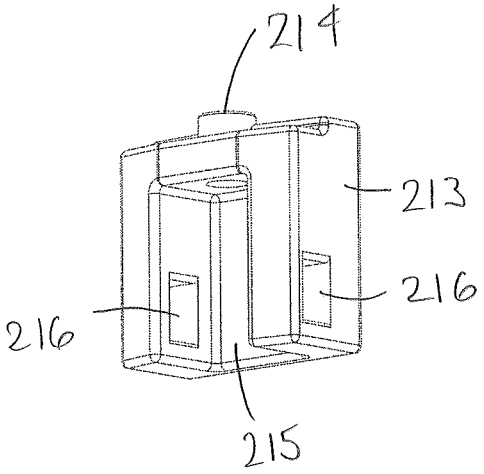
FIG. 68 is a perspective view of a pivoting support block or lock body.

As seen in FIGS. 64-66, the support block 213 includes a central chamber 215 and side passages 216 that allow the end portion of the link bar 212 to extend horizontally there through (FIG. 66) and slide freely through the passages 216 during articulation of the outer arm section 182 and linkage 181. FIGS. 62 and 63 show the displacement of the link bar 212 through the support block 213. For locking of such movement, the link bar 212 includes a row of lock teeth or other formations 217 on the bottom surface thereof.

While the link bar 212 is freely slidable through the passages 216, the position locking mechanism 184 also includes a lock body 218 that has the push button 210 formed on an upper end thereof. The lock body 218 fits into the central chamber 215 of the support block 213 (FIG. 66) and is biased upwardly by a spring 220 or other biasing member such that the push button 210 normally projects out of the outer arm section 182. The lock body 218 includes a central passage 221 which has a serrated bottom formed with lock formations or teeth 222 that mate with the serrated teeth 217 on the link bar 212. When the lock body 218 is biased upwardly as seen in FIG. 64, the teeth 222 engage the bar teeth 217 to prevent sliding of the link bar 212 through the passages 221 and 216, which thereby locks out movement or articulation of the wheel support arm 180. To unlock same and permit movement, the push button 210 can be pressed downwardly to move the lock body downwardly and disengage the teeth 222 thereof from the bar teeth 217 which then permits the link bar 212 to slide through the support block 213 as shown by FIGS. 62 and 63. This configuration of the position lock mechanism 180 provides an alternate to the lock mechanism 77, while permitting easy locking and unlocking of the wheel support arms.

Figure 70:
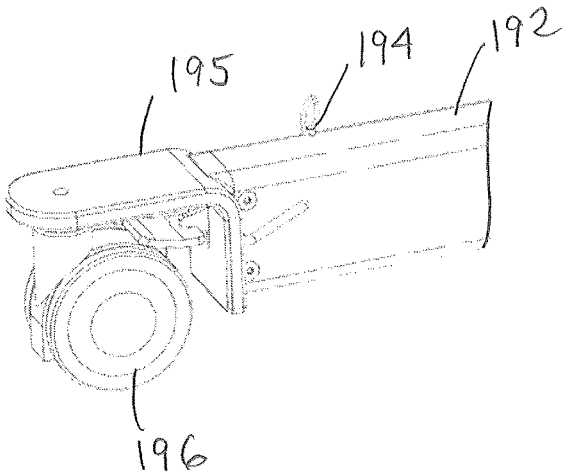
FIG. 70 is a fragmentary perspective view of the rear wheel assembly in a locked condition.
Figure 71:
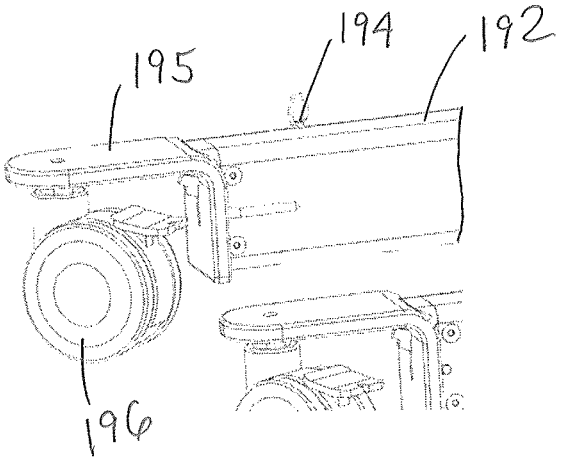
FIG. 71 is a fragmentary perspective view of the rear wheel assembly in an unlocked condition.

Next as to the alternate wheel support arm 190 (FIGS. 56 and 69), this wheel support arm 190 is also structurally and functionally similar to the support arms 20 and 21 except for the differences noted below as to the position locking mechanism 194. As described above, the arm connectors or connector blocks 193 are formed essentially the same as the arm connectors 75 and are configured for pivotable connection to the column connectors 74. Also, the wheels 196 and wheel mounts 195 are formed the same as the wheels 25 and wheel mounts 140 such that swiveling of the wheels 196 can be locked (FIG. 70) or unlocked (FIG. 71).

Figure 69:
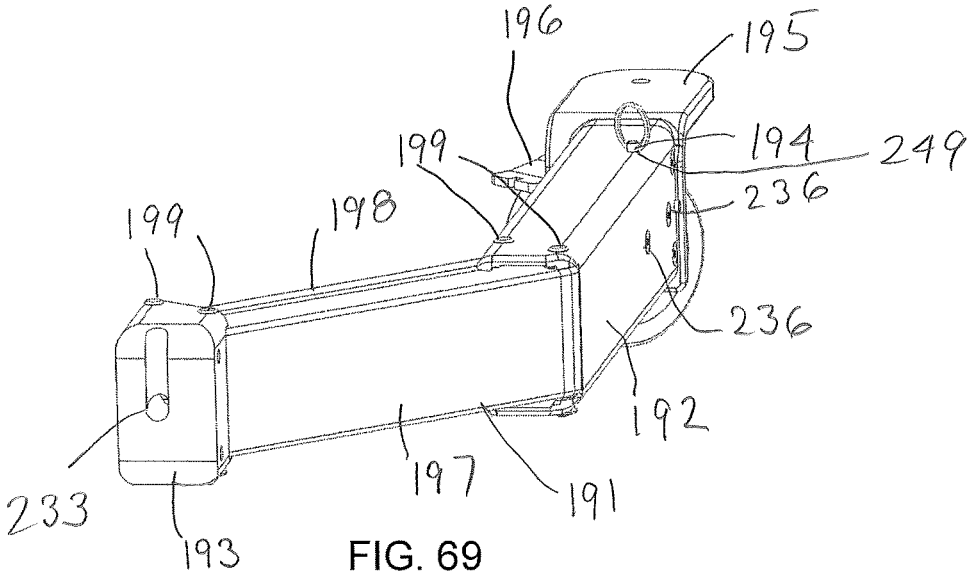
FIG. 69 is a perspective view of the support arm assembly of FIG. 56 with the second position locking mechanism.
Figure 72:
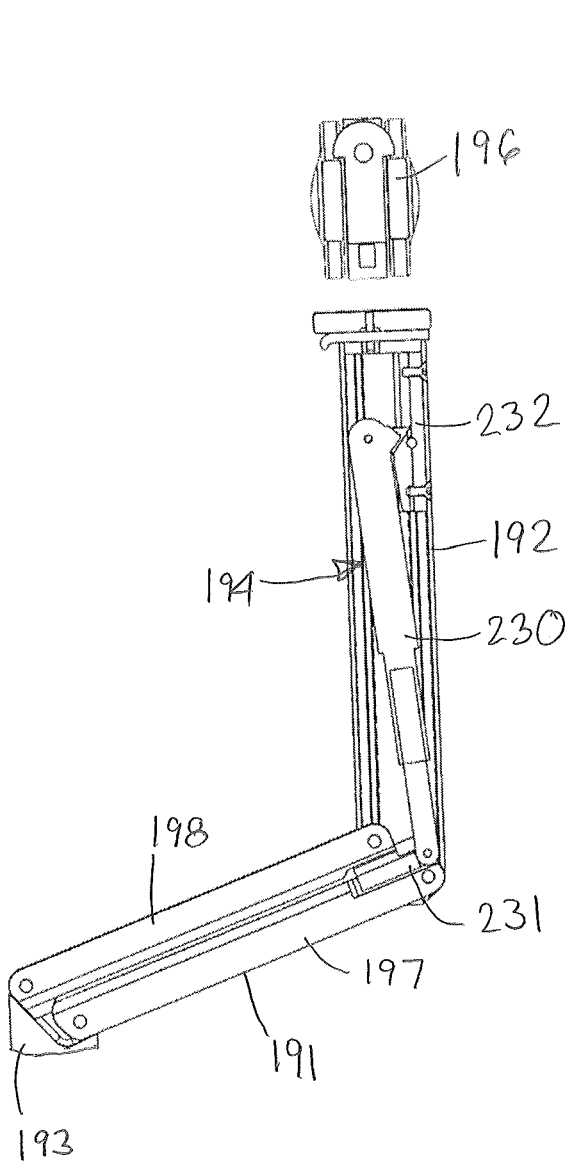
FIG. 72 is a plan view of the wheel support arm assembly showing the LH rear wheel support arm assembly with the rear wheel support arm in the wide width position and showing the second position locking mechanism.
Figure 73:
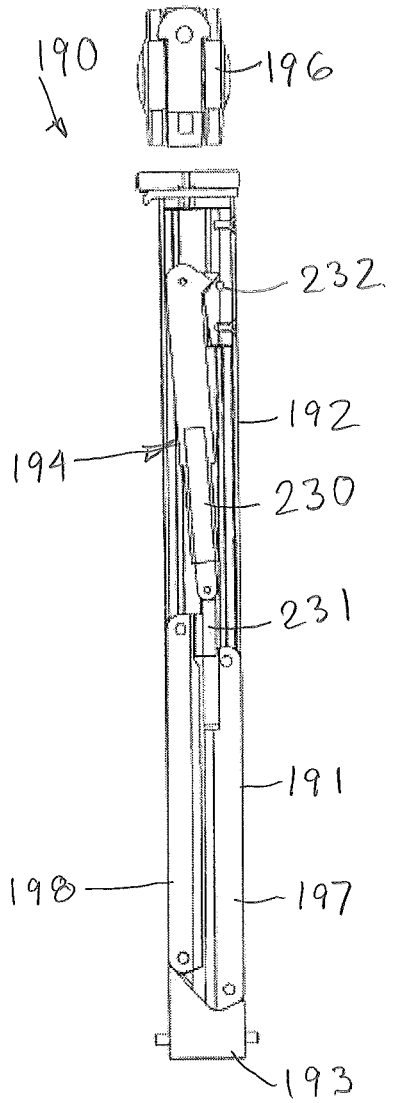
FIG. 73 is a plan view of the wheel support arm assembly showing the LH rear wheel support arm assembly with the rear wheel support arm in the straightened, narrow width position and showing the second position locking mechanism.

Next as to FIGS. 72 and 73, the position locking mechanism 194 is shown in greater detail inside the outer arm section 192. This position locking mechanism 194 preferably comprises an electric motor driven linear actuator 230 which can be electrically powered to extend or retract the length thereof. The inner end of the actuator 230 is pivotally attached to a clevis block 231 that is rigidly affixed to the inner linkage arm 198 so that the orientation of the clevis block 231 changes with the movement of the linkage arm 198. The opposite end of the actuator 230 is also attached to another clevis block 232 that is affixed to the wall of the outer arm section 192. When fully assembled, the outer clevis block 232 is stationarily affixed to the outer arm section 192. As such, extension of the actuator 230 causes rotation of the inner clevis block 231 to thereby cause movement of the four-bar linkage 191 and move the wheel support arm 190 between the two orientations of FIGS. 72 and 73. As seen in FIG. 69, the linkage 191 may include a cable passage 233 that allows routing of power wires from the actuator 230 to the transporter 10 and the control module 216 thereof.

Figure 74:
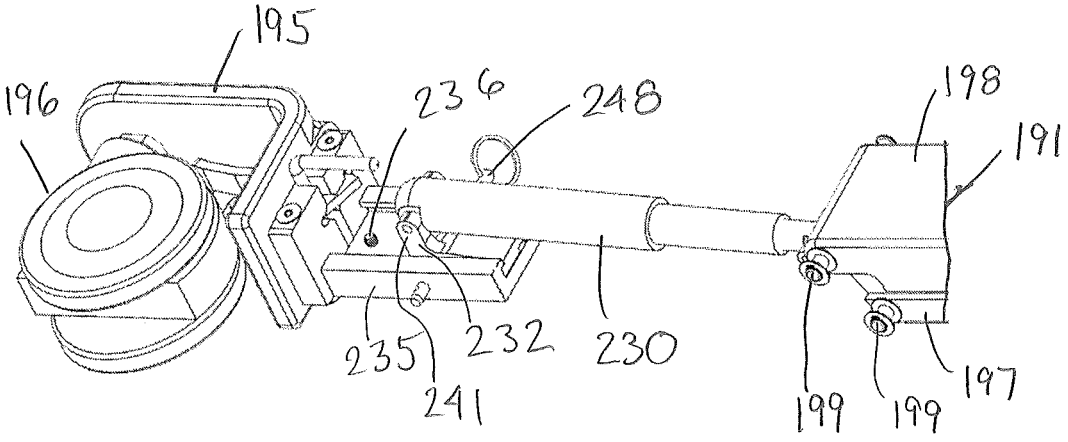
FIG. 74 shows the second position locking mechanism when assembled.
Figure 75:
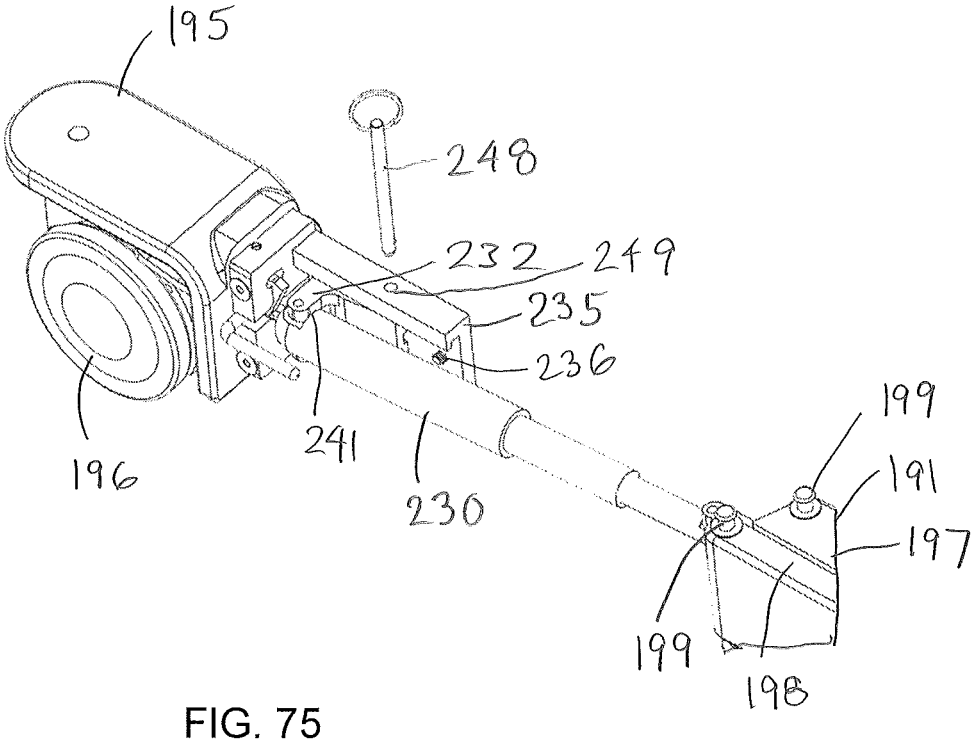
FIG. 75 shows the second position locking mechanism with an anchor pin removed.
Figure 76:
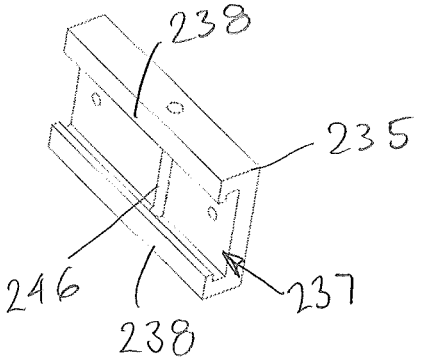
FIG. 76 is a perspective view of a connector block.
Figure 77:
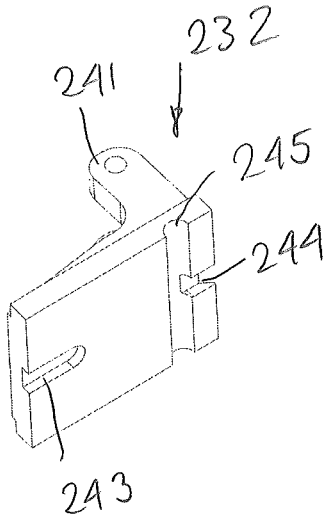
FIG. 77 is a rear perspective view of a clevis block.
Figure 78:
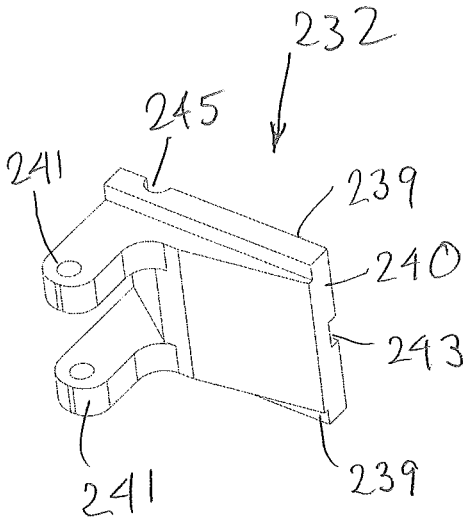
FIG. 78 is a front perspective view of the clevis block.

Referring to FIGS. 74-78, the outer clevis block 232 is formed as an assembly with a mounting block 235 that is fastened to the outer arm section 192 by inner and outer fasteners 236 (FIG. 69). When assembled, the ends of the fasteners 236 may project through the mounting block 235 as seen in FIGS. 74 and 75. The mounting block 235 also includes a channel 237 defined by undercut side walls 238, which channel 237 receives the outer clevis block 232 therein.

The clevis block 232 includes side edges 239 defined by a main body 240, wherein the side edges 239 are slidably carried within the block channel 237 by the undercut side walls 238. The exposed side of the main body 240 includes projecting mounting flanges 241 that pivotally connect to the outer end of the actuator 230.

A covered face of the main body 240 includes two open-ended recesses 243 and 244 that receive the ends of the fasteners 236 to thereby prevent the clevis block 232 from sliding out of the channel 237 formed in the mounting block 235. During assembly, some sliding of the clevis block 232 is permitted. However, the face of the main body 240 also includes a vertical groove 245 that conforms to a complementary groove 246 formed in the mounting block 235 to form a bore for receiving a lock pin 248 therein. The bore extends vertically upwardly and downwardly through the outer arm section 192 to form a continuous vertical passage 249 that can be accessed from an exterior of the outer arm section 192 and permit insertion of the pin 248 therein. When the pin 248 is fitted into the passage 249 and the bore 248, the pin 248 prevents axial movement of the clevis block 232 relative to the mounting block 234.

When the lock pin 248 is installed, the wheel support arm 190 cannot articulate unless the actuator 230 is extended or retracted under control power. If power fails or manual adjustment is required, the lock pin 248 can be pulled to permit manual articulation of the support arm 190. As a result, the support arm 190 and its powered position locking mechanism 194 provides an option for controlled articulation of the support arm 190 between the wider and narrower positions of FIGS. 72 and 73 respectively.

Figure 79:
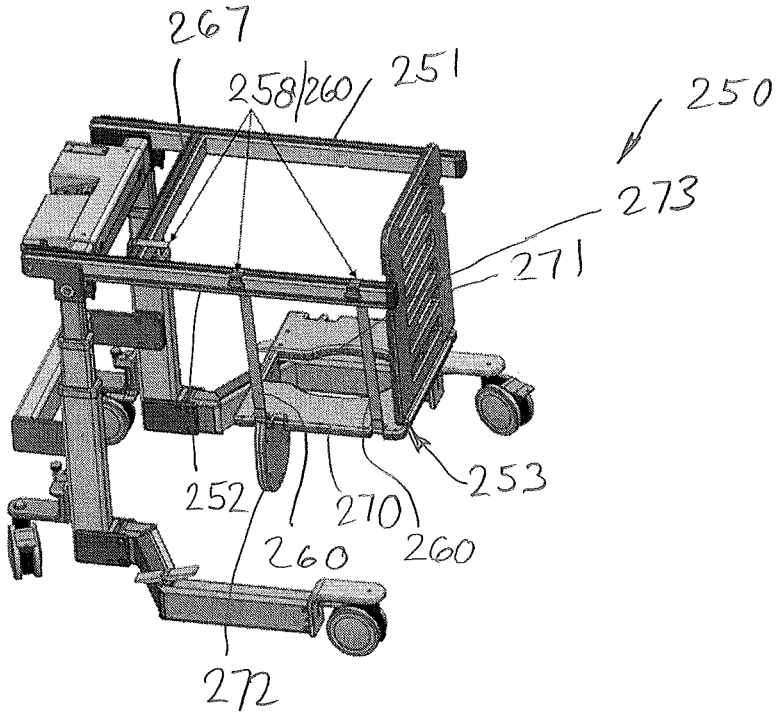
FIG. 79 is a perspective view of an alternate lift-transfer device with an alternate slotted support arms and seat assembly.
Figure 80:
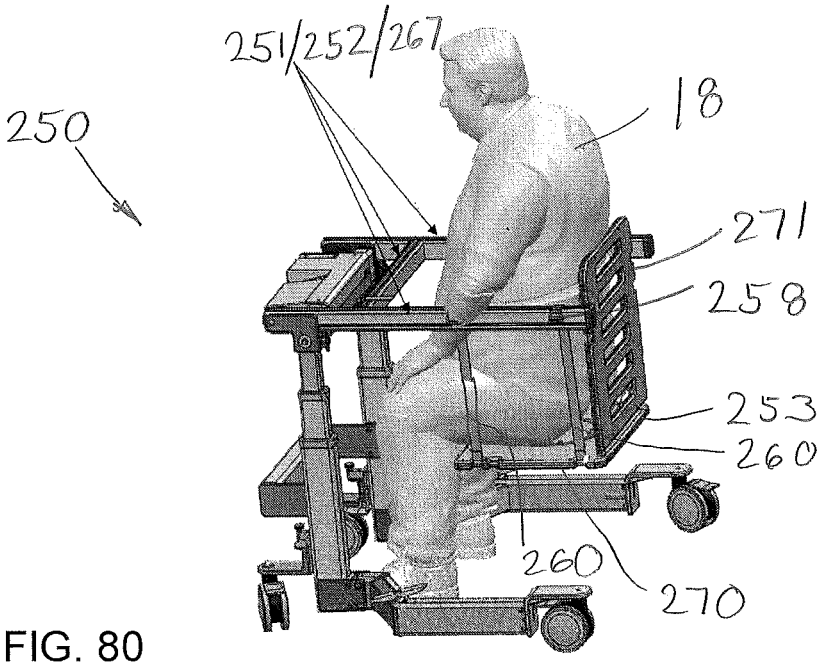
FIG. 80 is a perspective view of the alternate lift-transfer device with an alternate slotted support arms and seat assembly supporting a patient.
Figure 81:
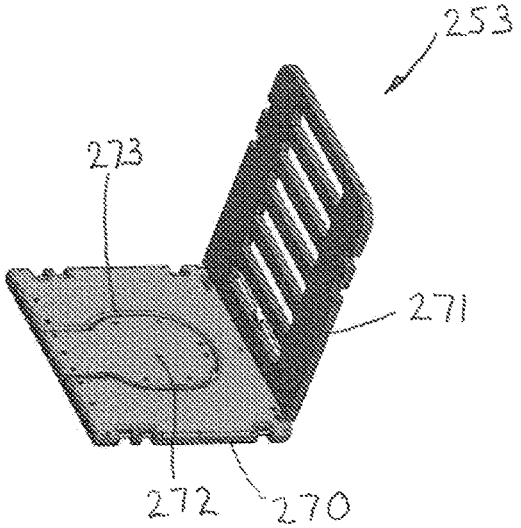
FIG. 81 is a perspective view of a seat for the alternate lift-transfer device of FIG. 79.
Figure 82:
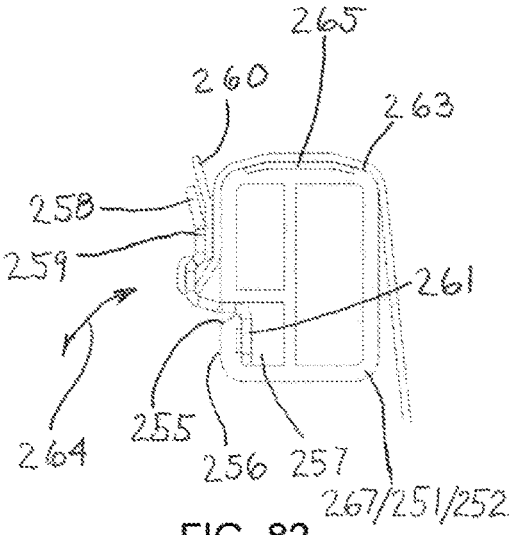
FIG. 82 is an end cross sectional view of the slotted support arm and adjustable support clips.
Figure 83:
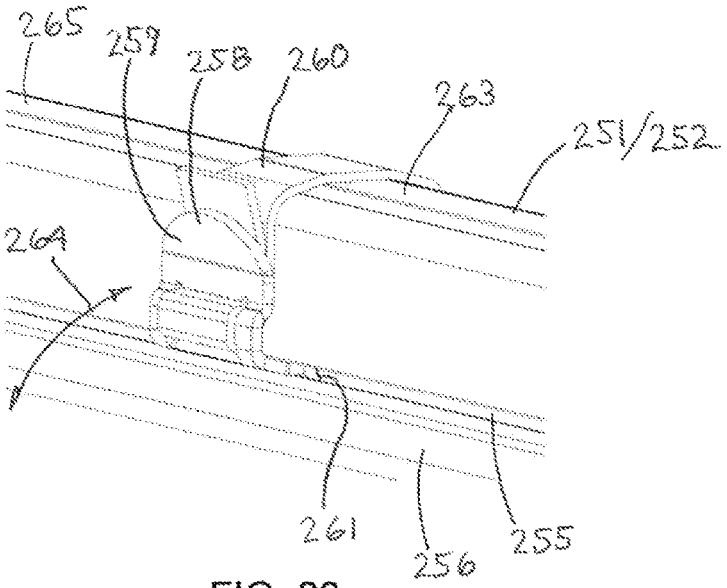
FIG. 83 is a perspective view of the slotted support arm and adjustable attachment clips.

Next, FIG. 79 shows an alternate lift-transfer device 250 with an alternate slotted support arms 251 and 252 and seat assembly 253. First as to the support arms 251 and 252, these support arms 251 and 252 have an extruded profile shown in FIG. 82 that defines an open slot 255 defined by an upstanding slot wall 256 and an interior groove 257. The slot 255 is defined along the outside face of the profile and is configured to receive a clip 258 therein. The clip 258 has a slotted main body 259 that receives the free end of a support strap 260 therein and allows the length of the strap 260 to be adjusted by sliding through the slots thereof. The main body 259 is then bent on the bottom end portion to define a stepped hook 261 that fits sidewardly into the slot 255. As the hook 261 is slid into the slot 255, the clip 258 then is pivoted upwardly about the top edge of the slot wall 256 so that the hook 261 abuts against the slot wall 256 on the interior groove 257 to securely anchor and essentially lock the clip 258 while still permitting sliding of the clip 258 along the length of the slot 255. As seen in FIGS. 82 and 83, the strap 260 runs over the top arm surface 263 to tension the clip 258 and hold it in the upright locked position shown in FIG. 83. As noted by reference arrow 264, tension on the strap 260 may be released, which then allows the clip 258 to be pivoted downwardly and unlocked from the slot 255. If desired, the top arm surface 263 may include a cushion or pad 265 to provide a softer surface for resting the arms of the occupant 18 and helping reduce wear on the straps 260.

Also, the cross tube 267 may be provided laterally between the support arms 251 and 252. The cross tube 267 also has the same profile (FIG. 82) preferably formed by extruded metal, and therefore, the cross tube 267 also serves as another anchoring structure or rail.

The seat support assembly 253 includes a seat portion 270 and a backrest portion 271 which are pivotally connected together. The seat support assembly 253 is preferably connected to the seat support arms 251 and 252 by elongate flexible and adjustable straps 260 that are provided as a set of four straps.

The seat portion 270 may optionally be formed as a toilet seat configuration with a trap door 272 pivotally enclosing an opening 273.

Figure 84:
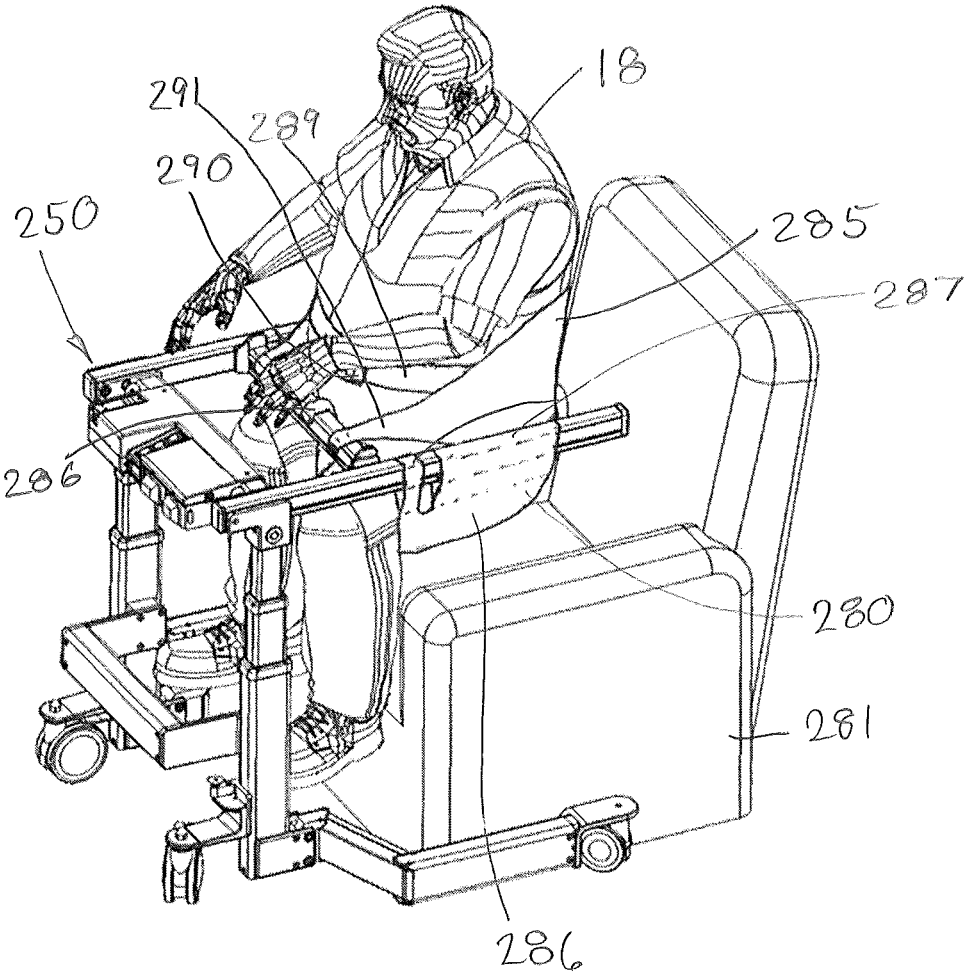
FIG. 84 is a perspective view of the lift-transfer device with another alternate seat assembly formed as a sling.

FIG. 84 illustrates the lift-transfer device or transporter 250 with another alternate seat assembly formed as a sling 280. The sling 280 comfortably suspends the occupant 18 from the transporter 250, such as for use in moving the occupant 18 to or from a chair 281. In this configuration, the wheel support arms 20 and 21 are displaced to the wide position to allow the chair 281 to nest therebetween (FIG. 84).

Generally, the sling 280 can be positioned under the occupant 18 when seated on the chair 281 so as to loosely wrap about the occupant 18. The transporter 250 is positioned next to the chair 281, and then the sling 280 can be installed on the support arms 251 and 252, wherein raising of the transporter 250 lifts the occupant as seen in FIGS. 84 and 88.

As seen in FIG. 86, the sling 280 can be made from a flexible suspension fabric which is shaped to define a back section 285, and two separated leg sections 286 that extend under and separately support the legs of the occupant 18 while define a sling opening between the separated leg sections 286. Each of the leg sections 286 includes connector structure preferably formed as hem-like loops 287 that can slide over the ends of the support arms 251 and 252 to carry the occupant's weight as seen in FIGS. 84 and 88. The leg sections 286 also extend forwardly and terminate in straps 288 that terminate in clips 258 (FIG. 87) wherein the clips 258 and straps 288 join to the cross member 267 to also carry weight. The straps 288 are adjustable in the clips 258 as described above relative to straps 260. The leg sections 286 also may include a stiffener or support insert 286A.

The back section 285 includes safety belt sections 289 that terminate in buckles 290 so as to wrap about the waist of the occupant 18 and secure them into the sling 280. Still further, the back section 286 also transitions sidewardly into flexible straps 291 that join to clips 258 to allow the length of the straps 291 to be adjustable. These back straps 291 and clips 258 also join to the cross rail 267 to help maintain the occupant upright in the seated position of FIGS. 84 and 88. The back section 285 also may include a stiffener or support insert 285A. With this design, the sling 280 can be placed on the occupant 18 without lifting of the patient's body from the chair seat wherein the configuration of the sling 280 is readily adjustable by adjusting the strap length in the clips 258.

Figure 89:
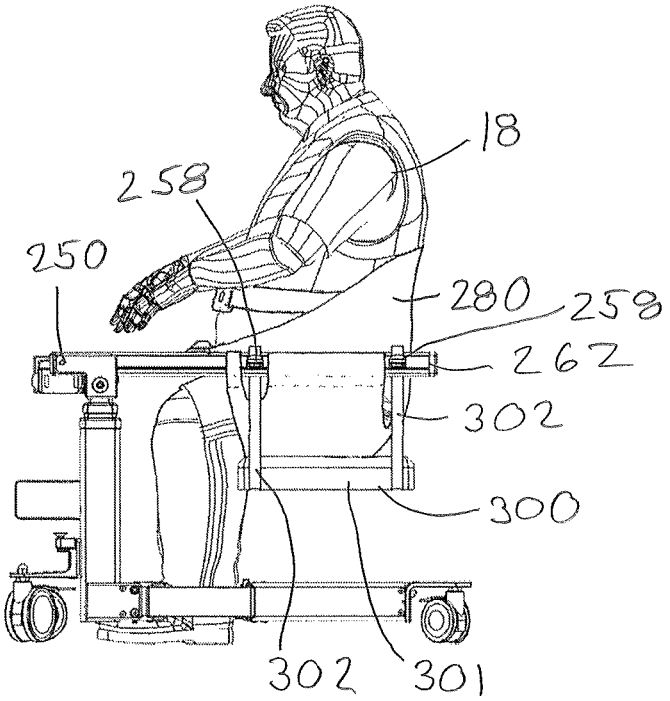
FIG. 89 is a side view of the lift-transfer device with still another alternate seat assembly with a cushioned seat plate provided in combination with the seat sling.

Referring to FIG. 89, the occupant 18 may be supported by the sling 280, which is provided in combination with an alternate seat unit 300. The seat unit 300 does not require a back rest, and instead comprises a cushioned seat plate 301 that is suspended from the support arms 261 and 262 by support straps 302 by clips 258 of the type described above. As such, the straps 302 and clips 258 are independently adjustable relative to the sling 280. With this configuration, the patient 18 can be first placed into the sling 280, such as when sitting, and then after removal from the chair 281, the seat unit 300 can be independently connected to the transporter 250. Thereafter, the length of the seat straps 302 can be independently adjusted in length to pull the seat plate 301 snug up against the patient 18 and remove load from the sling 280, so that the seat plate 301 thereby provides the primary support to the patient 18 instead of the sling 280. Since the seat plate 301 preferably is cushioned, the seat plate 301 ultimately can provide greater comfort to the patient 18 than the sling 280. The sling 280 is very useful in first removing the patient from the chair 18.

Figure 90:
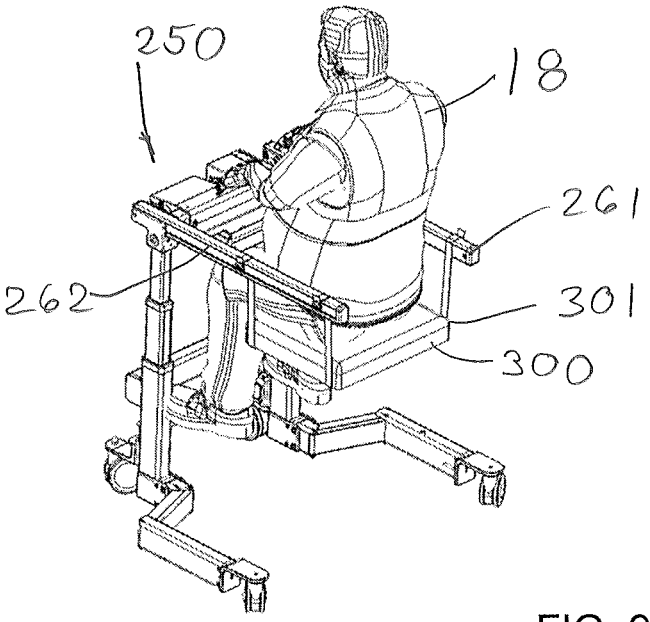
FIG. 90 is a rear perspective view of the lift-transfer device with the cushioned seat plate provided without the seat sling and the wheel support assemblies positioned in the wide width position.

As seen in FIG. 90, the seat unit 300 may be used separate from the sling 280, or the sling 280 may be removed once the occupant 18 is supported within the transporter 250.

Figure 91:
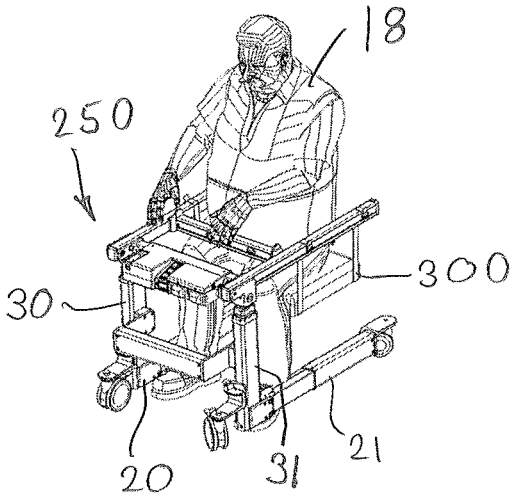
FIG. 91 is a perspective view of the lift-transfer device with the cushioned seat plate, the wheel support assemblies positioned in the narrow width position, and the lift columns in the lowered position.
Figure 92:
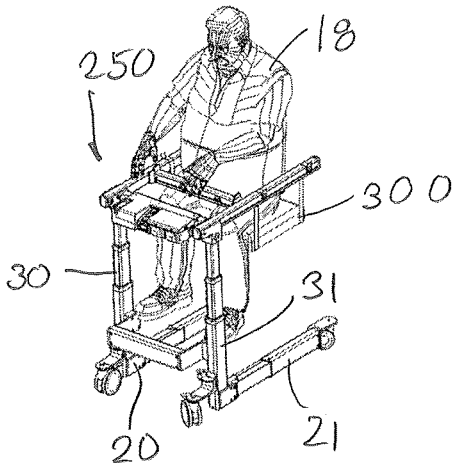
FIG. 92 is a perspective view of the lift-transfer device with the cushioned seat plate, the wheel support assemblies positioned in the narrow width position, and the lift columns in the raised position.
Figure 93:
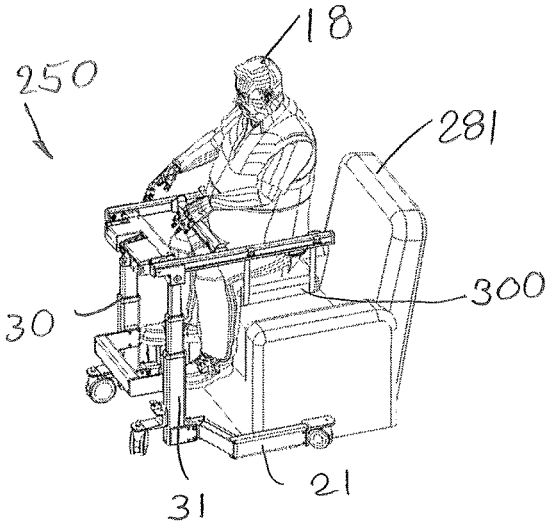
FIG. 93 is a perspective view of the lift-transfer device with the cushioned seat plate, the wheel support assemblies positioned in the wide width position so that a chair is nested therebetween, and the lift columns in the raised position.
Figure 94:
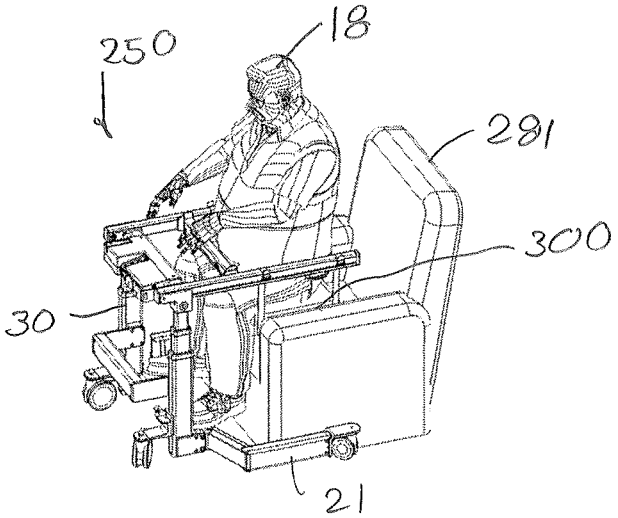
FIG. 94 is a perspective view of the lift-transfer device with the cushioned seat plate, the wheel support assemblies positioned in the wide width position and having a chair nested therebetween, and the lift columns in the lowered position to position the patient on the chair.

Referring to FIGS. 91-94, the seat unit 300 is usable to perform all functions of the transporter 250. FIG. 91 shows the transporter 250 with the cushioned seat plate 300, the wheel support assemblies 20 and 21 positioned in the narrow width position, and the lift columns 30 and 31 in the lowered position. FIG. 92 shows the transporter 250 with the cushioned seat plate 300, the wheel support assemblies 20/21 positioned in the narrow width position, and the lift columns 30/31 in the raised position. FIG. 93 shows the transporter 250 with the cushioned seat plate 300, the wheel support assemblies 20/21 positioned in the wide width position so that a chair 281 is nested therebetween, and the lift columns 30/31 in the raised position. FIG. 94 shows the transporter 250 with the cushioned seat plate 300, the wheel support assemblies 20/21 positioned in the wide width position and having a chair 281 nested therebetween, and the lift columns 30/31 in the lowered position to position the patient 18 on the chair 281.

Figure 95:
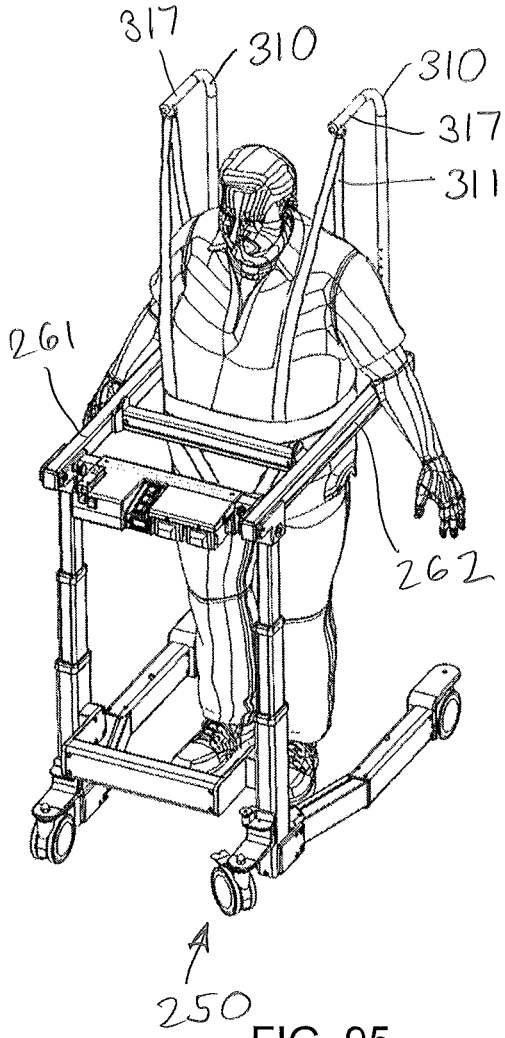
FIG. 95 is a perspective view of the lift-transfer device provided with suspension posts carrying a support sling in a forward facing position.
Figure 97:
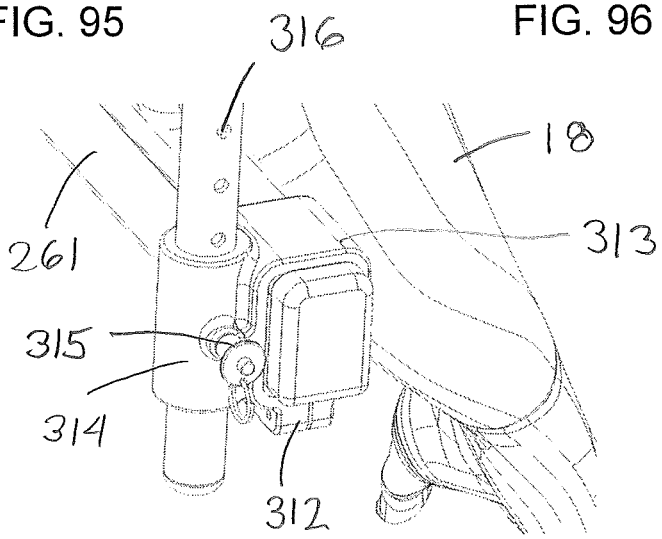
FIG. 97 is a fragmentary perspective view of the lift-transfer device provided with support brackets for the suspension posts.

With the inventive system, the patient 18 also may be supported on the transporter 250 in an upright position as seen in FIG. 95. An optional suspension post 310 can be provided on each of the support arms 261 and 262 that is configured to carry a support sling 311 in a forward facing position. FIG. 97 shows a support bracket 312 for the suspension posts 310. The support bracket 312 includes a support ring 313 that slides onto the end of the respective support arm 261 or 262 and preferably is locked in place. The support ring 313 also includes a vertical socket 314 having a locking pin 315 that fits into a corresponding aperture 316 in the suspension post 310.

Figure 96:
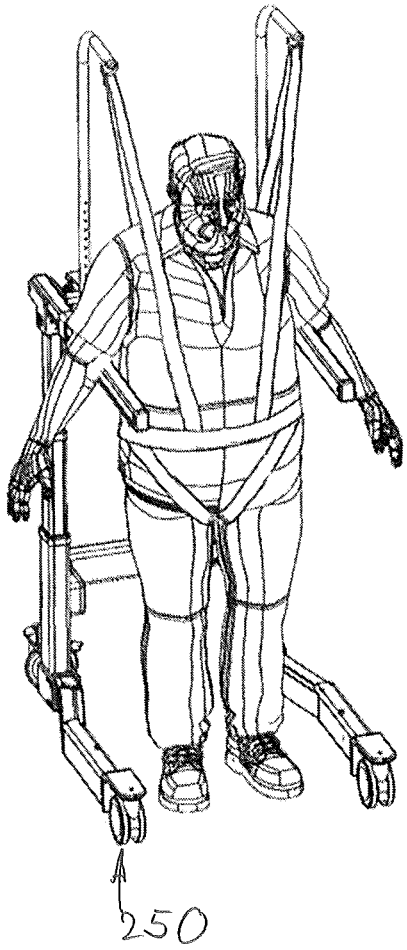
FIG. 96 is a perspective view of the lift-transfer device provided with the suspension posts carrying a support sling in a rearward facing position.

The suspension post 310 is vertically elongate and has a row of apertures 316 so that the post 310 can slide into the socket 314 and be locked in place. The post 310 includes a suspension arm 317 that projects horizontally and supports the sling 311 therefrom. The sling 311 hangs downwardly and supports the patient 18 as seen in FIG. 95. In this manner, the sling 311 is vertically adjustable and can suspend the patient 18 in a forward facing position. FIG. 96 shows the posts 310 reversed so that the suspension arms 317 project rearwardly with the patient 18 in a rearward facing position.

Figure 98:
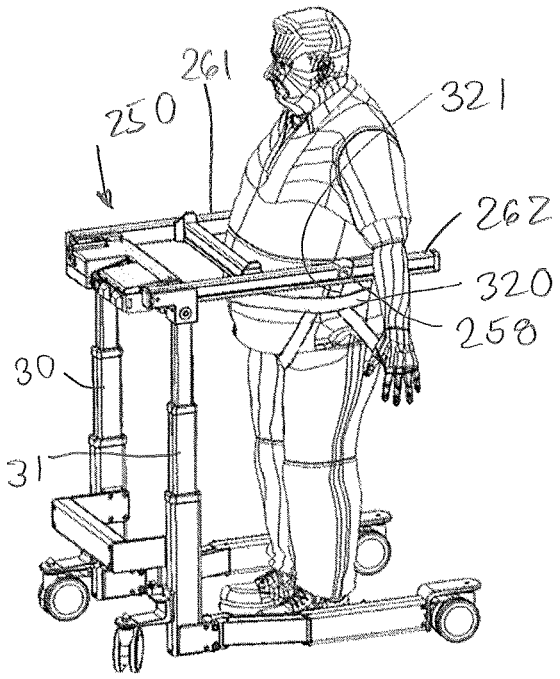
FIG. 98 is a perspective view of the lift-transfer device provided with an alternate support sling supported by the support arms as viewed from the side.
Figure 99:
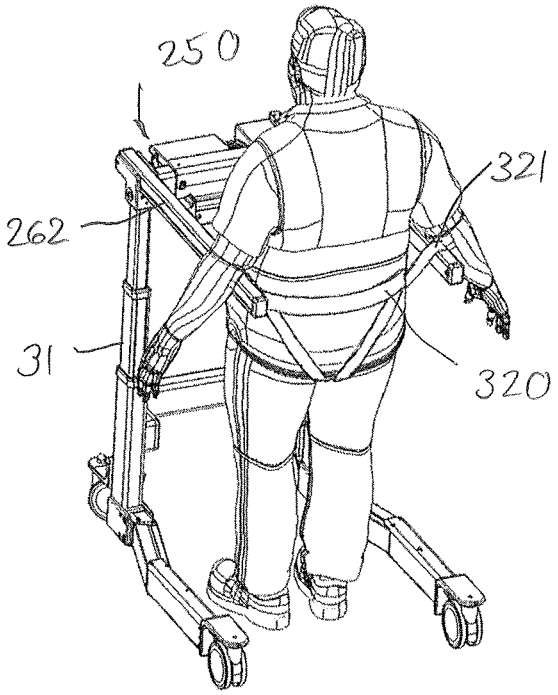
FIG. 99 is a perspective view of the lift-transfer device provided with an alternate support sling supported by the support arms as viewed from the rear.

FIGS. 98 and 99 show an alternate support sling 320 supported by the support arms 261 and 262. The sling 320 includes straps 321 with clips 258. When the lift columns 30 and 31 are raised, the patient 18 is held upright as shown in these figures.

Figure 100:
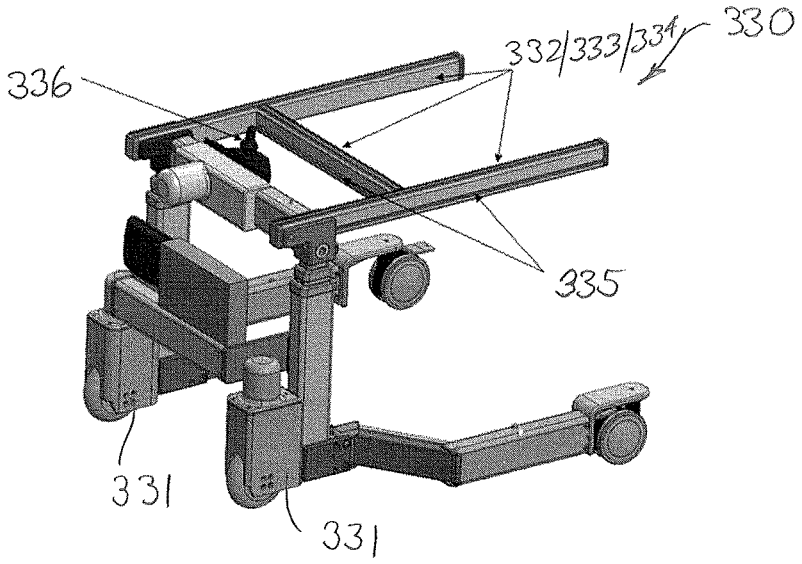
FIG. 100 is a perspective view of an alternate lift-transfer device having powered drive wheels.

While the above-described embodiments of the invention are disclosed without a power drive, FIG. 100 shows an alternate lift-transfer device 330 having powered drive wheels 331. This transporter 330 has the same structure and function including the slotted support rails 332, 333 and 334 with attachment slots 335. With the power driven wheels 331, the transporter 330 can be driven by a joystick controller 336 that is accessible by the occupant.

Figure 101:
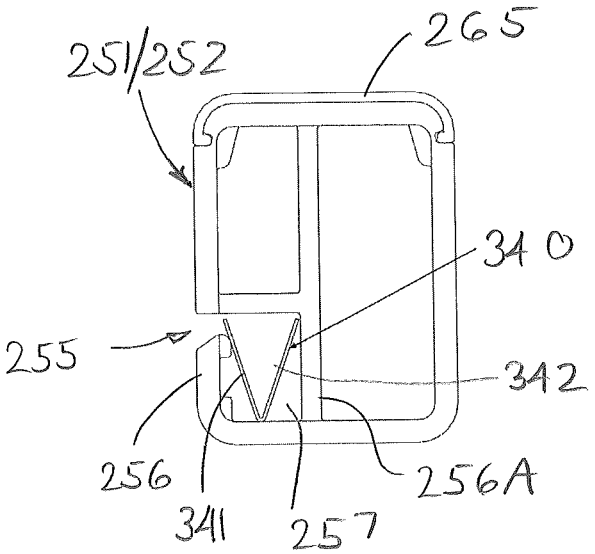
FIG. 101 is an end cross sectional view of the slotted support arm, which is improved to include a biasing member provided therein.
Figure 102:
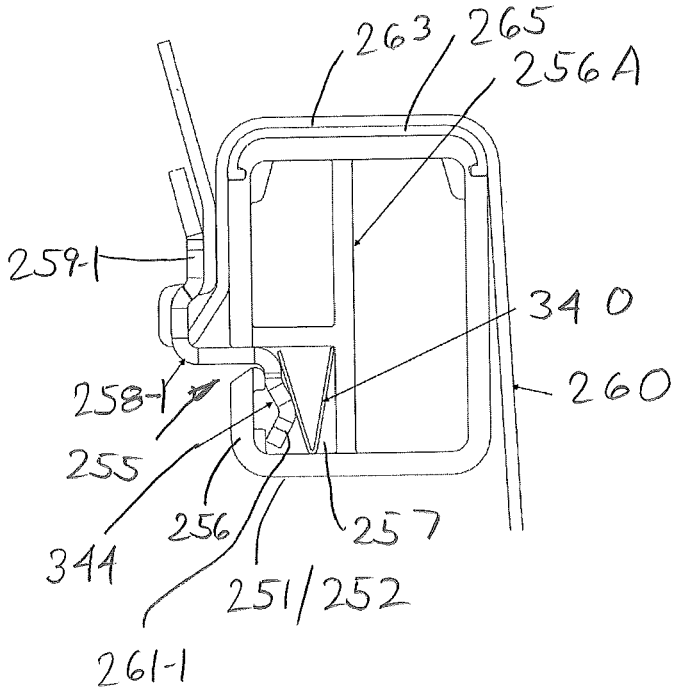
FIG. 102 is a perspective view of the slotted support arm and including adjustable attachment clips.

Next as to FIGS. 101 and 102, the support arms 251 and 252 have the extruded profile previously described relative to FIG. 82 which defines an open slot 255 defined by an upstanding slot wall 256 and an interior groove 257. The interior groove 257 is further improved so as to include a biasing member 340, which preferably is formed as a resilient, elongate spring strip that preferably has a V-shape. The biasing member 340 includes first and second legs 341 and 342, which are compressed in the groove 257 and press outwardly against the outer slot wall 256 and an inner slot wall 256A as seen in FIG. 101.

Referring to FIG. 102, the slot 255 is defined along the outside face of the profile and is configured to receive the improved clip 258-1 therein. The clip 258-1 basically functions the same as clip 258 described above, and common reference numerals are used to describe common component parts. The clip 258-1 has a slotted main body 259 that receives the free end of a support strap 260 therein and allows the length of the strap 260 to be adjusted by sliding through the slots thereof. The main body 259-1 is then bent on the bottom end portion to define a stepped hook 261-1 that fits sidewardly into the slot 255. The improved hook 261-1 cooperates against the outer leg 341 of the biasing member 340 and is bent so as to include a bent end portion 344 that is bent relative to clip 258 to impede reversed insertion of the hook 261-1 into the slot 255.

As the hook 261-1 is slid into the slot 255, the clip 258-1 compresses the biasing member 340 to fit between the outer leg 341 and the slot wall 256. The clip 258-1 then is pivoted upwardly about the top edge of the slot wall 256 so that the hook 261-1 abuts against the slot wall 256 on the interior groove 257 to securely anchor and essentially lock the clip 258-1 while still permitting sliding of the clip 258-1 along the length of the slot 255. As seen in FIGS. 101 and 102, the strap 260 runs over the top arm surface 263 to tension the clip 258-1 and hold it in the upright locked position shown in FIG. 102. As noted above relative to FIGS. 82 and 83, tension on the strap 260 may be released, which then allows the clip 258-1 to be pivoted downwardly and unlocked from the slot 255. If desired, the top arm surface 263 may include a cushion or pad 265 to provide a softer surface for resting the arms of the occupant 18 and helping reduce wear on the straps 260.

In this embodiment, the biasing member 340 facilitates the final rotation of the clip 258-1 upwardly by tending to bias the clip 258-1 in a clockwise rotation relative to FIG. 102, and then applies pressure against the clip 258-1 to thereby hold the clip 258-1 in the vertical orientation even when the webbing 260 might be loose or not under tension from the patient 18 or other loads.

Figure 103:
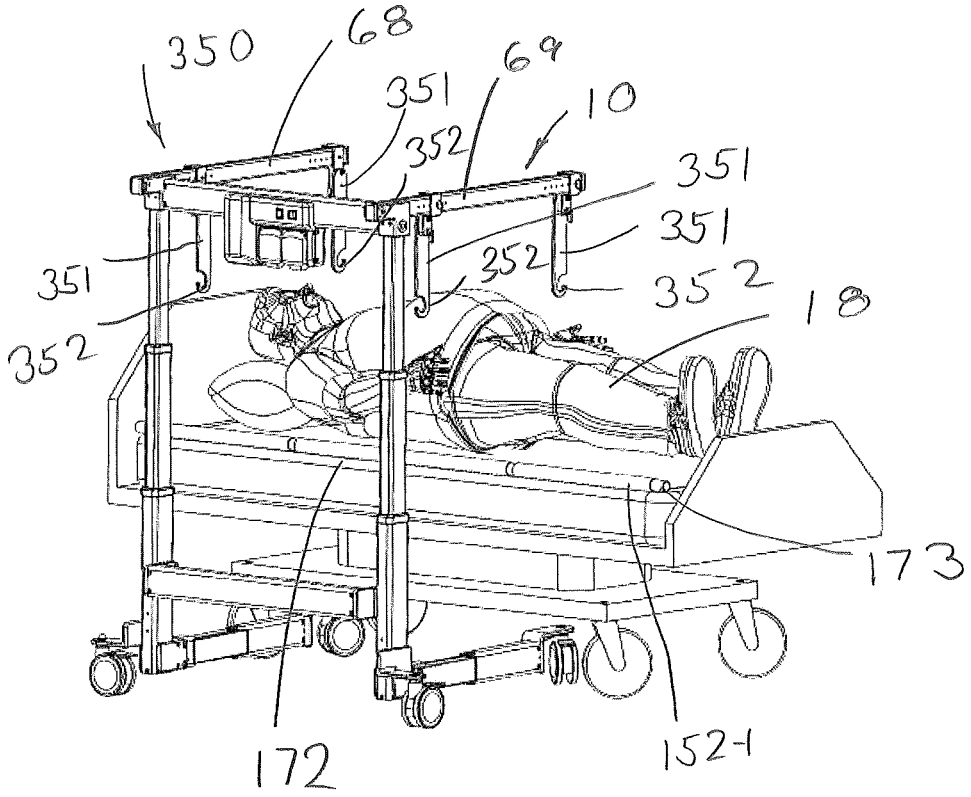
FIG. 103 is a perspective view of a further embodiment of a patient transporter adjacent to a patient on a bed.
Figure 104:
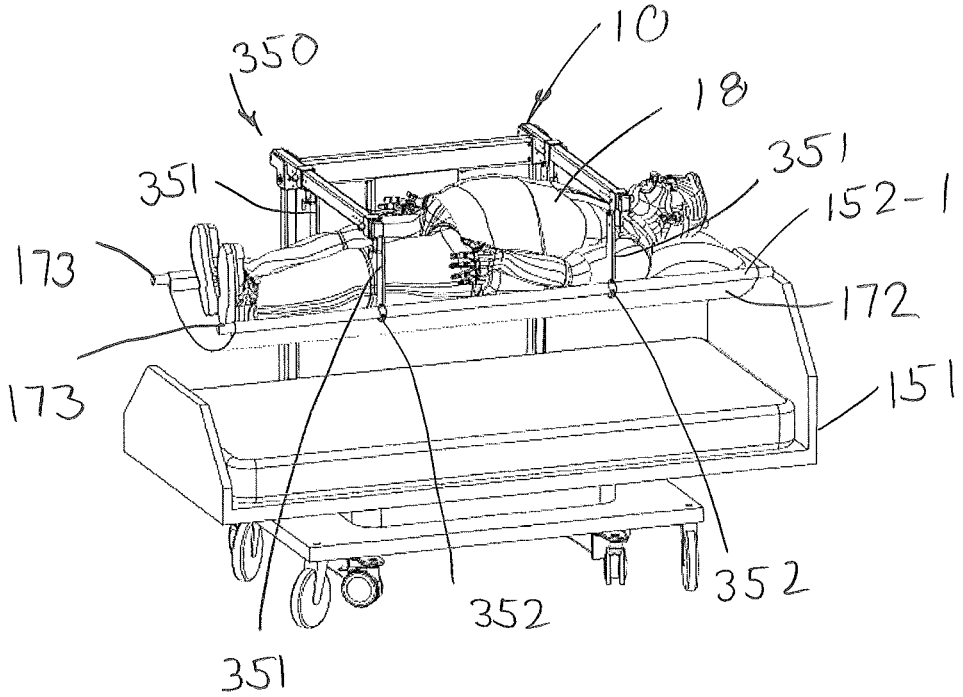
FIG. 104 is a perspective view of the patient transporter from another side showing the patient in a lifted position.

Referring to FIGS. 103 and 104, an improved transporter 350 is illustrated, which functions as a modified embodiment of the transporter 150 disclosed above in FIGS. 38, 39, 40A and 40B. This transporter 350 makes use of the lift-transfer device 10, which is configured as a gurney for lifting and transferring a person to and from a bed 151 in a supine position. The gurney transport lift 350 uses the transporter 10 wherein the total lateral width of the gurney transporter 350 is maintained the same so as to be shorter than the bed 151, but is configured to support the full-length body support unit preferably formed as a stretcher unit 152-1. The stretcher unit 152-1 is formed substantially the same as the stretcher unit 152 except for modifications made to engage with the transporter 350.

Generally, the transporter 350 comprises the lift-transfer device 10 which is configured to include support brackets or units 351 which are each adapted to engage the support arms 68 and 69. As seen in FIG. 103, a pair of the support brackets 351 are mounted on each of the support arms 68 and 69 by sliding the support brackets 351 onto the outer free ends of the support arms 68 and 69. The support brackets 351 hang or project downwardly and have lower ends 352 that connect to and support the stretcher poles 173 in order to suspend the stretcher body 172 therefrom. In this manner, the total width of the transporter 350 is less than the length of the bed and possibly less than the length of the patient 18. In other words, the length of the transporter 350 is essentially defined by the length of the stretcher poles 173. This narrow transporter 350 may be configured from the basic lift-transfer device 10 that is modified by mounting of the support brackets 351 to the support arms 68 and 69. Further, the transporter 350 still has a dimension measured front to back across the stretcher unit 152 that is narrow enough to pass through a doorway or passageway. In use, the transporter 350 may be operated and used in a manner as already described above, such as the above disclosure relating to the lift-transfer device 10 and transporter 150.

Figure 105A:
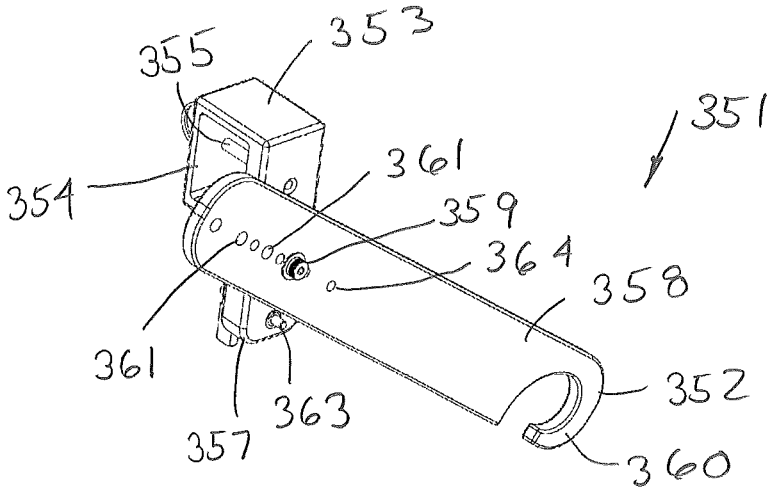
FIG. 105A is a front perspective view of a support bracket.
Figure 105B:
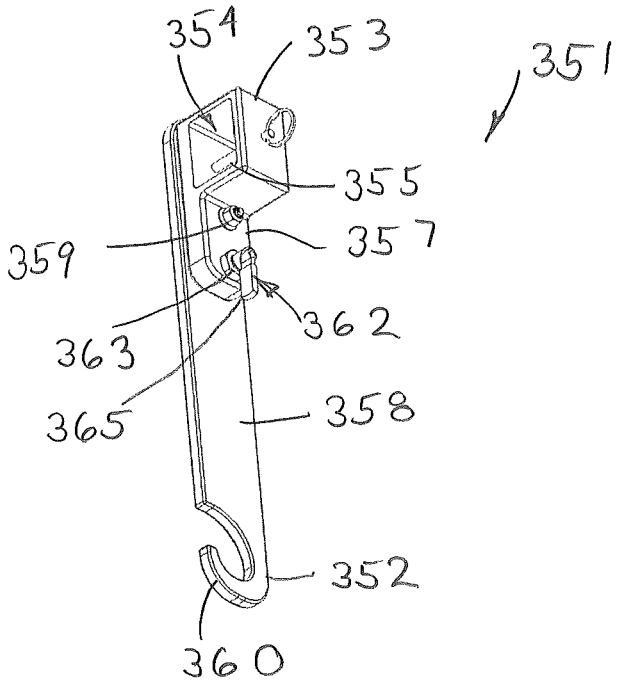
FIG. 105B is a rear perspective view of the support bracket.

FIGS. 105A and 105B illustrate the support brackets 351 in greater detail. Each support bracket 351 includes an arm mount 353 at the upper end thereof, which has a generally rectangular passage 354 that slides onto the support arms 68 and 69. A lock 355 formed as a removable locking pin is provided which is removable during sliding of the support arms 68 or 69 through the passage 354. When suitably positioned, the pin of the lock 355 is slid through bores in the arm mount 353 and an aligned bore in the support arm 68/69.

The support bracket 351 also includes a main body 357 that projects downwardly and supports a pivotable arm 358 that is connected thereto by a pivot pin 359. The lower end 352 of the arm 358 includes a connector 360 that preferably is formed as a hook, which is configured to latch onto the stretcher poles 173. Preferably, the arm 358 is rigid to minimize swinging of the patient 18 and stretcher unit 152 when supported on the support bracket 351. Hence, swinging of the stretcher unit 152 is particularly restrained in the direction aligned head-to-toe of the patient 18. To vary the overall vertical length of the support bracket 350, the arm 358 includes a row of pivot holes or bores 361 that receive the pivot pin 359 in a selected one of the holes 361 to vary the length of the support bracket 350.

The main body 357 also includes a releasable latch unit 362 that connects to the arm 358 to latch the arm 358 in the vertical orientation after engagement with the stretcher poles 173. The latch unit 362 comprises a retractable latch pin 363 that is oriented to engage with a latch bore 364 in the arm 358. The latch unit 362 also includes a manual actuator 365 that is rotated to displace the latch pin 363 by a suitable cam cooperating between the actuator 365 and latch pin 363. The arm 358 can then be released so it can be swung to the side of the stretcher poles 173 so that the stretcher poles 173 are disengaged from the transporter 350. Next the arm 358 can be swung to engage the connector 360 with the stretcher poles 173 and then the latch unit 362 engaged to secure the latch poles 173 to the transporter 350 for transport of the patient 18 to and from the bed 151. On the longer transporter 150, the primary purpose of the cradles or supports 170 mounted securely to the support arms 166 and 167 is to keep the stretcher poles 173 from coming together as the patient 18 is loaded on the flexible fabric 172. On the shorter transporter 350 where the stretcher unit 152 is suspended, one advantageous purpose of the rigid vertical supports 351 and the support pivot latch unit 362 is to prevent the stretcher poles 173 from coming together under the load of the patient on the flexible stretcher fabric 172. Also, these rigid supports 351 minimize swinging of the patient in any direction while being transported.

Figure 106A:
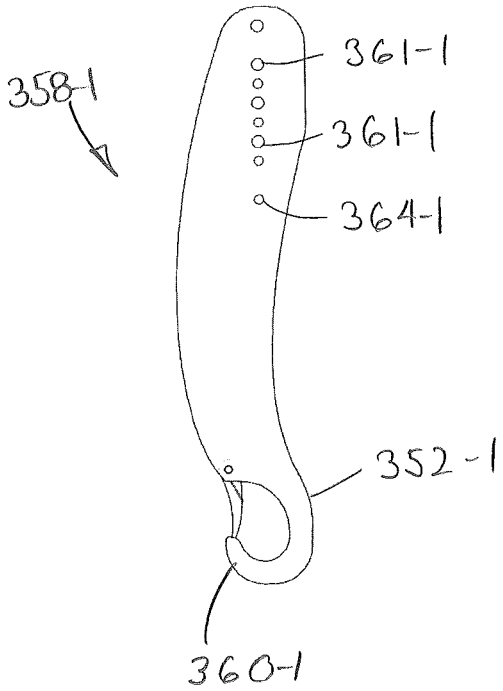
FIG. 106A is a front view showing an alternate support bracket.
Figure 106B:
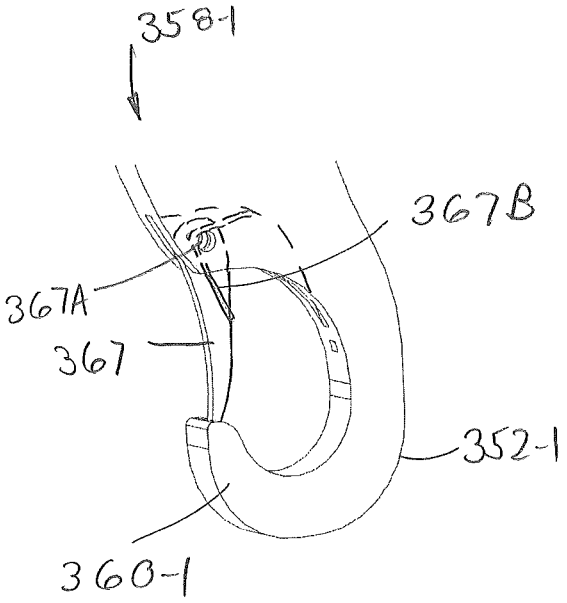
FIG. 106B is a partial enlarged perspective view of the hook end of the support bracket.
Figure 106C:
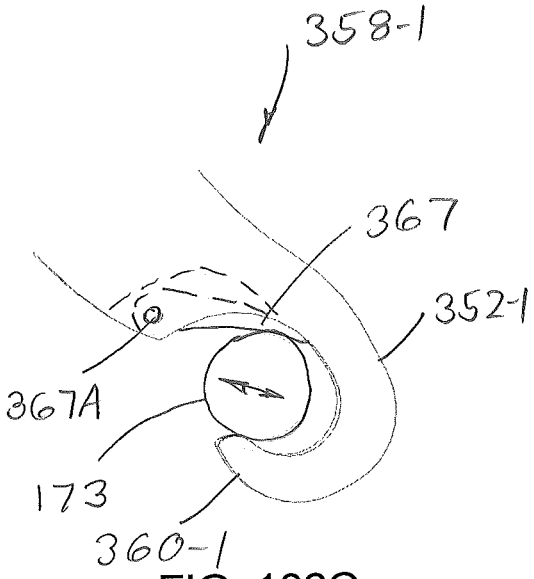
FIG. 106C is a partial enlarged side view of the hook end being engaged with a stretcher pole.

Referring to FIGS. 106A-106C, a modified construction for the pivotable arm 358 is shown and designated as arm 3358-1. While this arm 358-1 has a modified shape, it functions the same as arm 358. The arm 358-1 may be connected to the main body 357 by the pivot pin 359 that engages with one of the row of pivot bores 361-1. The lower end 352-1 of the arm 358-1 includes a connector 360-1 that preferably is formed as a hook, which is configured to latch onto the stretcher poles 173. In this arm 358-1, a securing device 366 is provided which preferably is formed as a spring-biased latch or lock 367 that is pivotally connected to the arm 358-1 by a pivot pin 367A. A biasing member 367B is provided that is preferably formed as a spring to bias the latch 367 to the locking position shown in FIG. 106B that closes off the mouth of the hook 360-1. The latch 367 can swing inwardly as shown in FIG. 106C to allow the stretcher pole 173 to slide into the mouth of the hook 360-1. Once the stretcher pole 173 is fully inserted, the latch 367 can clear the stretcher pole 173 so as to return to the locking position and restrain the stretcher pole 173 within the hook 360-1. To release the stretcher pole 173, the latch 367 can be manually pivoted inwardly so as to clear the stretcher pole 173 as seen in FIG. 106C and allow the stretcher pole 173 to be removed therefrom.

Figure 107:
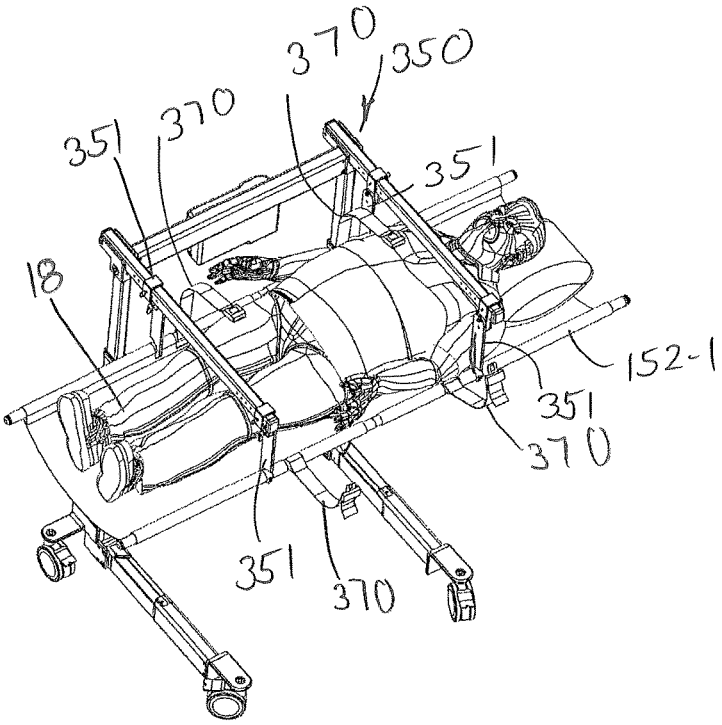
FIG. 107 is a perspective view of the transporter with a further embodiment of a stretcher unit.

Next, FIG. 107 shows a perspective view of the transporter 350 with a further embodiment of a stretcher unit 152-1 supported thereon. Notably, the stretcher unit 152-1 is suspended or carried by the above-described support brackets 351. For safety, the stretcher unit 152-1 may also include safety straps 370 for securing the patient 18 in place.

Figure 108:
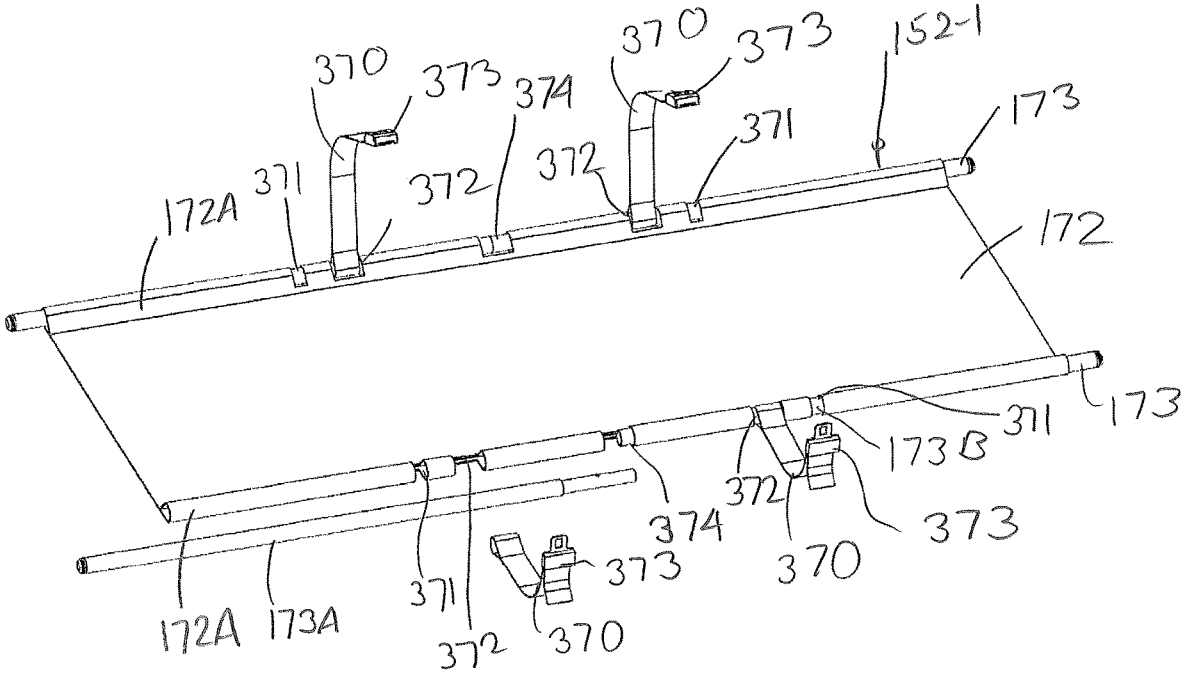
FIG. 108 is an exploded view of the stretcher unit.

In more detail as to FIG. 108, the stretcher unit 152-1 includes the stretcher poles 173 that may be formed in two parts 173A and 173B as described above. The stretcher body 172 is formed like described above with tubular edge portions 172A. In FIG. 108, the edge portions 172A also include bracket access openings, windows or slots 371 that allow the connectors 360 of the support brackets 351 to thereby engage the stretcher poles 173.

The edge portions 172A also include further strap access openings 372 which allow the safety straps 370 to engage with the stretcher poles 173. The straps 370 include hems or loops on one end through which the stretcher pole 173 can be slid to fixedly secure the safety straps 370 to the poles 173. The straps 370 are provided in mating pairs, and their free ends preferably include buckle-like connectors 373 that mate to secure the patient 18 in position for transport.

Also, the edge portions 172A may include a third set of access openings 374 to facilitate mating of the free ends of the pole sections 173A and 173B during assembly of the poles 173. In this manner, the stretcher unit 152-1 provides improved safety for the patient 18 and is readily engaged with the support brackets 351.

Figure 109:
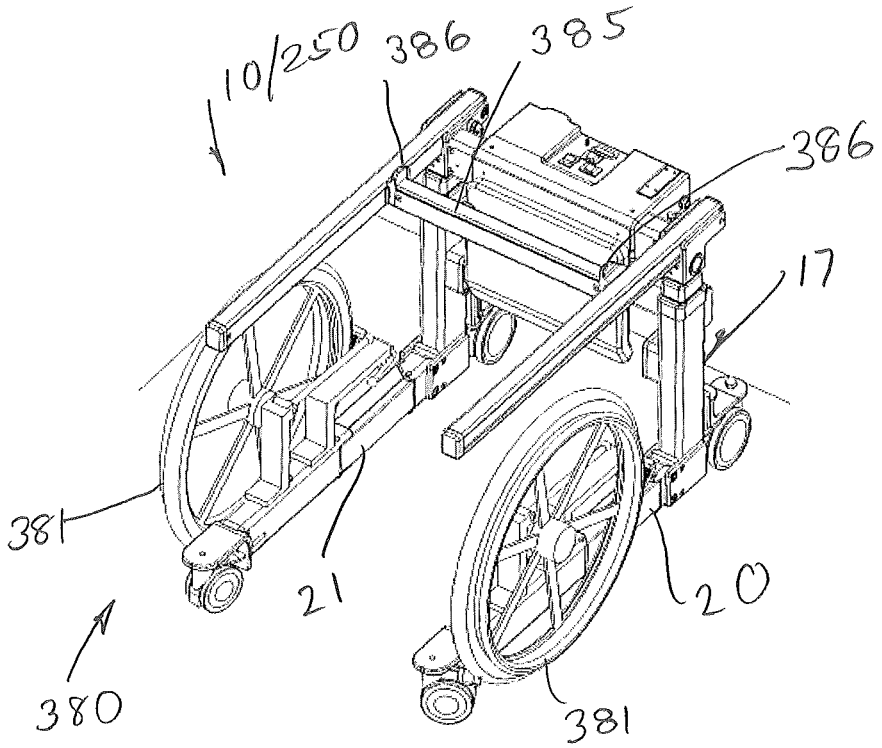
FIG. 109 is a perspective view of a lift-transfer device with a handwheel drive assembly mounted thereto.

Next, FIG. 109 is a perspective view of a lift-transfer device 10 or 250 with a handwheel drive assembly 380 mounted to the existing wheeled base 17. The drive assembly 380 comprises a handwheel drive unit 381 mounted to each of the wheel support arms 20 and 21. The common reference numeral is used for each drive unit 381 although it is apparent that the two drive unites 381 are formed as mirror images of each other depending upon whether the drive unit 381 is mounted on the left side or rights side of the wheeled base 17. The following discussion will focus on one of the drive units 381, wherein it is readily apparent that the discussion also applies to the other drive unit 381.

Figure 110:
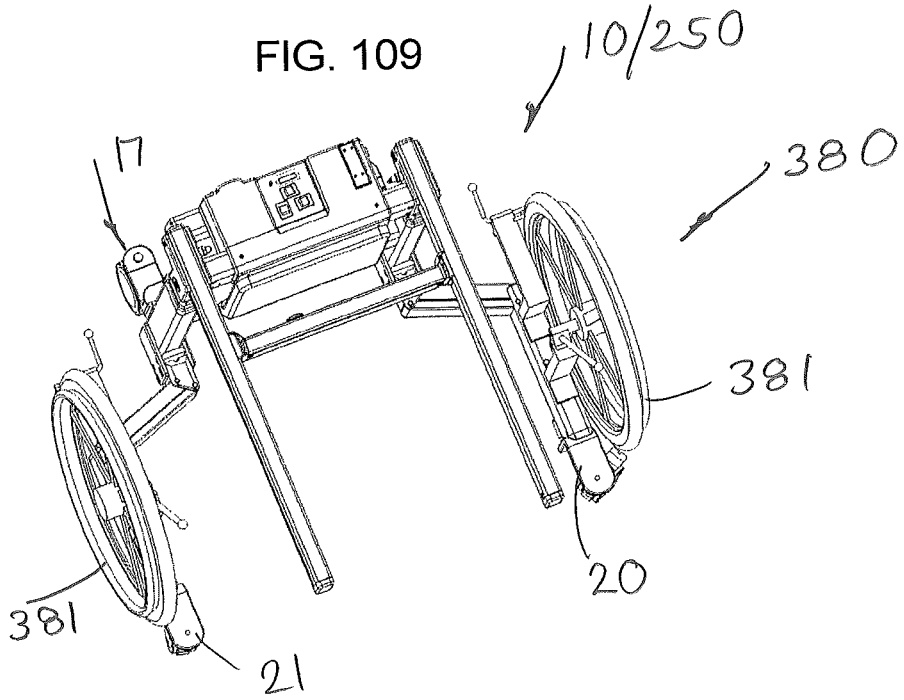
FIG. 110 is a perspective view of the lift-transfer device in an expanded condition.

Generally, any lift-transfer device 10 or 250 is usable as described above since the drive units 381 are displaceable from a use position to a stored position. FIG. 110 is a perspective view of the lift-transfer device in an expanded condition with the drive units 381 mounted in place.

Figure 111:
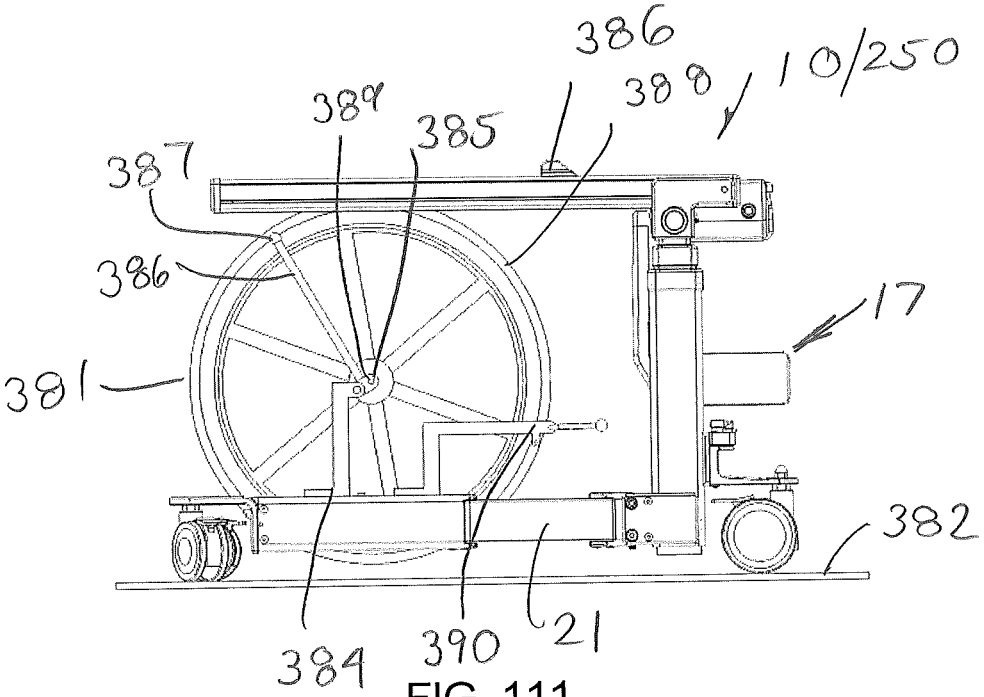
FIG. 111 is a side view showing the handwheel drive assembly in a raised condition.
Figure 112:
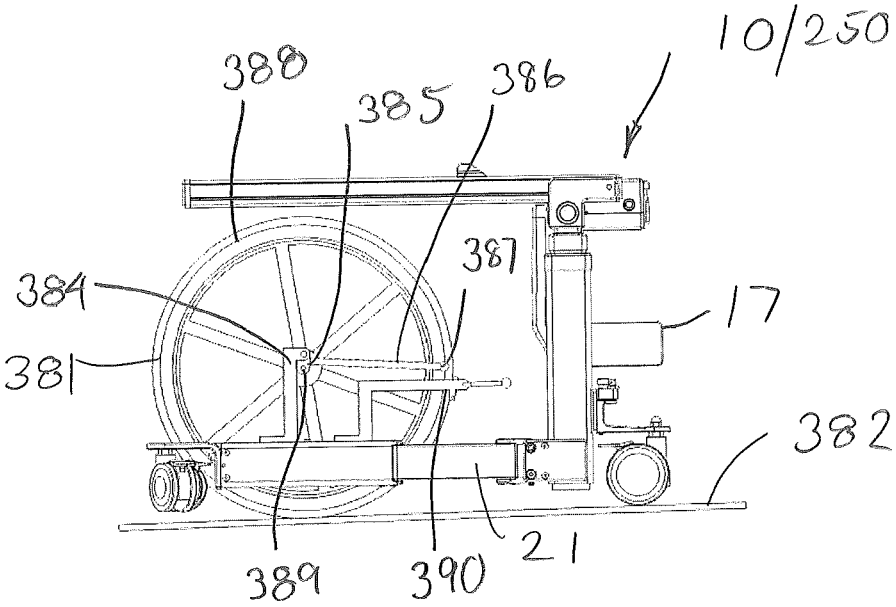
FIG. 112 is a side view showing the handwheel drive assembly in a lowered condition.

In more detail, FIG. 111 is a side view showing the drive unit 380 of the handwheel drive assembly 381 in a raised condition which allows the lift transfer device 10 to be used with the existing wheeled base 17 and moved by a caregiver as described above. FIG. 112 is a side view showing the drive unit 381 of the handwheel drive assembly 38 in a lowered condition in contact with a floor or other support surface 382 which raises or lifts the rear of the wheeled base 17 and allows the patient or occupant to manually drive the lift transfer device 10 by manual operation of the drive units 381.

In more detail, each drive unit 381 includes a mounting bracket 384 that can be preinstalled or retrofitted onto the respective one of the wheel support arms 20 or 21. The upper end of the mounting bracket 384 includes a transfer linkage 385 that preferably actuated by an actuator 386 formed as a lever 387. As seen in FIG. 111, the actuator 386 may be in a first operative condition which causes the transfer linkage 385 to lift a wheel 388 that is rotatably attached thereto by an axle 389. The actuator 386 can be rotated to the second operative position of FIG. 112 which displaces the axle 389 downwardly toward the floor 382 so that the wheel 388 not contacts the floor 382 but also lifts or raises a rear portion of the wheeled base 17 above the floor. In this condition, the wheels 388 now support the wheeled base 17 and rotation of the wheels 18 by the occupant causes displacement of the wheeled base 17 and device 10 across the floor 382 in a manner similar to a wheelchair. The length of the lever 387 is advantageous in providing sufficient torque to the transfer linkage 385 in order to lift the wheeled base 17 even when loaded with an occupant.

Figure 113:
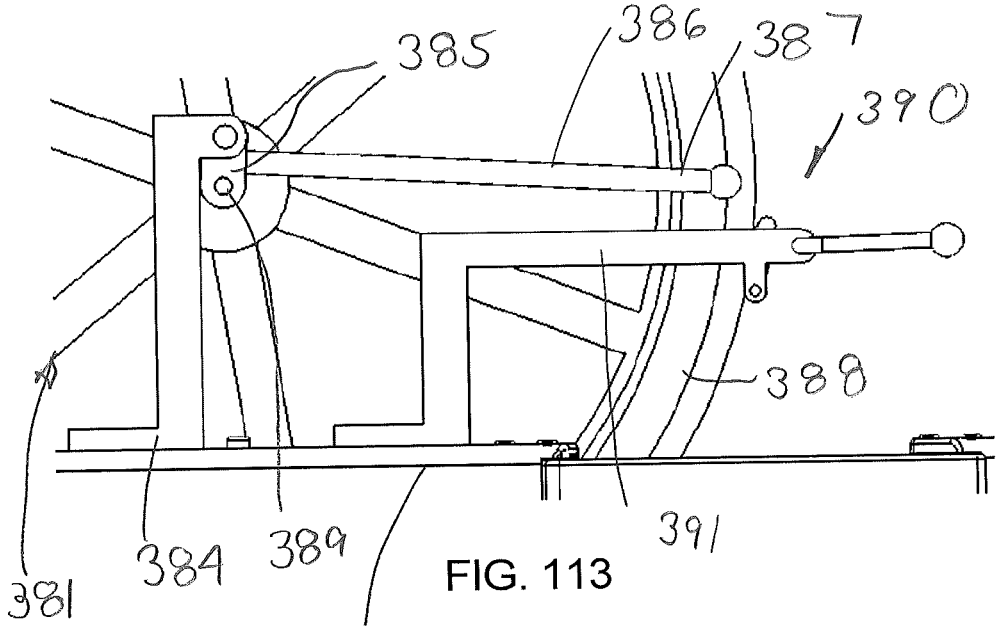
FIG. 113 is a partial interior side view of a wheel lock in a locked condition.
Figure 114:
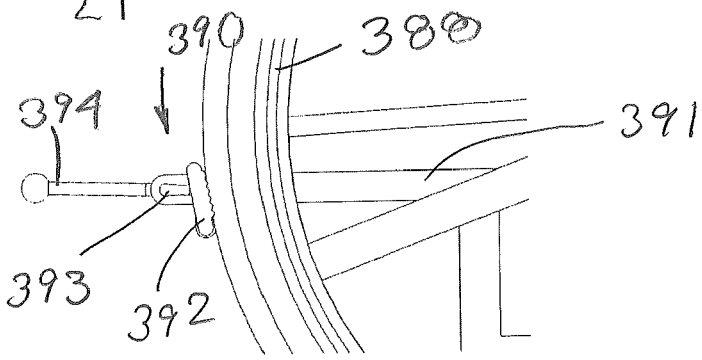
FIG. 114 is a partial exterior side view of the wheel lock in a locked condition.
Figure 115:
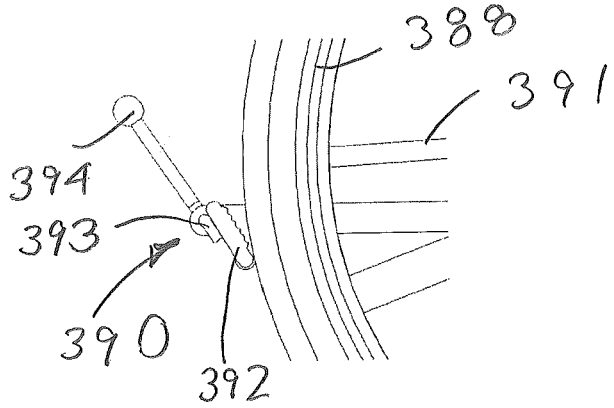
FIG. 115 is a partial exterior side view of the wheel lock in an unlocked condition.

Also, the drive unit 381 may include a brake assembly 390 as seen in FIGS. 113-115. FIG. 114 is a partial interior side view of a wheel lock or brake 390 in a locked condition, and FIG. 115 is a partial exterior side view of the wheel lock or brake 390 in an unlocked condition. In more detail, the brake 390 includes a mounting arm 391 having a brake pad 392 pivotally connected thereto. A cam actuator 393 is pivotally connected to the mounting arm 391 and includes an actuator handle 394 to rotate the cam actuator 393 and press the brake pad 392 against the wheel 388 (FIG. 114) for braking or release the brake pad 392 from the wheel 388 (FIG. 115) for unlocking of the drive units 381. In this manner, the occupant can manually engage and disengage the drive units 381, and lock same to prevent undesired movement of the lift-transfer device 10 when the drive units 381 are in use.

Additionally as seen in FIGS. 109 and 110, the crossbar 385 may include a pair of upstanding guards 386 which serve to protect the fingers and hands of an occupant if the transfer device 10 is moved below an object while the occupant's hands are resting on the crossbar 385. For example, the guards 386 can hit a table edge if the transfer device 10 is elevated too high relative to the table edge, which then allows the transfer device 10 to be lowered enough to clear the bottom of the table edge or other similar structure. These protective guards also may be seen in FIGS. 84 and 85 mounted to the cross tube 267 which basically serves as the crossbar 385 referenced above.

Figure 116:
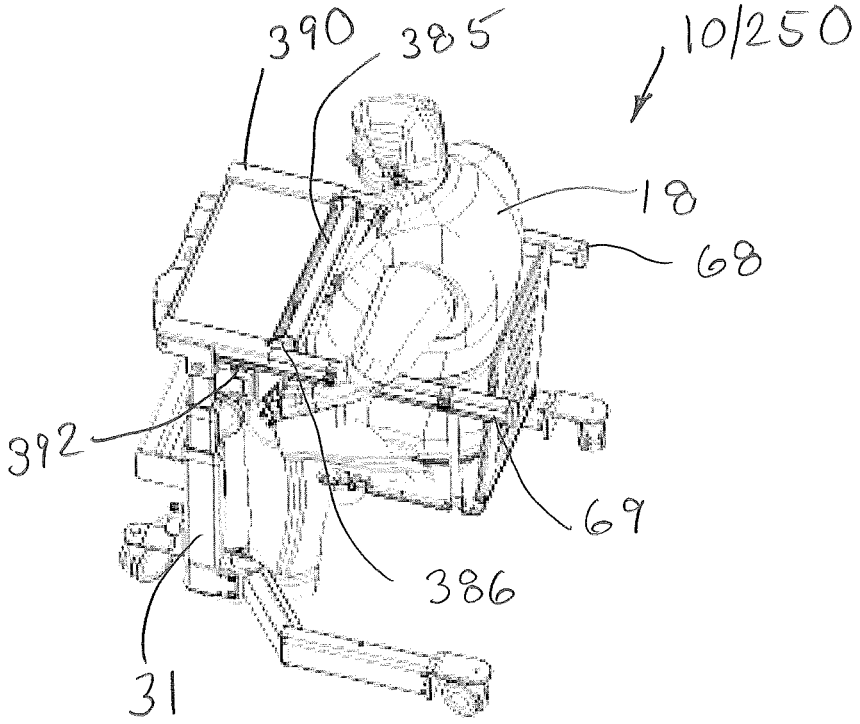
Figure 117:
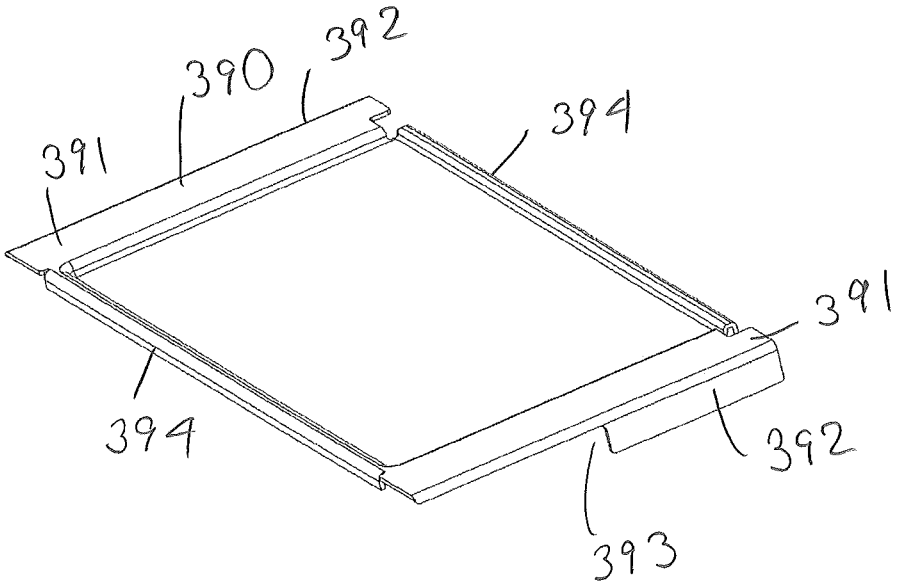

Referring next to FIGS. 116 and 117, the lift transfer device 10 may also be provided with a removable tray 390. The tray 390 includes side edges 391 with side walls 392 that define an edge channel that fits over the tops of the support rails such as the support rails 68 and 69 or the similar support rails of the lift-transfer device 250. The front edge portions of the tray 390 may have notches 393 in the side walls 392 to fit over the upper end portions of the support columns 30/31. The front and rear edges also include flanges 394 that provide rigidity and help locate the tray 390 laterally on the support rails. The tray 390 is readily removable when not in use.

Figure 118:
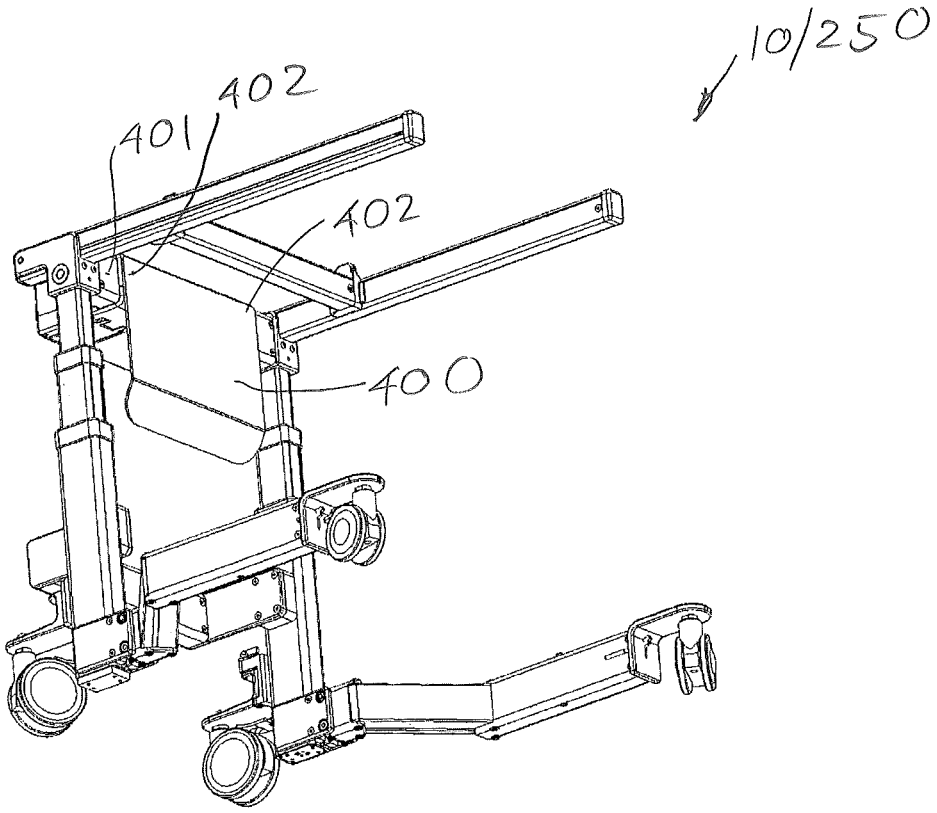
Figure 119:
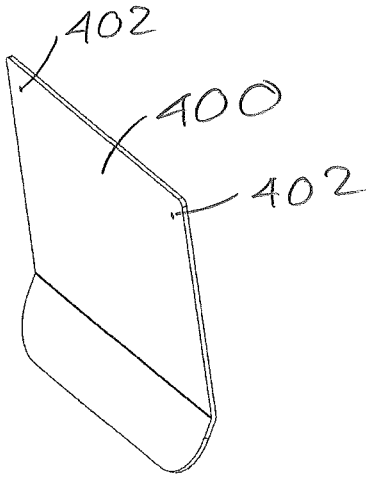
Figure 120:
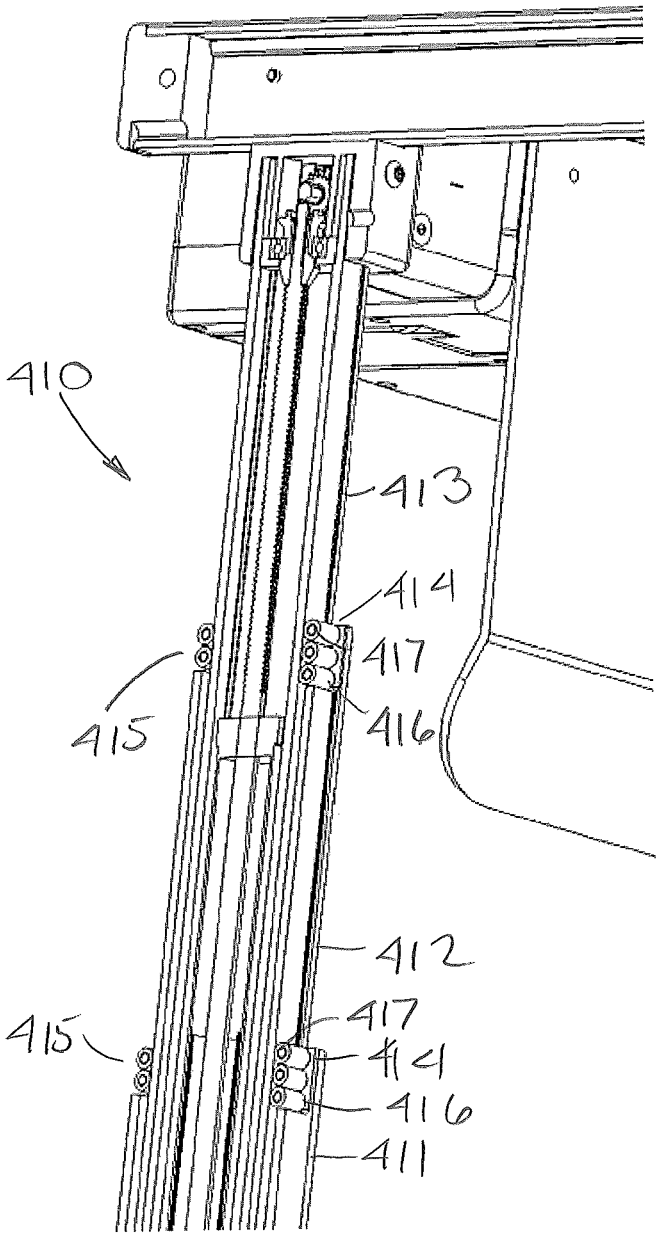

Referring to FIGS. 118 and 119, any of the above-described lift transfer devices such as the lift transfer devices 10 or 250 may include a knee guard 400 which can mount to a face 401 of the device frame such as the cross beam structure 32 described above. The knee guard 400 is secured by fasteners 402 and projects downwardly to protect the lower extremities of the occupant 18.

Referring to FIGS. 120-124, a modified construction for each post assembly 30 or 31 is shown as including the post assembly 410. The post assembly 410 includes lower, middle and upper posts 411, 412 and 413, which essentially cooperate together and function like the lower posts 51/52, middle posts 56/57 and upper posts 60/61 described above. The following disclosure relates to improvements in the post assembly 410 that allows the post assembly to be used with any of the lift-transfer devices described above.

To maintain alignment of the double telescoping lift columns 410, the lower post 411 slidably supports the middle post 412, and the upper post 413 slides within the middle post 412. Each lift column 410 has first support roller assemblies 414 on one side of the posts 411 and 412 at the upper ends thereof, and second support roller assemblies 415 on the opposite side of the upper ends of the posts 411 and 412.

The first roller assemblies 414 comprise a plurality and preferably three rollers 416 that are rotatably supported on the respective posts 411 and 412 by roller shafts 417. The second roller assemblies 415 comprise a plurality and preferably two rollers 418 that are rotatably supported on the respective posts 411 and 412 by roller shafts 419. The rollers 416 and 418 act inwardly on the exterior surfaces of the posts 412 and 413.

Further, each lift column 410 has third support roller assemblies 420 on one side of the posts 412 and 413 at the bottom ends thereof, and fourth support roller assemblies 421 on the opposite side of the lower ends of the posts 412 and 413.

The third roller assemblies 420 comprise a plurality and preferably three rollers 422 that are rotatably supported on the respective posts 412 and 413 by roller shafts 423. The fourth roller assemblies 421 comprise a plurality and preferably two rollers 424 that are rotatably supported on the respective posts 412 and 413 by roller shafts 425. Each of the rollers 422 and 424 act outwardly on the interior surfaces of the posts 411 and 412, wherein the shafts 423 and 425 fit within roller seats 427 formed in the wall of the posts. This configuration provides improved sliding of the telescoping posts 411, 412 and 413 during operation.

Figure 121:
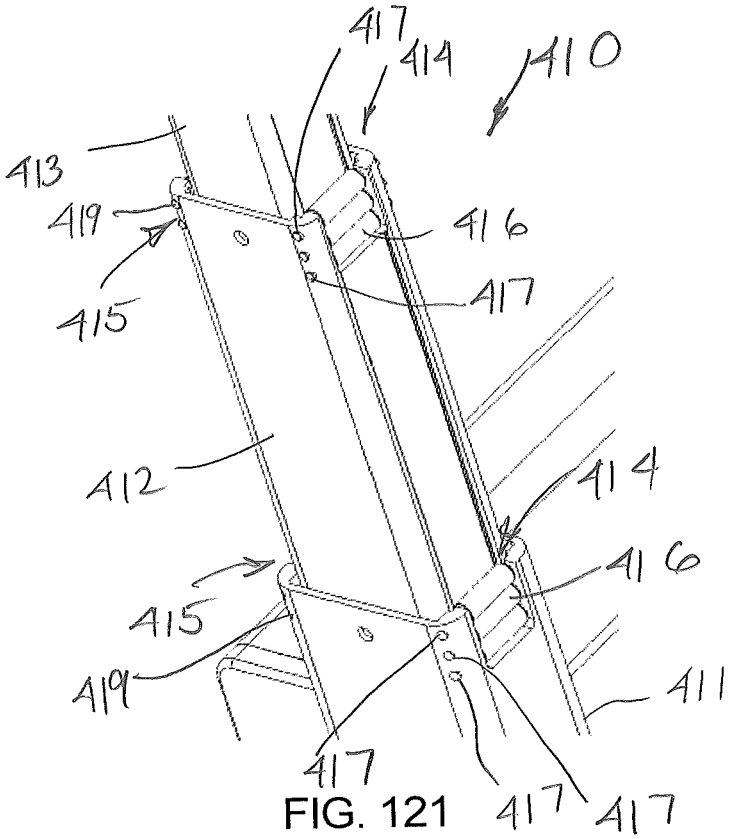
Figure 122:
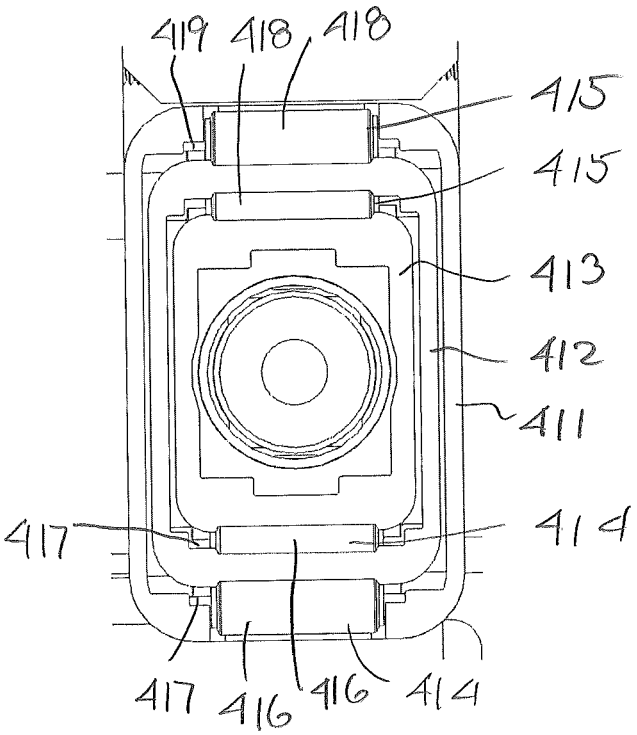
Figure 123:
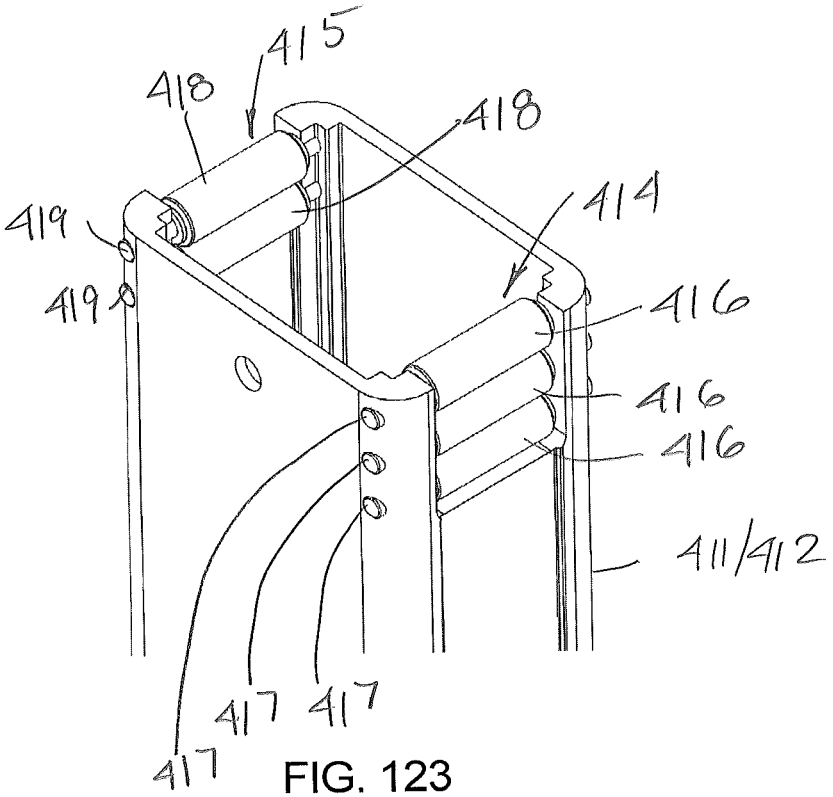
Figure 124:
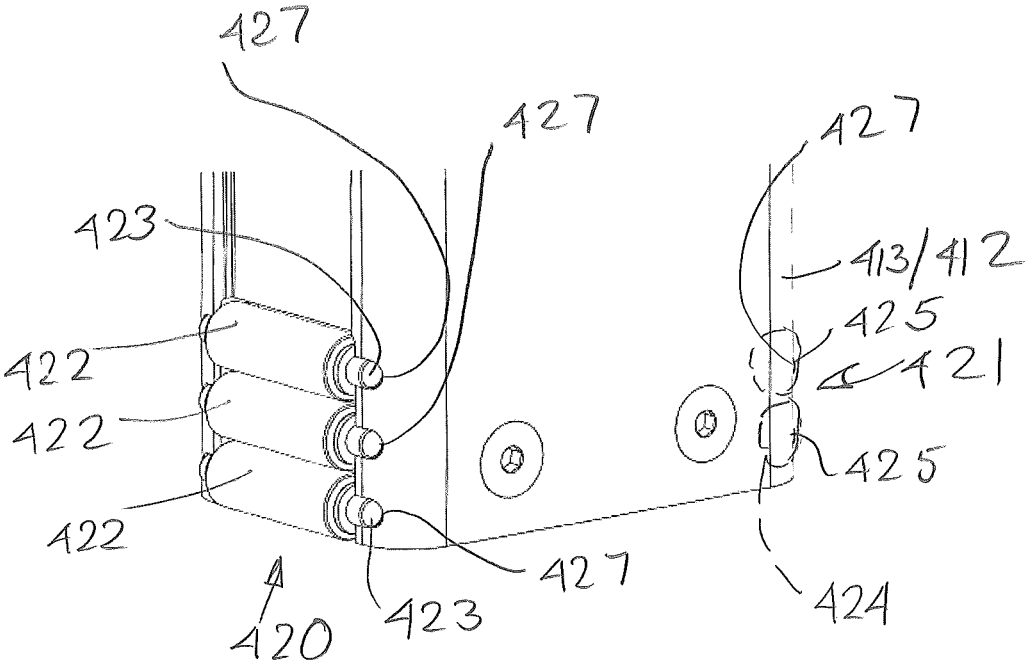

To maintain sideward alignment, the various rollers described above ride along recessed tracks formed in the side faces of the posts 411, 412 and 413 as seen in FIGS. 121 and 122 and include chamfered roller edges that fit snug into the corners of the tracks to maintain alignment of the posts relative to each other.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A patient transport device comprising:

a horizontally disposed wheeled base comprising horizontally disposed first and second wheel support arms each having a support wheel mounted near a respective first end thereof that is disposed opposite a respective second end, said first and second ends of said wheel support arms being disposed proximate front and rear sides of said patient transport device;

a lifting structure attached to said second ends of said first and second wheel support arms comprising substantially vertical first and second lifting columns and a frame structure disposed therebetween wherein said frame structure sidewardly spaces apart said first and second lifting columns and said first and second wheel support arms;

said frame structure holding said lifting columns in substantially vertical orientation, thereby forming a lifting structure and wherein said lifting structure has at least one frame wheel attached thereto, whereby said patient transport device may roll across a supporting surface while rollingly supported by said wheels;

each one of said first and second lifting columns including respective first and second patient support arms attached near the upper end thereof, wherein each one of said first and second patient support arms has a top surface and has an arm length that extends substantially parallel to the other one of said patient support arms and substantially above a respective one of said first and second wheel support arms so as to be lifted by said first and second lifting columns; and said first and second patient support arms including elongate slots formed lengthwise on at least one side thereof wherein each said slot has a slot length extending lengthwise along at least a portion of said arm length and; and a patient support unit being provided having a plurality of flexible straps which each include a respective connector clip thereon, said connector clip being removably anchored to said slot by insertion with said slot and pivoting of said clip upwardly to a locked position, wherein said strap connected to said respective clip extends over said top surface of said patient support arm such that said patient support unit is suspended from said first and second patient support arms and tension on said strap holds said clip in said locked position, said slot length being greater than said clip such that each said clip is positionable in a plurality of positions along said length of said slot to position said strap at a selected one of said plurality of positions and thereby vary a position of each strap along said length of said patient support arm.

2. A patient transport device as in claim 1 wherein said patient support unit comprises a seat.

3. A patient transport device as in claim 1 wherein said patient support unit comprises a flexible sling.

4. A patient transport device as in claim 3 wherein said patient support unit comprises a seat supported by a respective plurality of said straps and said clips anchored to said first and second patient support arms, wherein said clips permit adjustment of a length of said straps.

5. A patient transport device as in claim 4 wherein said sling is supported by a respective plurality of said straps and said clips, wherein said clips permit adjustment of a length of said straps and a position of said sling define by said straps connected thereto is adjustable independently of a position of said seat defined by said straps connected thereto.

6. A patient transport device according to claim 1, wherein said first and second patient support arms have a profile that defines said respective slot, which said slot is defined by an upstanding slot wall and an interior groove, said clip being insertable into said interior groove and being pivotable about an upper edge of said slot wall under said tension of said strap.

7. A patient transport device comprising:

a horizontally disposed wheeled base comprising horizontally disposed first and second wheel support arms each having a support wheel mounted near a respective first end thereof that is disposed opposite a respective second end, said first and second ends being disposed proximate to rear and front sides of said patient transport device;

a lifting structure attached to said second ends of said first and second wheel support arms comprising substantially vertical first and second lifting columns and a frame structure disposed therebetween wherein said frame structure sidewardly spaces apart said first and second lifting columns and said first and second wheel support arms;

said frame structure holding said lifting columns in substantially vertical orientation, thereby forming a lifting structure and wherein said lifting structure has at least one frame wheel attached thereto, whereby said patient transport device may roll across a supporting surface while rollingly supported by said wheels;

each one of said first and second lifting columns including respective first and second patient support arms attached near the upper end thereof, wherein each one of said first and second patient support arms extends substantially parallel to the other one of said patient lifting arms and substantially above a respective one of said first and second wheel support arms so as to be lifted by said first and second lifting columns; and said first and second patient support arms including elongate slots formed lengthwise on at least one side thereof, said elongate slots having a slot length extending lengthwise between opposite first and second ends thereof such that said first and second ends of each said slot are disposed proximate said rear and front sides of aid patient transport device; and a patient support unit being provided having a plurality of flexible straps which each include a connector clip thereon, said connector clip being removably anchored to said slot by insertion with said slot and pivoting of said clip upwardly to a locked position, wherein said strap connected to said clip extends over a top surface of said patient support arm such that said patient support unit is suspended from said first and second patient support arms and tension on said strap holds said clip in said locked position, each said clip being positionable along said slot length of said slot so that said clip can be positioned at one of opposite end positions located proximate said front side and said rear side of said patient transport device and a plurality of intermediate positions between said opposite end positions.

8. A patient transport device as in claim 7, wherein said patient support unit comprises a seat.

9. A patient transport device as in claim 8, wherein said seat is provided with a respective plurality of said straps and said clips anchored to said first and second patient support arms, wherein said clips permit adjustment of a length of said straps.

10. A patient transport device as in claim 7, wherein said patient support unit comprises a flexible sling.

11. A patient transport device as in claim 10, wherein said sling is supported by a respective plurality of said straps and said clips, wherein said clips permit adjustment of a length of said straps and a position of said sling define by said straps connected thereto is adjustable independently of a position of said seat defined by said straps connected thereto.

12. A patient transport device according to claim 7, wherein said first and second patient support arms have a profile that defines said respective slot, which said slot is defined by an upstanding slot wall and an interior groove.

13. A patient transport device according to claim 12, wherein said slot wall and said interior groove define an open slot mouth extending lengthwise to receive said clip therein and allow said clip to slide along said slot mouth.

14. A patient transport device according to claim 13, wherein said clip comprises a main body having a stepped hook that fits sidewardly into said lot mouth.

15. A patient transport device according to claim 14, wherein said hook is insertable sidewardly into said slot and is pivotable upwardly about a top edge of said slot wall wherein said hook abuts against an interior surface of said slot wall to securely anchor said clip in position under said tension of said strap while permitting sliding of said clip along said slot.

* * * * *